US006460984B1

(12) United States Patent
Matsumoto et al.

(10) Patent No.: US 6,460,984 B1
(45) Date of Patent: Oct. 8, 2002

(54) LIQUID SUPPLY SYSTEM, LIQUID CONTAINER, HEAD CARTRIDGE, INK JET CARTRIDGE, LIQUID SUPPLY CONTAINER, METHOD FOR COUPLING THE HEAD CARTRIDGE WITH THE LIQUID SUPPLY CONTAINER, COMMUNICATION UNIT USED FOR THE LIQUID SUPPLY SYSTEM, INK JET RECORDING APPARATUS PROVIDED WITH THE INK JET CARTRIDGE OPENING/CLOSING VALVE USED FOR THE LIQUID CONTAINER, AND LIQUID SUPPLY CONTAINER PROVIDED WITH THE OPENING/CLOSING VALVE

(75) Inventors: Hidehisa Matsumoto, Kawasaki (JP); Hiroyuki Ishinaga, Tokyo (JP); Jun Hinami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/301,129

(22) Filed: Apr. 28, 1999

(30) Foreign Application Priority Data

| | | |
|---|---|---|
| Apr. 28, 1998 | (JP) | 10-119353 |
| Apr. 28, 1998 | (JP) | 10-119354 |
| Apr. 28, 1998 | (JP) | 10-119355 |
| Apr. 28, 1998 | (JP) | 10-119356 |
| Apr. 28, 1998 | (JP) | 10-119357 |
| Dec. 24, 1998 | (JP) | 10-368065 |

(51) Int. Cl.[7] ..... B41J 2/175
(52) U.S. Cl. ..... 347/86
(58) Field of Search ..... 347/84, 85, 86, 347/87, 49

(56) References Cited

U.S. PATENT DOCUMENTS

| | | | | |
|---|---|---|---|---|
| 4,368,478 A | * | 1/1983 | Koto | 347/86 |
| 5,509,140 A | | 4/1996 | Koitabashi et al. | 347/86 |
| 5,619,238 A | | 4/1997 | Higuma et al. | 347/86 |
| 5,784,088 A | * | 7/1998 | Ujita et al. | 347/86 |
| 5,886,721 A | * | 3/1999 | Fujii et al. | 347/87 |
| 5,903,294 A | * | 5/1999 | Abe et al. | 347/87 |
| 5,949,456 A | | 9/1999 | Matsumoto et al. | 347/85 |
| 5,975,330 A | | 11/1999 | Sasaki et al. | 220/495.01 |
| 6,022,102 A | * | 2/2000 | Ikkatai et al. | 347/85 |
| 6,183,075 B1 | | 2/2001 | Sasaki | 347/86 |

FOREIGN PATENT DOCUMENTS

| | | |
|---|---|---|
| DE | 3544328 | 6/1987 |
| EP | 322131 | 6/1989 |

(List continued on next page.)

*Primary Examiner*—Michael Nghiem
(74) *Attorney, Agent, or Firm*—Fitzpatrick, Cella, Harper & Scinto

(57) ABSTRACT

A liquid supply system includes a liquid supply container provided with a liquid accommodating portion being deformable by storing liquid in the closed space to be able to generate negative pressure, a liquid supply unit detachably mountable on the liquid supply container to contain the capillary force generating material retaining liquid therein, and at the same time, to supply liquid to the outside, a container for the capillary force generating material provided with an air communication unit communicating with the air outside to be able to generate the gas-liquid exchange for leading out liquid by introducing gas into the liquid accommodating portion through the communication unit connected with the liquid supply container, and the communication unit being arranged on the upper surface of the container for the capillary force generating material, at the same time, the liquid supply container being arranged above the container for the capillary force generating material through the communication unit to shaft liquid in the liquid supply container to the container for the capillary force generating material.

38 Claims, 51 Drawing Sheets

FOREIGN PATENT DOCUMENTS

| | | | |
|---|---|---|---|
| EP | 529 879 | * | 3/1993 |
| EP | 577439 | | 1/1994 |
| EP | 580433 | | 1/1994 |
| EP | 581531 | | 2/1994 |
| EP | 711 667 | * | 5/1996 |
| EP | 712727 | | 5/1996 |
| EP | 738 605 | * | 10/1996 |
| EP | 791466 | | 8/1997 |
| EP | 816098 | | 1/1998 |
| EP | 829363 | | 3/1998 |
| JP | 55-151572 | * | 10/1980 |
| JP | 3-289441 | | 12/1991 |
| JP | 5-318758 | | 12/1993 |
| JP | 6-320749 | | 11/1994 |
| JP | 7-68782 | | 3/1995 |
| JP | 8-034122 | | 2/1996 |
| JP | 10-175311 | | 6/1998 |

* cited by examiner

LIQUID SUPPLY SYSTEM, LIQUID CONTAINER, HEAD CARTRIDGE, INK JET CARTRIDGE, LIQUID SUPPLY CONTAINER, METHOD FOR COUPLING THE HEAD CARTRIDGE WITH THE LIQUID SUPPLY CONTAINER, COMMUNICATION UNIT USED FOR THE LIQUID SUPPLY SYSTEM, INK JET RECORDING APPARATUS PROVIDED WITH THE INK JET CARTRIDGE OPENING/CLOSING VALVE USED FOR THE LIQUID CONTAINER, AND LIQUID SUPPLY CONTAINER PROVIDED WITH THE OPENING/CLOSING VALVE

BACKGROUND OF THE INVENTION

1. Field of the Invention

The present invention relates to a liquid supply system that utilizes the negative pressure exerted for supplying liquid to the outside. More particularly, the invention relates to a liquid supply system for a liquid jet recording apparatus that prints on a recording medium for recording by supplying the liquid to the recording head. The invention also relates to a liquid container, a head cartridge, an ink jet cartridge, a liquid supply container, a method for coupling the head cartridge with the liquid supply container, a communication unit used for the liquid supply system, an ink jet recording apparatus provided with the ink jet cartridge, an opening/closing valve used for the liquid container, and a liquid supply container provided with the opening/closing valve.

2. Related Background Art

As the conventional liquid supply system that utilizes the negative pressure in order to supply liquid to the outside, there has been proposed an ink container that provides the negative pressure for the ink jet head in the field of the ink jet recording apparatus, for example. Practically, then, there has been adopted the structure that enables the ink container and the recording head to be unified (as an ink jet cartridge). The ink jet cartridge is further classified into the structure in which the recording head and the ink container (an ink accomodating portion) are made always as one body, and the structure in which recording means and an ink accomodating portion are made as separate bodies, and then, these are made separable for the recording apparatus, but integrated when used.

As one of the easiest methods to exert the negative pressure in a liquid supply system of the kind, there may be cited a method that utilizes the capillary force of a porous substance. The ink container used for such method is structured to contain ink entirely in the interior of the ink container which serves as an ink reservoir or, preferably, to contain a porous substance, such as sponge, compressed for storage, and an atmospheric communication port should be arranged to intake the outside air into the ink container for the smoother ink supply when printing is in operation.

However, there is a problem for using a porous member as an ink container, because the ink storage efficiency is low in terms of each unit volume. In order to solve this problem, the applicant hereof has proposed an ink container in the publication of EPO 580433, which is provided with the ink accomodating chamber that is closed essentially from the entire chamber that contains the material for generating the negative pressure with the exception of the communication unit, and which is used in a state where the chamber that contains the negative pressure generating material is open to the air outside. Also, in the publication of EPO 581531, the invention is proposed so that the ink accomodating chamber is made exchangeable for the ink container described above.

In this ink container, ink is supplied from the ink accomodating chamber to the chamber that contains the negative pressure generating material by the operation of the gas-liquid exchange which causes the gas to be contained in the ink accomodating chamber along with the ink which is led out from the ink accomodating chamber. As a result, there is an advantage that ink can be supplied substantially under the constant condition of the negative pressure during the operation of the gas-liquid exchange.

On the other hand, the applicant hereof has proposed in the publication of EPO 738605 the liquid container characterized in that the liquid container is provided with a housing in the configuration of substantially polygonal column, and also, with a storage unit whose outer surface is equal or analogous to the inner surface of the housing, which is made deformable along with the liquid being led out from the interior thereof, and that the thickness of the storage unit is made thinner on each portion formed between each of the corners and the central part of each surface of such polygonal column. The storage unit of this liquid container is contracted appropriately as the liquid is led out (no gas-liquid exchange takes place phenomenally). In this way, while utilizing the negative pressure, liquid can be supplied. Therefore, as compared with the conventional bag type ink container material, this storage unit is more freely positioned for its arrangement to make it possible to mount it on the carriage appropriately. Also, this invention is excellent in that ink can be stored in the storage unit directly and the ink storage efficiency is improved accordingly.

Now, the ink container of the type where the chamber that contains the negative pressure generating material is arranged together with the adjacent ink accomodating chamber is formed to perform the gas-liquid exchange that introduces the gas into the ink accomodating chamber when ink in the ink accomodating chamber, which has a storage space fixed in advance, is supplied to the chamber that contains the negative pressure generating material.

Therefore, interlocked with the supply of ink from the ink accomodating chamber to the chamber that contains the negative pressure generating material, the air outside is introduced corresponding to the amount of ink into the ink accomodating chamber. In this chamber, therefore, both the air outside and ink are present. This air outside may be caused to expand depending on the changes of the environment under which a printer is used (the temperature difference in a day, for example). In such a case, ink is led out from the ink accomodating chamber to the chamber that contains the negative pressure generating material. Here, in accordance with the conventional art, the amount of ink shift should be considered with respect to such ratio of expansion together with various environments under which ink is used. In practice, therefore, the maximum buffer space should be provided inevitably for the negative pressure generating member. Then, it becomes impossible to make the resultant inner volume greater as desired in some cases.

SUMMARY OF THE INVENTION

It is an object of the invention to provide the liquid supply system having an excellent practicability in a better condition capable of supplying ink under the stabilized negative pressure irrespective of the various environments of the use under the liquid supply system provided with the replaceable ink accomodating chamber (liquid container), as well as to provide the replaceable liquid container to be used for this system.

In addition, as other objectives hereof, various related inventions will be provided with respect to the valve, the installation mechanism, and the like to which the aforesaid liquid supply system is effectively applicable.

Here, with respect to the ink container of the type in which the chamber that contains the negative pressure generating material and the ink accomodating chamber are arranged adjacent to each other, the inventors hereof have precisely analyzed the status of the ink accomodating chamber having the air introduced into it.

Now, from the fact that the ink supply from the ink accomodating chamber to the chamber that contains the negative pressure generating material is interlocked with the introduction of gas, it has been found as a new knowledge that the amount of ink should be regulated appropriately when ink shifts from the ink accomodating chamber to the negative pressure generating material.

Then, with the further analysis, it has been found that it is impossible to block the expansion of the air residing in the ink accomodating chamber, which may be brought about by the environmental changes, but the inventors hereof have successfully concluded that the conventional thought should be inverted so as to allow the expansion of the air in the ink accomodating chamber to materialize the new idea in this respect.

In order to achieve the objectives discussed above, the invention is based upon the completely new idea, and the specific means therefor will be apparent from the structures given below.

Now, a liquid supply system comprises a liquid supply container provided with a liquid accomodating portion being deformable by storing liquid in the closed space to be able to generate negative pressure; a liquid supply unit detachably mountable on the liquid supply container to contain the capillary force generating material retaining liquid therein, and at the same time, to supply liquid to the outside; a container for the capillary force generating material provided with an air communication unit communicating with the air outside to be able to generate the gas-liquid exchange for leading out liquid by introducing gas into the liquid accomodating portion through the communication unit connected with the liquid supply container. For this liquid supply system, the communication unit is arranged on the upper surface of the container for the capillary force generating material, at the same time, the liquid supply container being arranged above the container for the capillary force generating material through the communication unit to shift liquid in the liquid supply container to the container for the capillary force generating material.

Also, a liquid container comprises a chamber for the capillary force generating material containing the capillary force generating material capable of retaining liquid therein, provided with a liquid supply unit to supply liquid to the outside, and the air communication unit to communicate with the air outside; and a liquid supply chamber arranged above the capillary force generating material provided with a liquid accomodating portion communicated with the chamber for containing the capillary force generating material, being capable of forming substantially the closed space with the exception of the communication with the chamber for containing the capillary force generating material. For this liquid container, the liquid accomodating portion is structured by the member capable of being deformed to generate negative pressure along with liquid to be led out, and the communication unit between the chamber for containing the capillary force generating material and the liquid supply chamber being arranged on the upper surface of the chamber for containing the capillary force generating material.

Also, a head cartridge which holds a liquid supply container attachably and detachably is provided with a liquid accomodating portion capable of generating negative pressure with deformation by containing liquid in the closed space. This head cartridge comprises a recording head unit for discharging liquid to the outside; a chamber for the capillary force generating material containing the capillary force generating material to hold liquid therein, being provided the liquid supply unit to supply liquid to the recording head unit, and the air communication unit to communicate with the air outside; a communication unit arranged on the upper surface of the chamber for containing the capillary force generating material to communicate the liquid accomodating portion with the chamber for containing the capillary force generating material; and a coupling structure to engage with the liquid supply container for holding the liquid supply container on the chamber for containing the capillary force generating material in the state of the liquid accomodating portion being communicated with the chamber for containing the capillary force generating material by the communication unit.

Also, an ink jet cartridge comprises a recording head unit for discharging liquid to the outside; a chamber for the capillary force generating material containing the capillary force generating material to hold liquid therein, being provided with the liquid supply unit to supply liquid to the recording head unit, and the air communication unit to communicate with the air outside; a liquid supply chamber arranged on the upper surface of the capillary force generating material to form substantially the closed space by communicating with the chamber for containing the capillary force generating material with the exception of the communication with the chamber for containing the capillary force generating material. For this ink jet cartridge, the liquid accomodating portion is structured by the member capable of generating negative pressure along with the liquid to be led out from the liquid accomodating portion.

Also, a liquid supply container is provided with a liquid supply unit to supply liquid to the outside, and an air communication unit communicated with the air outside, being exchangeable and detachably mountable on the container for the capillary force generating material containing the capillary force generating material to be able to hold liquid therein, at the same time, having the communication unit on the upper part thereof. This liquid supply container comprises an opening arranged to be connected with the communication unit on the lower face in the state of being used; a liquid supply container having substantially closed space with the exception of the opening, at the same time, being able to generate negative pressure with the deformation along with liquid contained therein to be led out; and a sealing material to seal the opening.

Also, a head cartridge is made capable of separating freely the detachably mountable liquid supply container for containing liquid. This head cartridge comprises a recording head unit for discharging liquid to the outside; a chamber for the capillary force generating material containing the capillary force generating material to hold liquid therein, being provided with the liquid supply unit to supply liquid to the recording head unit, and the air communication unit to communicate with the air outside; a supply tube provided for the chamber for containing the capillary force generating material to communicate the liquid supply container with the chamber for containing the capillary force generating material when the liquid supply container is installed. For this head cartridge, the supply tube is provided with an opening different from the opening for the supply use to supply mainly liquid from the liquid supply container, and also, the opening is in the state substantially communicated with the capillary force generating material.

Also, a head cartridge is capable of separating freely the detachably mountable liquid supply container for containing liquid, and comprises a recording head unit to supply liquid to the outside; a supply tube to communicate the liquid supply container with the recording head by installing the liquid supply container; a closing member surrounding the base of the supply tube, at the same time, closing the space on the circumference of the supply tube from the outside when the liquid supply container is install, and an opening different from the opening for use of liquid supply being arranged on the side face of the supply tube.

Also, an ink jet cartridge comprises a recording head unit to discharge ink to the outside; a chamber for the capillary force generating material containing the capillary force generating material capable of holding liquid therein which is provided with the liquid supply unit to supply liquid to the recording head unit, and the air communication unit communicated with the air outside; a liquid supply container is provided with the liquid accomodating portion separably arranged to be detachably mountable on the chamber for containing the capillary force generating material to form substantially closed space when installed on the chamber for containing the capillary force generating material, at the same time, being provided with a liquid accomodating portion for storing liquid; a supply tube arranged for the chamber for containing the capillary force generating material to communicate the liquid accomodating portion with the capillary force generating material when installed on the liquid supply container. For this ink jet cartridge, the supply tube is provided with an opening different from the opening for supply use to supply mainly liquid from the liquid supply container, and also, the opening which is substantially in the communicating state with the capillary force generating material.

Also, an ink jet cartridge comprises a recording head unit to discharge ink to the outside; a liquid supply container provided with the liquid accomodating portion separably arranged to be detachably mountable on the recording head to form substantially closed space when installed on the recording head unit, at the same time, being provided with a liquid accomodating portion for storing liquid; a supply tube arranged for the recording head unit to communicate the liquid accomodating portion with the recording head unit when the liquid supply container is installed, and a closing member surrounding the recording head unit, at the same time, closing the space on the circumference of the supply tube from the outside in the sate of the liquid supply container being installed on the recording head unit. For this ink jet cartridge, an opening, which is different from the opening for use of liquid supply, is arranged on the side face of the supply tube.

In order to achieve the objectives of the invention, an ink jet recording apparatus hereof comprises an ink jet cartridge referred to either one of the preceding paragraphs, and also, holding means to hold the ink jet cartridge. This ink jet apparatus discharges liquid from the recording head unit of the ink jet cartridge in accordance with electric signals provided for discharging liquid.

Also, a method for coupling is to couple a head cartridge having a recording head unit to discharge liquid to the outside with a liquid supply container provided with a liquid accomodating portion to store liquid to be supplied to the recording head unit, which is made separable and detachably mountable on the recording head unit. This method comprises the steps of closing the opening of the recording head unit and the liquid accomodating portion including the supply tube having an opening on the side face arranged for the recording head unit to make this opening one closed space; inserting the supply tube into the liquid accomodating portion of the liquid supply container; and shifting liquid in the liquid accomodating portion from the opening into the supply tube.

Also, a liquid supply system comprises a liquid supply container provided with a liquid accomodating portion for storing liquid in a closed space, being capable of generating negative pressure by being deformed; a container for the capillary force generating material which is detachably mountable on the liquid supply container and also, provided with the capillary force generating material capable of holding liquid, an air communication unit communicated with the air outside, and a liquid supply unit to supply liquid to the outside. For this liquid supply system, the communication unit for communicating the liquid supply container with the container for the capillary force generating material is provided with a gas preference introducing passage to introduce gas priority into the liquid supply container, and a liquid led-out passage to lead out liquid from the liquid supply container.

Also, a communication unit used for the liquid supply system comprises a liquid supply container for containing liquid in the closed space, being provided with a liquid accomodating portion capable of generating negative pressure by being deformed; a container for the capillary force generating material which is detachably mountable on the liquid supply container, and also, provided with the capillary force generating material, the air communication unit communicated with the air outside, and the liquid supply unit to supply liquid to the outside. In this communication unit, the liquid supply container is provided with a gas preference introducing passage to introduce gas priority into the liquid supply container, and a liquid led-out passage to lead out liquid from the liquid supply container.

Also, an ink jet cartridge comprises a recording head unit for discharging liquid to the outside; a chamber for the capillary force generating material containing the capillary force generating material to hold liquid therein, which is provided with the liquid supply unit to supply liquid to the recording head unit, and then, a liquid accomodating portion for containing liquid in the closed space to be able to generate negative pressure by being deformed, and a liquid supply container which is detachably mountable on the chamber for capillary force generating material. In this ink cartridge, the communication unit of the liquid supply container and the chamber for the capillary force generating material is provided with a gas preference introducing passage to introduce gas priority into the liquid supply container, and a liquid led-out passage to lead out liquid from the liquid supply container.

Also, a head cartridge which is capable of detachably mounting a liquid supply container is provided with the liquid accomodating portion deformable by containing liquid in the closed space capable of generating negative pressure. This head cartridge comprises a recording head unit to discharge liquid to the outside; and a chamber for the capillary force generating material containing the capillary force generating material capable of holding liquid in it which is provided with a liquid supply unit to supply liquid to the recording head unit, and an air communication unit communicated with the air outside. In this head cartridge, the chamber for the capillary force generating material is integrally arranged together with the recording head unit, and at the same time, the communication unit of the chamber for the capillary force generating material communicated with the liquid supply container is provided with a gas preference introducing passage to introduce gas priority to the liquid supply container, and a liquid led-out passage to lead out liquid from the liquid supply container.

Also, a liquid supply container is provided with a liquid supply unit to supply liquid to the outside, and an air communication unit communicated with the air outside. This container is exchangeable and detachably mountable on the container for the capillary force generating material containing the capillary force generating material, which is made capable of holding liquid in it. The container comprises a liquid accomodating portion which forms substantially closed space for the container for the capillary force generating material with the exception of the communication unit, at the same time, being deformable along with liquid contained in the interior thereof to be lead out to be able to generate negative pressure; and a liquid led-out passage to lead out liquid to the container for the capillary force generating material as well as a gas preference introducing passage to introduce gas priority to the container for the capillary force generating material, which are formed for the communication unit.

Also, a replaceable liquid supply container is provided with a liquid accomodating portion to store liquid, and a plurality of liquid supply units to supply liquid in the liquid accomodating portion to the outside, which is detachably mountable on a tank holder having a coupling unit formed to couple with the liquid supply unit. This replaceable liquid supply container comprises the plurality of liquid supply units which are arranged on the portion becoming the bottom when the liquid supply container is in the use condition, and a first latch lever provided with a first coupling portion elastically arranged on one side face of the liquid supply container to engage with a first hooking portion formed on the tank holder, and a second latch lever provided with a second coupling portion elastically arranged on the other side face opposite to the side face having the first latch lever to engage with a second hooking portion formed on the tank holder, at the same time. Then, the pair of side faces provided with the first and second latch levers are arranged to expand in the attaching and detaching direction of the tank holder.

Also, a replaceable liquid supply container is provided with a liquid accomodating portion to store liquid, and a liquid supply unit to supply liquid in the liquid accomodating portion to the outside, which is detachably mountable on a tank holder having a coupling unit formed to couple with the liquid supply unit. This replaceable liquid supply container comprises the liquid supply unit arranged on the portion becoming the bottom when the liquid supply container is in the use condition, and a first latch lever provided with a first coupling portion elastically arranged on one side face of the liquid supply container to engage with a first hooking portion formed on the tank holder, and a second latch lever provided with a second coupling portion elastically arranged on the other side face opposite to the side face having the first latch lever to engage with a second hooking portion formed on the tank holder, at the same time. Then, the first and second latch levers being configured to be inclined or bent from the area near the bottom of the side faces toward upwardly, and the pair of facing side faces provided with the first and second latch levers being arranged to expand in the attaching and detaching direction of the tank holder.

Also, an ink jet head cartridge is provided with the opening for inserting the liquid container for reservoiring liquid used for recording to hold the liquid container to be freely attached and detached, at the same time, having a recording head unit to discharge the liquid. This ink jet head cartridge comprises an ink communication tube communicated with the liquid supply unit arranged on the portion becoming the bottom in the use condition of the liquid container; a first hooking portion to engage with a first latch lever arranged on one side face of the liquid container; and a second hooking portion arranged on the other side face opposite to the side having the first hooking portion to engage with a second latch lever provided for the liquid container.

In order to achieve the objectives of the invention discussed above, an ink jet recording apparatus comprises an ink jet cartridge referred to either one of the preceding paragraphs; and a carriage which holds the ink cartridge freely attached and detached, and supported to be able to reciprocate along the surface of a recording medium. This ink jet recording apparatus performs recording on the recording medium by discharging ink from the recording head on the ink jet cartridge in accordance with electric signals transmitted for discharging ink.

Also, an opening/closing valve for use of a liquid container which forms the liquid supply port for a liquid container to contain liquid closely comprises a plurality of valves surrounded the thinner thickness portions breakable by being depressed. Then, the broken parts of the thinner thickness portions are closed elastically after the thinner thickness portions are broken.

Also, an opening/closing valve for use of a liquid container which forms the liquid supply port for a liquid container to contain liquid closely comprises a movable portion; and a sheet member to open and close the liquid supply port which substantially closes the liquid supply port using the elastic supporting portions which support the movable portion, and also, with the provision of a plurality of thinner thickness portions breakable when depressed. Then, the supply of the liquid is made possible to the outside of the liquid container through at least one of the broken thinner thickness portions.

Also, a liquid container with an opening/closing valve comprises a liquid container which contains liquid closely; and an opening/closing valve to form the liquid supply port for the liquid container. Then, this opening/closing valve for use of a liquid container is provided with a movable portion, and a sheet member to open and close the liquid supply port, and to substantially close the liquid supply port using the elastic supporting portions to support the movable portion, and also, with the provision of a plurality of thinner thickness portions breakable when depressed to make the supply of the liquid possible to the outside of the liquid container through at least one of the broken thinner thickness portions.

Also, a method for unsealing an opening/closing valve for use of a liquid container is to close the opening of the liquid container, which is provided with breakable thinner thickness portions when the liquid container is mounted on a container holder having a communication tube to communicate with the interior of the liquid container holding liquid. This method comprises the step of unsealing by breaking the thinner thickness portions by enabling the leading end portion of the communication tube of the container holder to abut upon the thinner thickness portions.

In accordance with the liquid supply system of the present invention, a part of liquid in the liquid container is shiftable to the container for the capillary force generating material after the liquid supply container and the container for the capillary force generating material are installed. As a result, the liquid accomodating portion is deformed along with the liquid that has been led out. Then, even if the air or the like in the liquid accomodating portion is expanded due to the environmental changes, the influence exerted by such expansion can be eased by the liquid supply container that is restored to the original shape. Moreover, since the container for the capillary force generating is positioned on the upper surface of the container for the capillary force generating material, the direction of liquid supply from the liquid supply container to the container for the capillary force generating material is the direction that follows the gravity, it becomes possible to maintain the stabilized supply condition.

Particularly, if the structure of the container for the capillary force generating material is formed so that liquid is held relatively easily between the communication unit and the liquid supply unit, the position of the gas-liquid interface of the liquid held in the capillary force generating material is settled stably in the vicinity of the communication unit (the groove connected with the communication unit).

In accordance with the head cartridge and the ink jet cartridge of the present invention, the chamber that contains the capillary force generating material or the recording head and the liquid supply container are connected through the supply tube. Liquid in the liquid supply container is supplied to the chamber that contains the capillary force generating material or to the recording head unit through the supply tube. Here, since the liquid supply container is separable and detachably mountable on the capillary force generating material or the recording head unit, liquid may adhere to the supply tube along with the attachment and detachment of the liquid supply container. However, for the supply tube, an opening which is different from the opening for use of the liquid supply is arranged to make it possible to enable the liquid that adheres to the supply tube to flow into the supply tube through this particular opening. For the one for which the supply tube is provided for the chamber that contains the capillary force generating material, the liquid that flows into the supply tube is absorbed by the capillary force generating material. Therefore, it becomes possible to suppress ink stains on the circumference of the supply tube. On the other hand, for the one for which the supply tube is installed on the recording head unit, the closed member surrounds the base of the supply tube. As a result, the liquid that leaks due to the attachment and detachment of the liquid supply container is held in the inside of the closed member and then, flows in the supply tube through the opening. As a result, it becomes possible to suppress the stains on the circumference of the supply tube.

Also, in accordance with the liquid supply system of other embodiment of the present invention, there are provided the liquid led-out passage to lead out liquid from the liquid supply container, and the gas preference introducing passage to introduce gas priority to the liquid supply container. Therefore, gas is easily introduced into the liquid container through the gas preference introducing passage when the gas-liquid exchange is performed. Consequently, liquid is led out from the liquid accomodating portion stably to the container for the capillary force generating material.

Also, in accordance with the other embodiment of liquid supply container of the present invention, a first latch lever and a second latch lever are arranged in the slanted or bent configuration toward the above from the area near the bottom portion of a pair of side faces of the replaceable liquid supply container. As a result, when the replaceable liquid supply container is installed on the tank holder, the first and second latch levers admit of the "play" between the tank holder and the replaceable liquid supply container, and at the same time, regulate the movement thereof other than the movement in the straight installation direction. Therefore, when one ink container having a plurality of supply ports should be mounted on the ink container holder, it becomes possible to solve the subject that a plurality of supply ports are to be connected with the corresponding supply tubes of the head at a time by the ink container is inserted after positioning it provisionally. At the same time, it becomes possible to provide a replaceable liquid supply container, as well as the head holder, capable of positioning each of the supply units, and implementing the simultaneous connection with ease between a plurality of supply ports and the holder.

Also, in accordance with the opening/closing valve for use of a liquid container of the present invention, a plurality of liquid supply ports which can be operated for opening and closing are arranged so that even if one operating unit is clogged by dust particles, solidification, or the like, to make the liquid supply difficult, it is still possible to supply liquid. Further, the opening/closing valve for use of the liquid container is provided with the thinner thickness portions which are breakable when being depressed. However, the thinner thickness portions are not broken in the initial state when the opening/closing valve is installed on the opening of the liquid container. Thus, the liquid container is reliably closed by the opening/closing valve in the initial stage until the thinner thickness portions are broken, hence unsealing the opening/closing valve for use of the liquid container. As a result, the sealing capability of the opening of the liquid container is enhanced in the initial stage, such as during distribution. Liquid is held in the interior of the liquid container assuredly.

Also, in the specification hereof, the container for the capillary force generating material, and the liquid container are used when these containers are made separable from the other containers. Besides such mode where these are used separately, the chamber that contains the capillary force generating material and the liquid containing chamber are used together in the event that these are always integrated.

Also, in the specification hereof, the area where liquid is not filled in the vicinity of the air communication port of the chamber that contains the capillary force generating material means not only the space (buffer unit) where no capillary force generating material is provided as described later, but also, the term that indicates this condition is used to refer to the state where, although the capillary force generating material is present, but ink is not filled in at all.

BRIEF DESCRIPTION OF THE DRAWINGS

FIG. 3A is the cross-sectional view taken along the same section as FIG. 1; FIG. 3B is the sectional view of the ink container, taken along line A—A in FIG. 1.

FIG. 4A is the cross-sectional view taken along the same section as FIG. 1; FIG. 4B is the sectional view of the ink container, taken along line A—A in FIG. 1.

FIG. 5A is the cross-sectional view taken along the same section as FIG. 1; FIG. 5B is the sectional view of the ink container, taken along line A—A in FIG. 1.

FIG. 6A is the cross-sectional view taken along the same section as FIG. 1; FIG. 6B is the sectional view of the ink container, taken along line A—A in FIG. 1.

FIG. 7A is the cross-sectional view taken along the same section as FIG. 1; FIG. 7B is the sectional view of the ink container, taken along line A—A in FIG. 1.

FIG. 10A illustrates the curve of the negative pressure shown in FIG. 8 in detail; FIG. 10B illustrates the state of changes of the led-out amount of ink from the ink storage unit as the time elapses, and the led-out amount of air introduction into the ink storage unit.

FIGS. 12A-1, 12A-2, 12B-1, 12B-2, 12C-1 and 12C-2 are views which illustrate the ink container operation in the pattern shown in FIG. 11.

FIGS. 14A-1, 14A-2, 14B-1, 14B-2, 14C-1 and 14C-2 are views which illustrate the ink container operation in the pattern shown in FIG. 13.

FIGS. 16A-1, 16A-2, 16B-1, 16B-2, 16C-1, 16C-2, 16D-1 and 16D-2 are views which illustrate the stabilized liquid holding mechanism when the conditions of environment are changed for the ink jet cartridge shown in FIG. 1.

FIG. 25A is the cross-sectional view; and FIG. 25B is the plan view.

FIG. 28A is the schematic perspective view; and FIG. 28B is the cross-sectional view.

DETAILED DESCRIPTION OF THE PREFERRED EMBODIMENTS

Hereinafter, with reference to the accompanying drawings, the embodiments will be described in accordance with the present invention.

In this respect, as the liquid which is used for the liquid supply system of the present invention, ink is exemplified for the description of each of the embodiments given below. However, the invention is not necessarily limited to ink as the applicable liquid. For example, the processing liquid or the like, which is used in the field of the ink jet recording, is of course among the liquids applicable to the present invention.

(First Embodiment)

Figure 1:
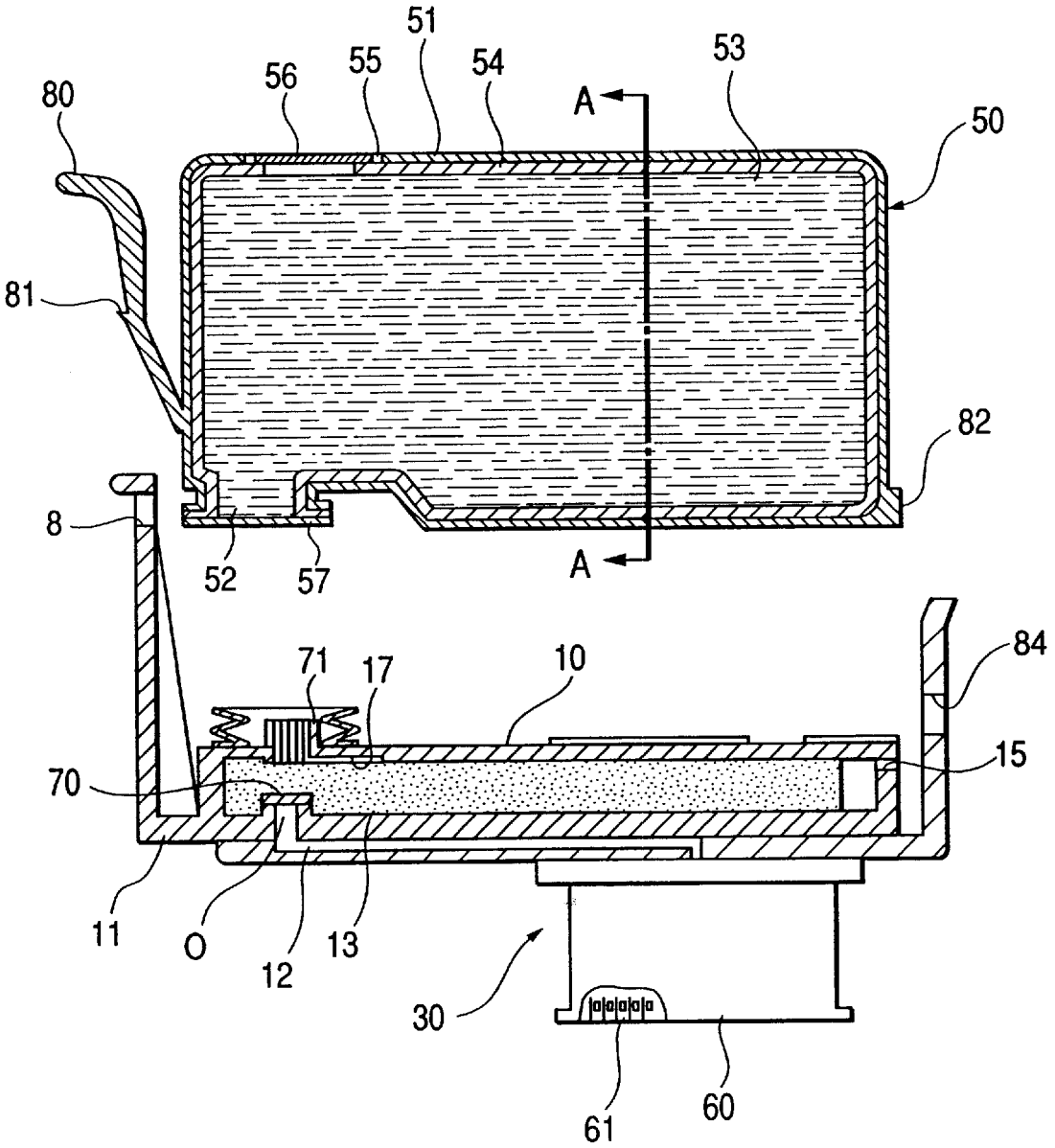
FIG. 1 a cross-sectional view which shows the ink jet cartridge to which the liquid supply system is applied in accordance with a first embodiment of the present invention.
Figure 2:
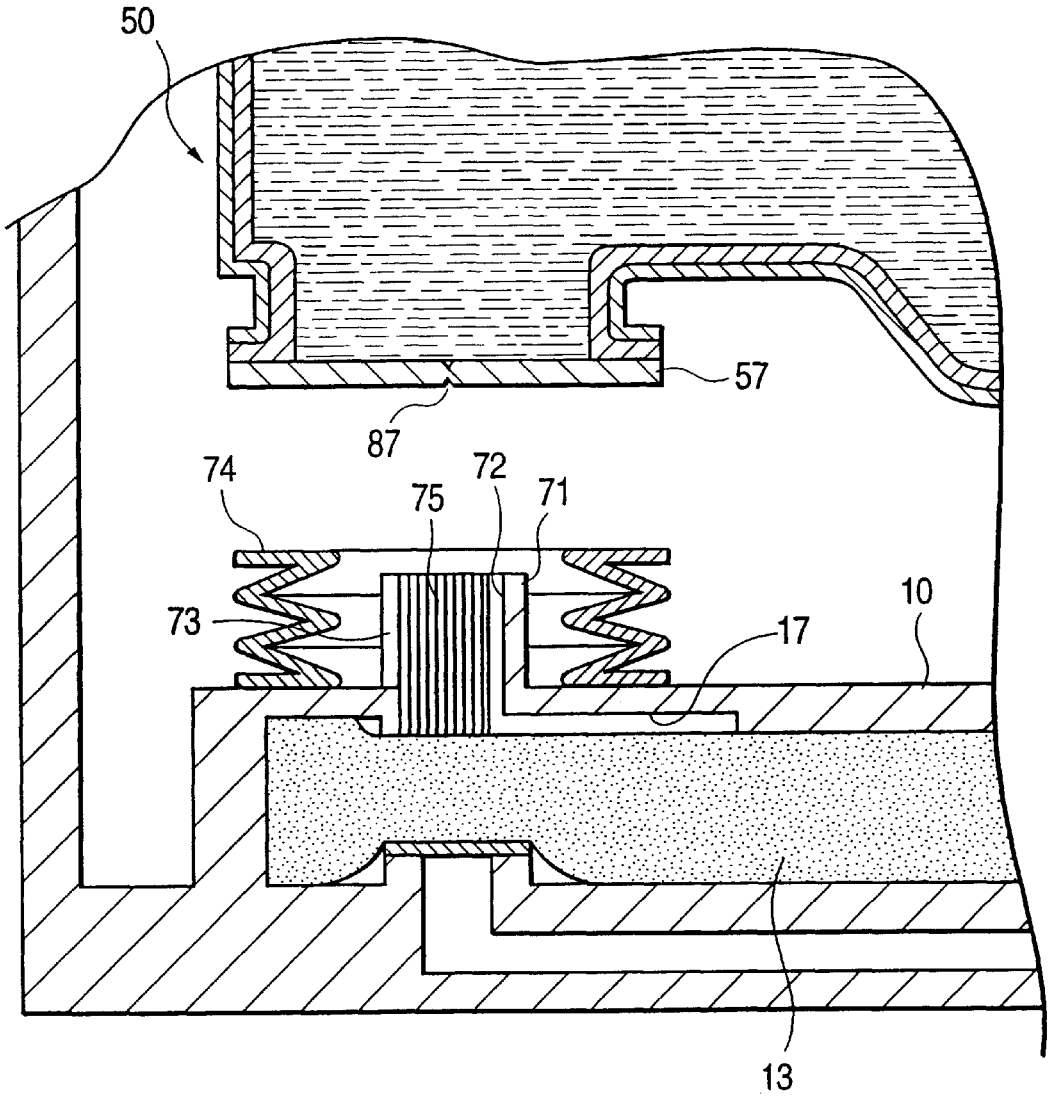
FIG. 2 is a cross-sectional view which shows in enlargement the vicinity of the ink supply unit and the communication tube of the holder with head for the ink container represented in FIG. 1.

FIG. 1 a view which schematically shows the ink jet cartridge to which the liquid supply system is applied in accordance with a first embodiment of the present invention, and which is a cross-sectional view showing the state where the ink container is mounted on the holder with head. FIG. 2 is an enlarged view which shows the connecting portion with respect to the ink path between the ink container and the holder with head represented in FIG. 1.

As shown in FIG. 1, the ink jet cartridge comprises an ink container 50 serving as the liquid supply container which stores ink in it; a tank holder 11 that holds the ink container 50; a chamber 10 that contains the capillary force generating material to provisionally hold ink to be supplied from the ink container 50; and the holder 30 with head formed integrally with a recording head 60 that performs recording by discharging ink supplied from the chamber 10 that contains the capillary force generating material.

The ink container 50 comprises the ink storage unit 53 detachably mountable on the holder 30 with head, which contains ink in its interior; and the ink supply unit 52 that leads out the liquid in the ink storage unit 53 to the chamber 10 that contains the capillary force generating material, which will be described later. Also, the ink container 50 is formed by the outer wall 51 that constitutes the chamber (housing), and the inner wall 54 having the inner surface which is equal or analogous to the inner surface of the outer wall 51.

The ink supply unit 52 is positioned on the one end side of the ink container 50, which is open to the lower end of the ink container 50. Also, the latch lever 80 with the latch nail 81 on it is integrally installed on the wall surface of the outer wall 51 on the side where the ink supply unit 52 is positioned. Before the ink container 50 is mounted on the holder 30 with head, the ink supply unit 52 is sealed with a sealing material 57 so that the ink storage unit 53 is airtightly closed from the air outside.

The inner wall 54 is flexible. The ink storage unit 53 is deformable as the contained ink is led out. Also, the inner wall 54 is provided with the fused portion (pitched off portion) 56. With this fused portion 56, the inner wall 54 is supported by being coupled with the outer wall 51. Also, the outer wall 51 is provided with an atmospheric communication port 55 to make it possible to introduce the air outside between the inner wall 54 and the outer wall 51.

On the other hand, the holder 30 with head comprises as described above the tank holder 11 that holds the ink container 50; the chamber 10 that contains the capillary force generating material arranged on the bottom of the tank holder 11; and the recording head 60 that performs recording on a recording medium by discharging ink (including the liquid, such as the processing liquid) from the discharge ports 61.

The chamber 10 that contains the capillary force generating material is arranged to contain the capillary force generating material 13, such as polyurethane or other porous material or fabric member formed by polyethylene, polypropylene, or the like, so as to hold ink by the utilization of the absorbing phenomenon of ink by means of the capillary force exerted by the capillary force generating material 13. On the upper wall of the chamber 10 that contains the capillary force generating material, there is provided the communication tube 71 which is connected with the ink supply unit 52 of the ink container 50 to communicate with the ink storage unit 53, and at the same time, on the lower wall thereof, the ink supply path 12 is open as the liquid supply unit for supplying ink to the recording head 60. The opening of the ink supply path 12 is positioned on the lower part of the communication tube 71. In other words, the openings of the communication tube 71 and the ink supply path 12 are both arranged on one end portion of the chamber 10 that contains the capillary force generating material. In this respect, the opening of the ink supply path 12 is provided with a filter 70 to prevent the foreign particles from entering the recording head 60.

The chamber 10 that contains the capillary force generating material further comprises the air introducing groove 17 and the atmospheric communication port 15. The air introducing groove 17 promotes the gas-liquid exchange which will be described later, which is formed in the horizontal direction on the inner side of the upper wall surface in the vicinity of the communication tube 71 to face the atmospheric communication port 15 side of the chamber 10 that contains the capillary force generating material, hence being communicated with the interior of the communication tube 71. The atmospheric communication port 15 enables the capillary force generating material 13 with the air outside, which is formed on the other end wall of the chamber 10 that contains the capillary force generating material. Here, the vicinity of the atmospheric communication port 15 of the chamber 10 that contains the capillary force generating material is made the buffer 16 where the capillary force generating material 13 is not present. In accordance with the present embodiment, the communication tube 71 abuts upon the capillary force generating material 13, and at the same time, the end portion thereof is connected with the air introducing groove 17, hence making it possible to implement the smooth operation of liquid supply which will be described later.

Here, in each of the cross-sectional views including FIG. 1, the area where the capillary force generating material 13 holds ink is indicated by slanted lines. Also, the ink, which is contained in the space, such as the ink storage unit 53, the atmospheric communication tube 17, or the gas-liquid exchange passage, is indicated by meshed lines.

Now, with reference to FIG. 2, the detailed description will be made of the vicinity of the ink supply unit 52 of the ink container 50 and the vicinity of the communication tube 71 of the holder 30 with head.

In the interior of the communication tube 71, an ink introducing device 75 is inserted. The ink introducing device 75 is arranged to guide ink from the upper end of the communication tube 71 to the capillary force generating material 13 in good condition. For example, felt or some other fabric is bundled together for use in the axial direction of the communication tube 71. On the inner wall of the communication tube 71, the air introducing path 72, which is communicated with the air introducing groove 17 and connected with the ink introducing device 75, is formed from the upper end to the lower end of the communication tube 71. Also, for the communication tube 71, a slit 73 is formed by removing a part of the tube wall of the communication tube 71 in the axial direction.

On the upper wall of the chamber 10 that contains the capillary force generating material, a bellows 74 is fixed to surround the communication tube 71. The bellows 74 is arranged to prevent the ink leakage when the communication tube 71 is inserted into the ink supply unit 52 of the ink container 50. The height thereof is made greater than that of the communication tube 71. The bellows 74 may be formed by rubber or some other elastic material. Here, it is arranged to enable the ink, which may leak to the gap between the communication tube 71 and the bellows 74 when the communication tube 71 is inserted into the ink supply unit 52, to flow into the chamber 10 that contains the capillary force generating material through the slit 73.

On the other hand, the structure is arranged so that an unsealing groove 87 is formed in the central portion of the sealing material 57 which is fused to the ink supply unit 52 of the ink container 50, and the sealing material 57 is broken by the unsealing groove 87 when the ink supply unit 52 is pressed into the communication tube 71, thus the communication tube 71 being inserted into the interior of the ink supply unit 52.

Now, reverting to FIG. 1, the ink container 50 of the present embodiment is formed by six surfaces that configure a rectangular parallelepiped substantially. Then, the cylindrical ink supply unit 52 is added to it as the curbed surface. The maximum surface area of this rectangular parallelepiped is represented in FIG. 1 indirectly. Then, the thickness of the inner wall 54 is smaller on the portion that constitutes the top part (hereinafter referred to as the corner including the case where the top portion makes a fine curved shape) than the central area of each surface of the rectangular parallelepiped, and gradually reduced toward each of the corners from the central area of each surface. In other words, this direction is the same as the deforming direction of each surface, and it produces the effect that promotes the deformation which will be described later.

Also, the corners of the inner wall 54 are formed by the three surfaces. Thus, the resultant strength of all the corners of the inner wall 54 becomes relatively stronger than that of the central zone, and the thickness is smaller than that of the central zone in terms of the extension of each plane. Therefore, the shift of the plane is permitted as described later. Here, it is desirable to make the thickness of each portion that forms the corners of the inner wall 54 substantially the same, respectively.

In this respect, since FIG. 1 is a schematic view, the outer wall 51 and the inner wall 54 of the ink container 50 are represented as if to be in contact with each other. However, in practice, it should be good enough if these walls are in a separable condition. The structure may be arranged so that the inner wall 54 and the outer wall 51 are in contact or these walls are positioned with a fine gap between them. However, before the ink container 50 is mounted on the holer with head 30, that is, before the ink container 50 is used, the inner wall 54 should be formed along the inner surface configuration of the outer wall 51 so that at least the corners of the inner wall 54 are placed at the corners of the outer wall 51 (this is termed as the initial state).

At this juncture, it is possible to prevent the external ink leakage more reliably from the interior of the ink storage unit 53 due to the external force, the temperature changes, or the pressure changes at the time of unsealing the sealing member 57 ink protect the interior of the ink storage unit 53 if ink is stored in an amount slightly smaller than the storable amount of ink in the ink storage unit 53 so as to enable the ink supply unit 52 to be under a slightly negative pressure when the sealing member 57 is unsealed.

Also, from the viewpoint of the environmental changes of the kind, it should be desirable to make the amount of air residing in the ink storage unit 53 extremely small before connection. In order to reduce the amount of air residing in the interior of the ink storage unit 53, it should be good enough to use the liquid injection method which is disclosed in the specification of Japanese Patent Application Laid-Open No. 10-175311, for example.

On the other hand, the capillary force generating material 13 of the chamber 10 that contains it holds ink in the state where the air introducing groove 17 is usually communicated with the air outside partly through the capillary generating material 13 excepting before the use of the liquid supply system.

Here, the amount of ink retained in the capillary force generating material 13 is dependent on the amount of ink retained in the capillary force generating material 13 when the ink containers 50 are replaced as described later. Therefore, a light fluctuation thereof is allowable. Also, as to the air introducing groove 17 and the communication tube 71, it is not necessary to fill them with liquid under any circumstances. As shown in FIG. 1, it may be possible to contain the air in them.

Now, in conjunction with FIGS. 3A and 3B to 8, the description will be made of the liquid (ink) supply operation of the liquid supply system. Each of FIGS. 3A and 3B to 7A and 7B is a view which schematically illustrates changes in ink discharged from the recording head 60 in that order represented in FIGS. 3A and 3B to 7A and 7B after the ink container 50 is mounted on the holder 30 with head in the liquid supply system shown in FIG. 1. Here, FIGS. 3A, 4A, 5A, 6A and 7A are cross-sectional views taken along the same section shown in FIG. 1. Those figures B illustrate the section taken along line A—A in FIG. 1. Also, FIG. 8 is a view which illustrates the relationship between the amount of ink led out from the ink supply port O shown in FIG. 1 (the opening of the ink supply path 12 to the chamber 10 that contains the capillary force generating material), and the negative pressure on the ink supply port portion. The axis of abscissa indicates the amount of ink led out form the ink supply port O to the outside, and the axis of ordinate indicates the negative pressure (static pressure) on the ink supply port portion. In FIG. 8, the state of changes in negative pressure as shown in FIGS. 3A and 3B to 7A and 7B is indicated by each of the arrows accordingly.

For the ink container of the present embodiment, the ink supply operation is roughly divided into three stages; before the operation of the gas-liquid exchange, during the operation of the gas-liquid exchange, and after the operation thereof. Hereunder, therefore, each of the operations will be described in detail in conjunction with the accompanying drawings.

(1) Before the Operation of the Gas-Liquid Exchange

Figure 3B:
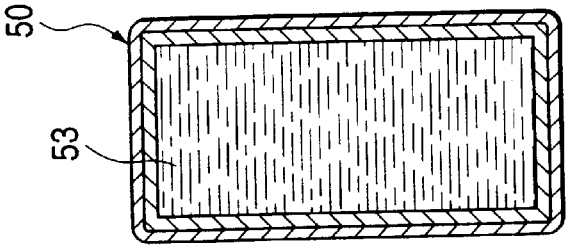
FIGS. 3A and 3B are views which illustrate the state of the ink jet cartridge shown in FIG. 1 immediately after the installation of the ink container on the holder with head.
Figure 3A:
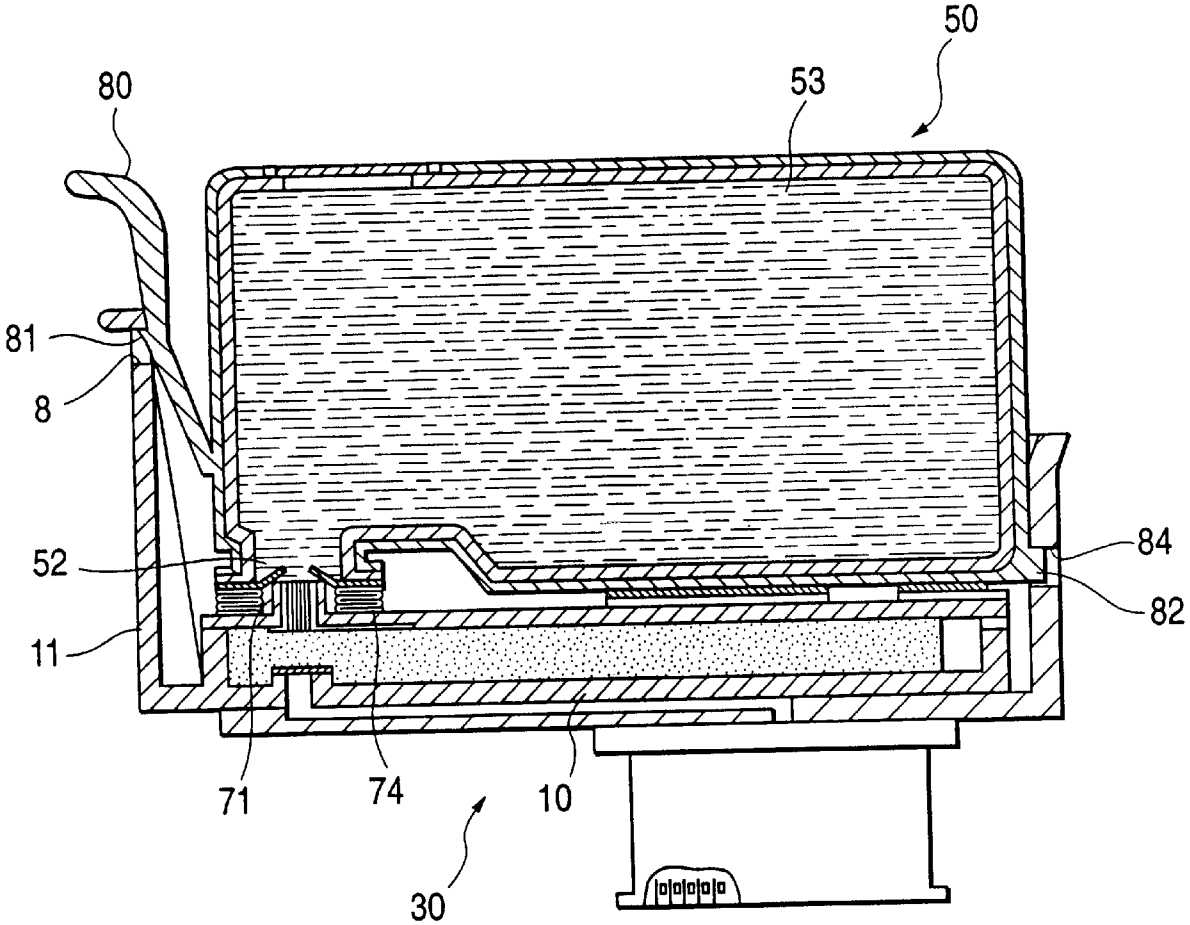

FIGS. 3A and 3B are views which illustrate the state of ink in the ink container 50 before it is led out to the chamber that contains 10 the capillary force generating material immediately after the ink container 50 has been mounted on the holder 30 with head.

Figure 9:
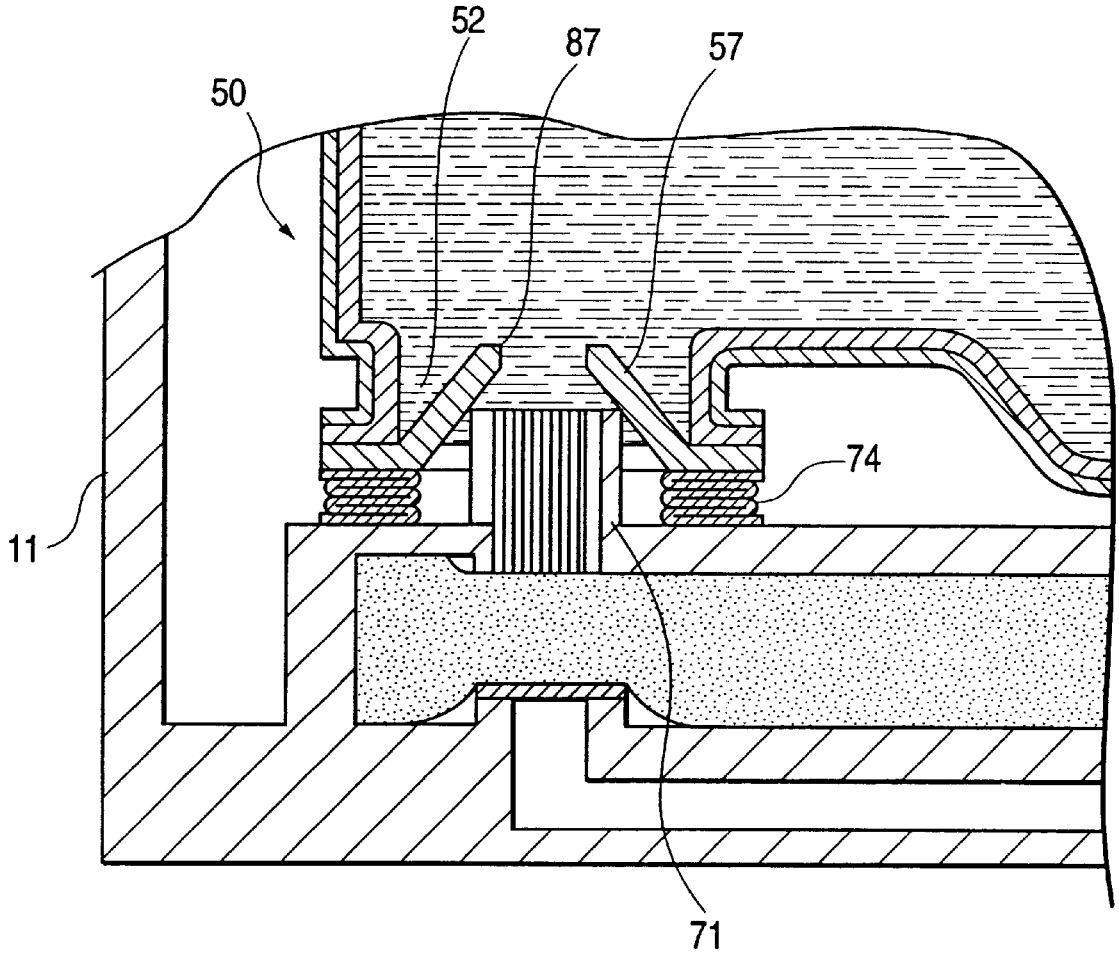
FIG. 9 is an enlarged cross-sectional view which shows the vicinity of the ink supply unit and communication tube of the ink jet cartridge represented in FIG. 1 in a state where the ink container is connected with the holder with head.

The ink container 50 is mounted on the holder 30 with head by inserting the ink container 50 into the opening of the tank holder 11 from above the holder 30 with head. Then, the fall-out check nail 82 of the ink container 50 is fitted into the hole 84 of the tank holder 11 to check the ink container to fall out. At the same time, the latch nail 81 of the latch lever 80 engages with the engagement hole 8 of the tank holder 11 to hold the ink container 50 on the tank holder 11. Then, as shown in FIG. 9, the communication tube 71 of the chamber 10 that contains the capillary force generating material breaks through the unsealing groove 87 of the sealing member 57 to enter the ink supply unit 52. Thus, the ink storage unit 53 of the ink container 50 is communicated with the chamber 10 that contains the capillary force generating material. At this juncture, the bellows 74 abuts upon the sealing member 57 earlier to close the circumference of the communication tube 71. After that, along with the insertion of the ink container 50, the bellows 74 is compressed, and the communication tube 71 unseals the sealing member 57. Therefore, ink is not allowed to flow out of the bellows 74 when the sealing member 57 is unsealed.

Figure 4B:
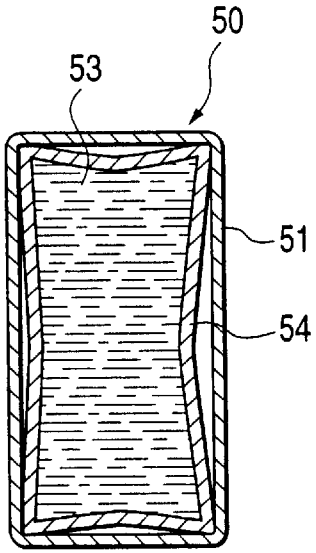
FIGS. 4A and 4B are views which illustrate the state of the ink jet cartridge shown in FIG. 1 at the initial stage of use.
Figure 4A:
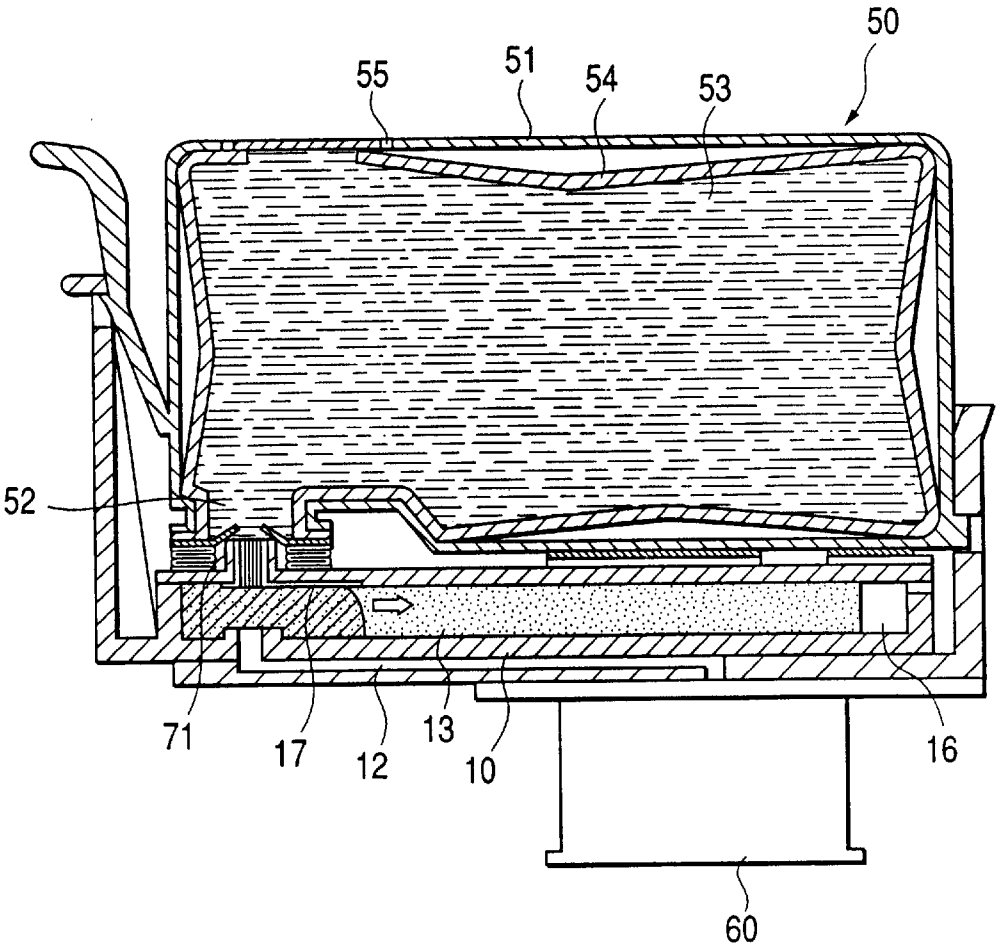

When the ink container 50 is mounted on the holder 30 with head, ink in the ink container 50 is supplied to the chamber 10 that contains the capillary force generating material through the communication tube 71. Then, in the chamber 10 that contains the capillary force generating material, ink shifts as indicated by arrows in FIG. 4A until the pressure in the chamber 10 that contains the capillary force generating material is made equal to the pressure in the ink container 50 as shown in FIGS. 4A and 4B. When the pressure becomes negative at the ink supply port 12, the equilibrium condition is obtained (this condition is termed as the "use initiation state").

Now, the detailed description will be made of the ink shift that presents the equilibrium condition.

When the communication tube 71 of the chamber 10 that contains the capillary force generating material is inserted into the ink supply unit 52 of the ink container 50, ink in the ink storage unit 53 is allowed to flow into the communication tube 71 to form an ink passage to the capillary force generating material 13 in the chamber 10 that contains the capillary force generating material. Also, in the state shown in FIG. 3A, if the air resides in the communication tube 71, the air shifts to the ink storage unit 53 (here, this presence of the air is omitted in FIGS. 4A and 4B).

With the formation of the ink passage, the ink shift begins from the ink storage unit 53 to the capillary force generating material 13 by means of the capillary force of this material 13. At this juncture, the inner wall 54 begins to be deformed from the central portion of the plane having the largest area in the direction in which the volume of the ink storage unit 53 is reduced.

Here, since the outer wall 51 functions to suppress the displacement of the corners of the inner wall 54, the ink storage unit 53 does not make any abrupt changes because of the acting forces that functions to deform it due to the consumption of ink and to restore it to the configuration at the initial state (see FIG. 1). Therefore, the negative pressure is exerted in accordance with the degree of the deformation. In this respect, the space between the inner wall 54 and the outer wall 51 is communicated with the air outside through the air communication port 55, hence introducing the air into the space between them corresponding to the deformation described above. Also, as to the introduction of ink into the air introducing groove 17, ink is filled in it if the capillary force is greater than the negative pressure exerted in the ink storage unit 53 as in the present embodiment.

When the ink shift begins to fill ink in the capillary force generating material 13 gradually, ink is filled in the leading end (the right side end in FIG. 4A) of the air introducing groove 17 to the air communication port 15 side. Then, the air introducing groove 17 cannot be communicated with the air outside any longer, and the ink container 50 handles ink and the air outside only through the chamber 10 that contains the capillary force generating material. Consequently, ink shift is further conducted so as to make the static negative pressure in the gas-liquid exchange passage of the ink container 50 equal to the static pressure in the communication tube 71 of the chamber 10 that contains the capillary force generating material.

In other words, since the negative pressure on the chamber 10 that contains the capillary force generating material side is greater than the negative pressure on the ink container 50 side, ink shifts further from the ink container 50 to the chamber 10 until the negative pressures on both sides become equal, and along with this shift, the amount of ink to be retained in the capillary force generating material 13 in the chamber 10 is increased accordingly. In this way, the ink shift from the ink container 50 to the chamber 10 that contains the capillary force generating material is conducted without introducing gas into the ink container 50 through the capillary force generating material 13. At the time of the equilibrium condition reached, the static negative pressure each in the ink container 50 and the chamber 10 that contains the capillary force generating material may be set at an appropriate value (at $\alpha$ in FIG. 8) depending on the kinds of the recording head 60 so as not to allow any ink leakage from the recording head 60 connected with the ink supply path 12.

The lowest limit of the shiftable amount of ink from the ink container 50 is the ink amount when ink is filled in the capillary force generating material 13 up to the position of the leading end (the gas-liquid interface to be described later) of the air introducing groove 17 on the upper surface of the capillary force generating material 13. The upper limit is the ink amount when ink is filled completely in the capillary force generating material 13. Therefore, in consideration of the variation of ink amount which is retained in the capillary force generating material 13 before connection, the shifting amount of ink to the capillary force generating material 13 is determined by the upper and lower limits of the ink amount. Then, it becomes possible to select the material and thickness of the ink storage unit 53 appropriately corresponding to the capillary force generating material 13 on the basis of the ink amount and the value of the negative pressure a in the equilibrium condition.

Also, since the amount of ink retained in the capillary force generating material 13 is not constant before connection, there is a case where some area of the capillary force generating material 13 is not filled with ink on the air communication port 15 side even when the equilibrium condition is reached. Together with the buffer unit 16, such area may be utilized as the buffer area against the temperature and pressure changes which will be described later.

To the contrary, if there is a fear that the pressure becomes positive on the ink supply port when the equilibrium condition is reached, the suction recovery may be performed by suction recovery means provided for the main body of the liquid jet recording apparatus to let a slight amount of ink flow out in order to cope with such situation.

In this respect, for the formation of ink passage in the communication tube 71 at the time of connection, it may be possible to utilize the shock at that time or it may be possible to press the ink storage unit 53 by compressing the ink storage unit 53 together with the outer wall 51, among some other method. Also, it may be possible to promote the gas in the communication tube 71 to shift into the ink storage unit 53 by the utilization of the negative pressure which is provided by conditioning the ink storage unit 53 to be in a slightly negative state before connection.

Figure 5B:
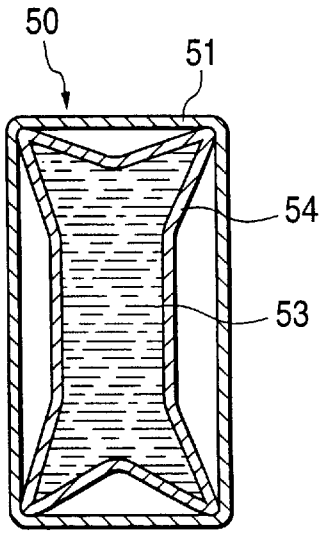
FIGS. 5A and 5B are views which illustrate the state of the ink jet cartridge shown in FIG. 1 when ink is led out.
Figure 5A:
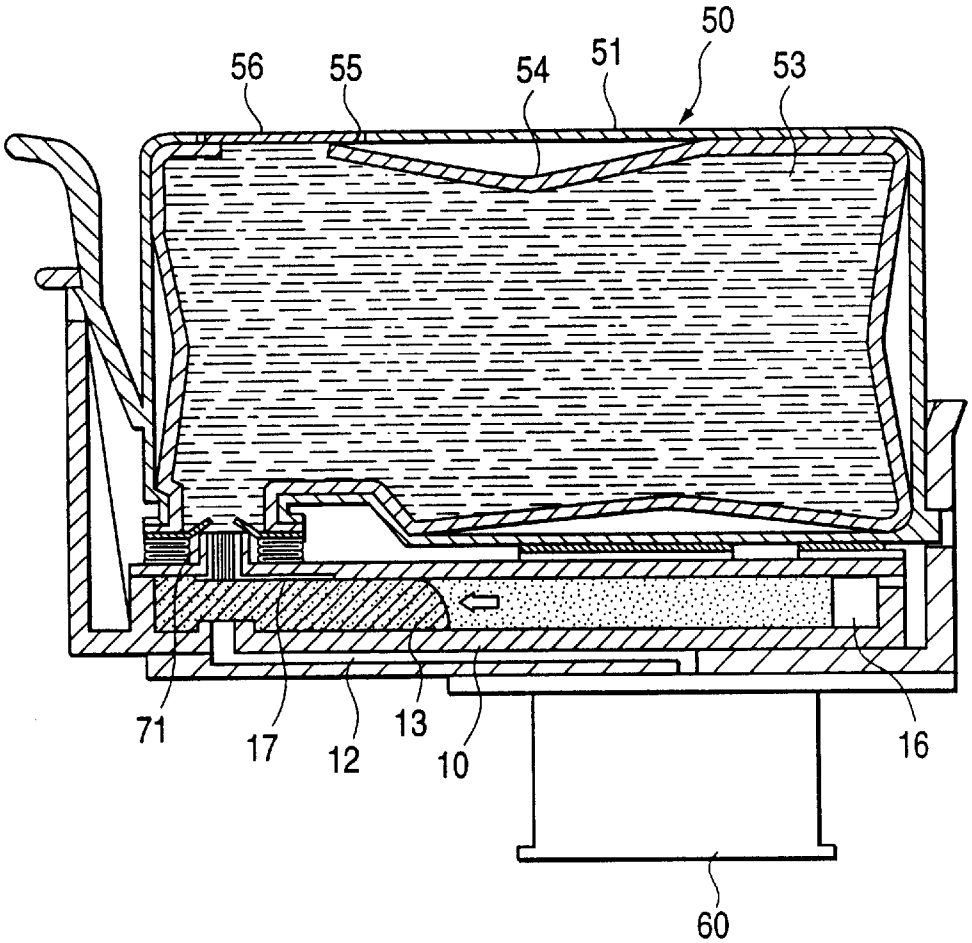

Now, as shown in FIG. 5A, ink is discharged from the recording head 60 to begin the consumption of ink. At this juncture, ink retained both in the ink storage unit 53 and the capillary force generating material 13 is consumed, while balancing the value of the static negative pressure exerted each in the ink storage unit 53 and the capillary force generating material 13 in the direction in which the value is increased (this is termed as the "first ink supply condition")

In other words, when the ink is consumed by the recording head 60, the position of the liquid level of the capillary force generating material 13 of the chamber 10 that contains it is caused to shift in the left direction in FIG. 5A, that is, toward the ink supply port O, and at the same time, the ink storage unit 53 is further deformed, thus maintaining the stably collapsed form in which the central portion of the ink storage unit 53 is directed inwardly.

Here, the fused portion 56 also functions as the portion to regulate the deformation of the inner wall 54. Then, on the surface adjacent to the surface which has the largest area, the part having no fused portion 56 begins to be deformed earlier than the area that has the fused portion 56 relatively, hence the inner wall 54 being caused to part from the outer wall 51. Here, in accordance with the present embodiment, the surfaces having the largest areas, which face each other, are deformed substantially at the same time, hence making it possible to implement the stabilized deformation in a better condition.

In this respect, the changes of the static negative pressure in the amount of ink led out from the ink supply port O in the state shown in FIGS. 5A and 5B are in the form in which the static pressure is gradually increased in proportion to the amount of ink thus lead out as shown at A in FIG. 8. Even in this first ink supply state, there is no possibility that the air outside enters the ink storage unit 53 through the communication tube 71.

(2) The Operation During the Gas-Liquid Exchange

Figure 6B:
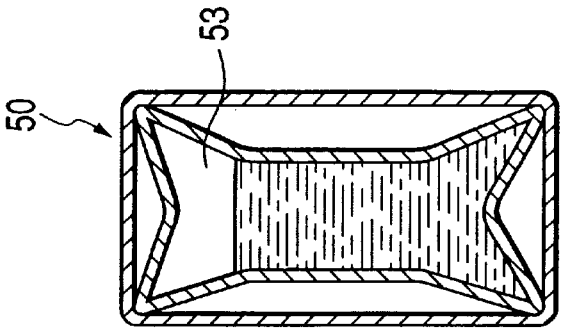
FIGS. 6A and 6B are views which illustrate the state of the gas-liquid exchange for the ink jet cartridge shown in FIG. 1.
Figure 6A:
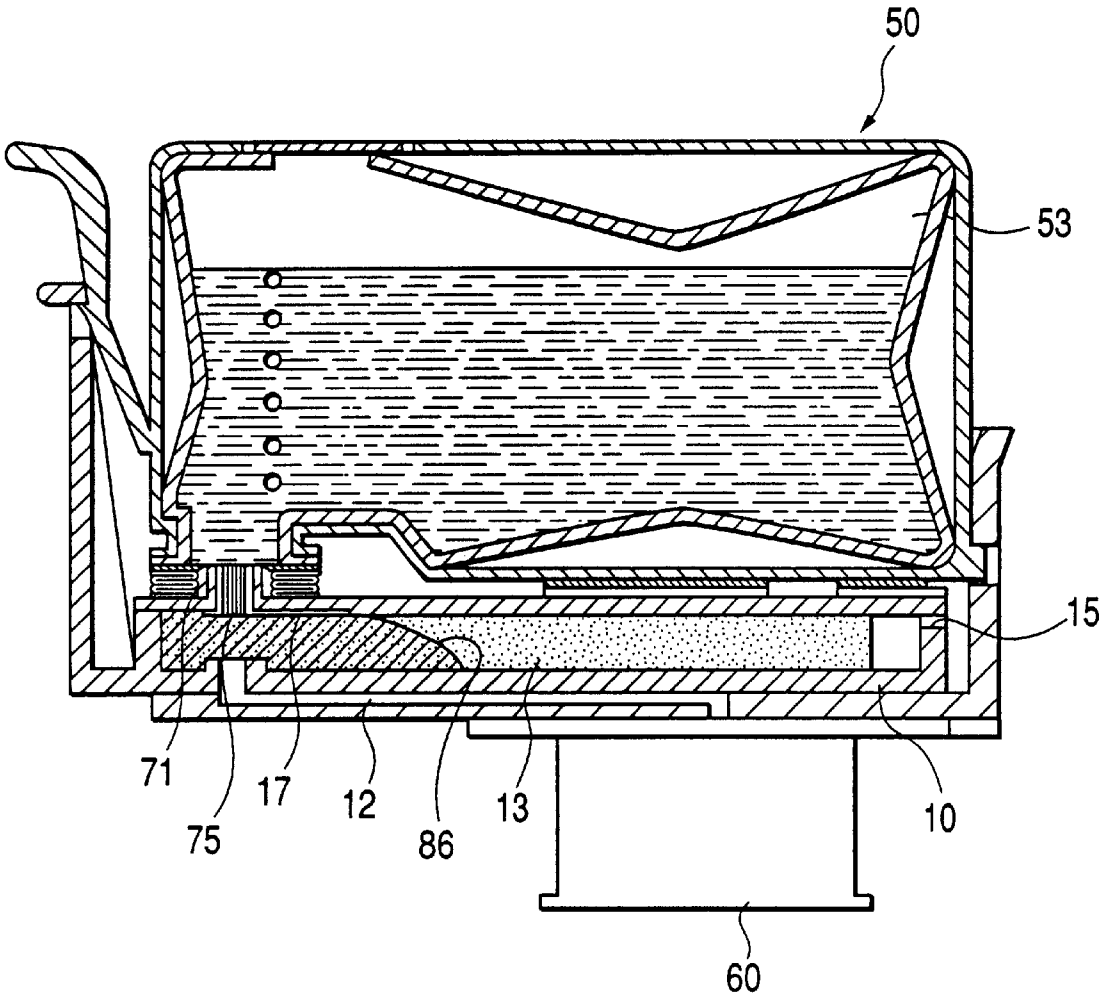

As ink is led out more from the ink supply port O, the gas is more introduced into the ink storage unit 53 as shown in FIGS. 6A and 6B (hereinafter, referred to as the "gas-liquid exchanging state" or the "second ink supply state").

At this juncture, the position of the liquid level of the capillary force generating material 13 is almost constant at its leading end portion (the gas-liquid interface 86). With the air outside that enters the ink container 50 from the air communication port 15 through the air introducing groove 17 and the communication tube 71, ink is caused to shift from the ink container 50 to the capillary force generating material 13 in the chamber 10 that contains it through the ink introducing device 75 of the communication tube 71.

Consequently, even if ink is consumed by the recording head 60 serving as liquid jet recording means, ink is filled in the capillary force generating material 13 in according with the amount of its consumption, thus allowing the capillary force generating material 13 to retain ink in a constant amount. Also, since the air outside is introduced into the ink storage unit 53, it can maintain its shape almost the same as at the time of the gas-liquid exchange. Then, the negative pressure in the ink container 50 is kept substantially constant, hence stabilizing the ink supply to the recording head 60.

The changes in the static pressure against the amount of ink led out from the ink supply unit in the state shown in FIGS. 6A and 6B indicate almost the constant value to the amount of ink thus led out as shown at B in FIG. 8.

So far, the gas-liquid exchange operation of the ink container of the present embodiment has been described. However, the operation during the gas-liquid exchange is not necessarily limited to the one described above if the ink storage unit 53 is made deformable as structured in accordance with the present embodiment.

With the ink container whose ink storage unit is not deformable as structured in accordance with the conventional art, ink is supplied to the capillary force generating material immediately along with the introduction of the air outside to the ink storage unit thereof.

On the other hand, if the ink container 50 whose ink storage unit 53 is deformable as in the present embodiment, ink in the ink container may be supplied to the capillary force generating material 13 even without introduction of the air outside into the ink storage unit 53 in some cases. On the contrary, there is no ink supply to the capillary force generating material 13 immediately following the introduction of the air outside into the ink storage unit 53 along with the consumption of ink in some cases. These phenomenon take place by the balance of the negative pressures brought about by the displacement of the ink storage unit 53 and the chamber 10 that contains the capillary force generating material.

Although the specific example of these operations will be described later, the gas-liquid exchange performed under structure hereof may differ from that of the ink container conventionally structured in some cases (the timing is different from the conventional gas-liquid exchange). With this temporal deviation at the time of the gas-liquid exchange between the ink which is led out from the ink storage unit 53 and the gas which is introduced into the ink storage unit 53, it becomes possible to enhance the reliability of the stable ink supply with the time lag against the sudden consumption of ink, environmental changes, vibration, or some other external factors.

(3) The Operation after the Gas-Liquid Exchange

Figure 7B:
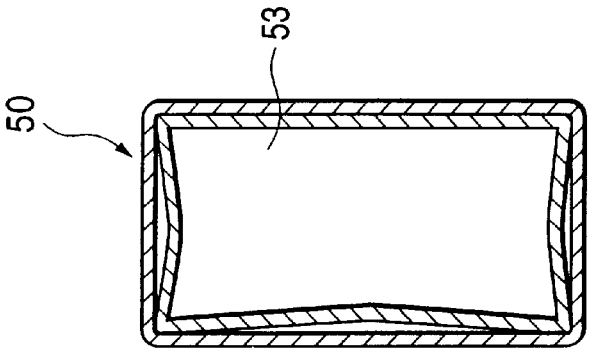
FIGS. 7A and 7B are views which illustrate the state of the ink jet cartridge shown in FIG. 1 before the ink containers are replaced.
Figure 7A:
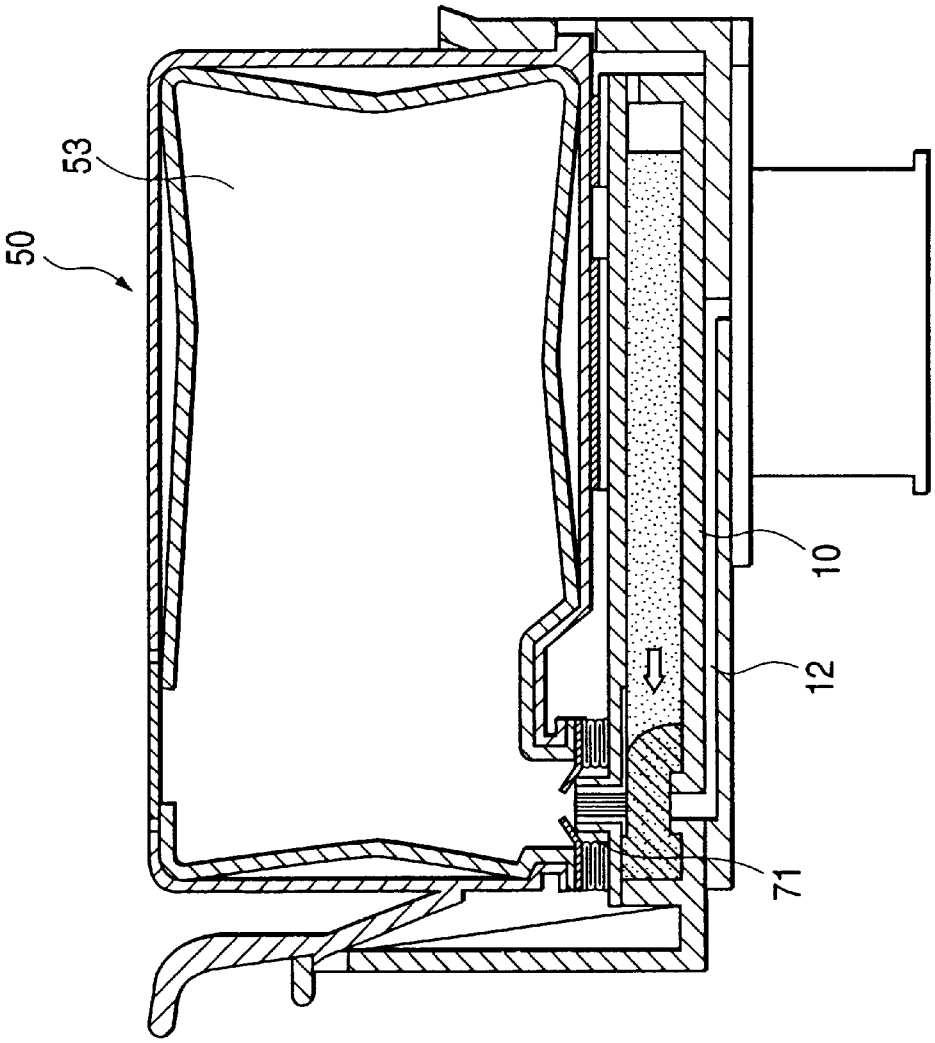
Figure 8:
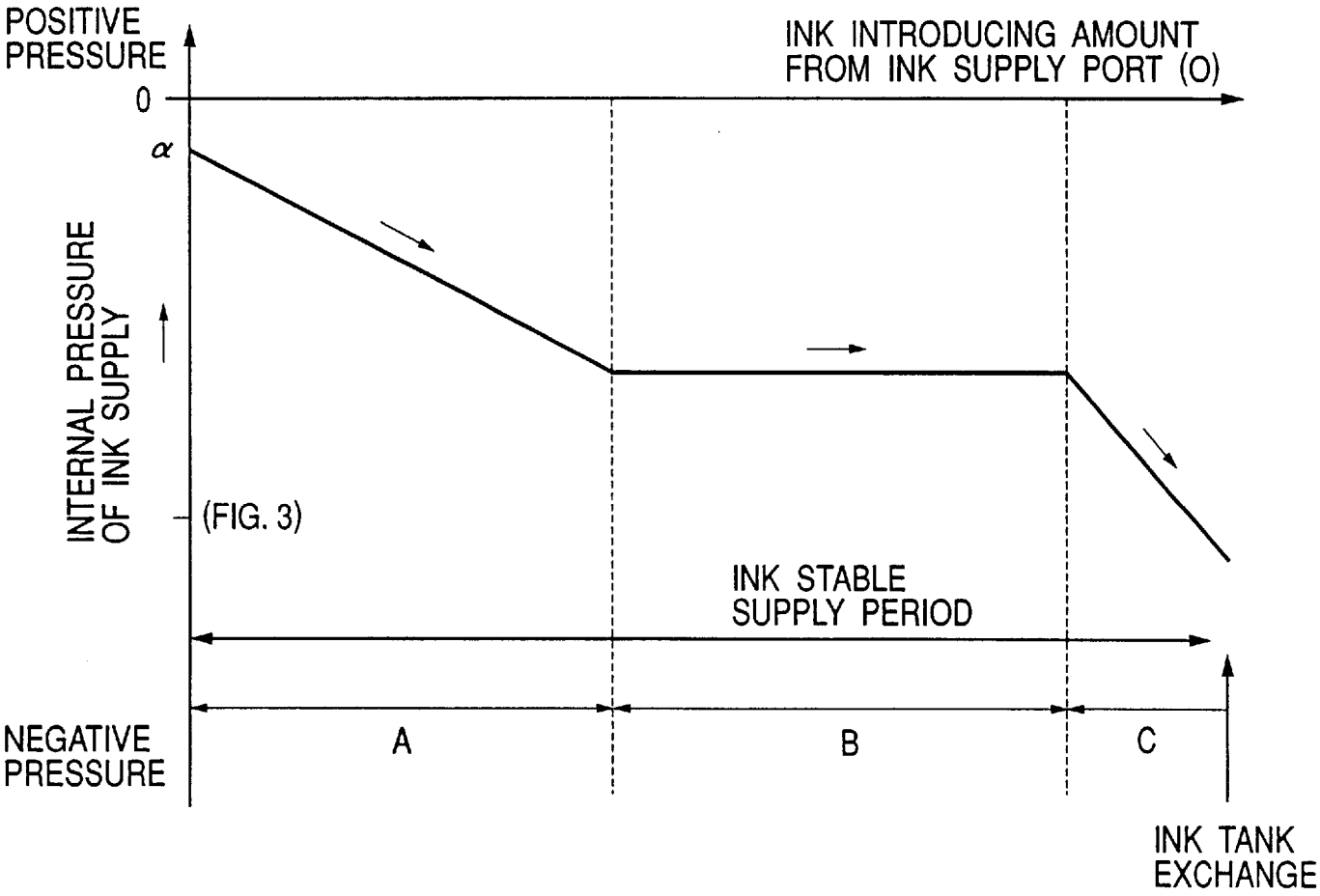
FIG. 8 is a view which illustrates the relationship between the amount of ink introduction and the negative pressure at the ink supply opening of the ink jet cartridge shown in FIG. 1.

When ink is further led out from the ink supply port O, ink in the ink storage unit 53 is almost completely consumed as shown in FIGS. 7A and 7B. Then, ink remaining in the chamber 10 that contains the capillary force generating material begins to be consumed. The changes in the negative pressure on the amount of ink led out from the ink supply port O in the state shown in FIGS. 7A and 7B is in the form that the negative pressure is increased in proportion to the amount of ink thus led out as indicated at C in FIG. 8. In this state, there is almost no fear that ink leaks from the communication tube 71 even if the ink container 50 is removed. Therefore, the ink container 50 should be removed for replacement.

In accordance with the embodiment represented in FIG. 1, the liquid supply operation of the ink container has been described above.

In other words, with the ink container 50 connected with the chamber 10 that contains the capillary force generating material, ink is caused to shift until the pressure in the chamber 10 that contains the capillary force generating material becomes equal to the pressure in the ink container 50, hence making use initiation ready. After that, when the recording head 60 begins consuming ink, ink retained both in the ink storage unit 53 and the capillary force generating material 13 is consumed, at first, while balancing the value of the static negative pressure exerted each in the ink storage unit 53 and the capillary force generating material 13 in the direction that each of them is increased. Then, ink remaining in the chamber 10 that contains the capillary force generating material is consumed through the gas-liquid exchange state that keeps substantially a constant negative pressure against the ink to be led out, while enabling the capillary force generating material 13 to keep the gas-liquid interface 86 by introducing gas into the ink storage unit 53.

In this way, in accordance with the present invention, there is provided with a step of using ink in the ink storage unit 53 without introducing the air outside into the ink storage unit 53. As a result, it should be good enough to consider only the air to be introduced into the ink storage unit 53 at the time of connection as to the restriction on the inner volume of the ink container 50 in this ink supply process (the first ink supply state). In other words, there is an advantage that it becomes possible to cope with the environmental changes even if the restriction is eased on the inner volume of the ink container 50.

Also, in accordance with the present invention, not only ink in the ink container 50 is consumed almost completely, but also, the air may be contained in the communication tube 71 when replaced. Therefore, the ink containers 50 can be replaced irrespective of the amount of ink retained in the capillary force generating material 13, hence making it possible to provide the ink supply system capable of replacing ink containers 50 without the provision of the remainders detection mechanism which is required in accordance with the conventional art.

Particularly, with the ink container 50 being positioned above the chamber 10 that contains the capillary force generating material, the direction of ink supply from the ink container 50 to the ink supply port O is arranged in the gravitational direction in order to maintain the stabilized supply condition at all the time. Further, with the horizontal arrangement of the communication tube 71 and the air introducing groove 17 which is connected therewith in the direction approaching the air communication port 15, the aforesaid gas-liquid exchange is performed smoothly.

Here, as shown in FIG. 8, the negative pressure is increased in proportion to the amount of ink to be led out (region A). Then, a constant value is kept (region B). After that, the negative pressure is increased in proportion to the amount of ink to be led out (region C). To materialize this, it is desirable to conduct the introduction of the air outside, that is, to make the shift from the region A to the region B, before the deforming surfaces of the ink storage unit, which face each other are in contact. This is because the changing rate of the negative pressure is different with respect to the amount of ink to be led out in the ink storage unit before and after the surfaces each having the largest area, which face each other are in contact.

Figure 10A:
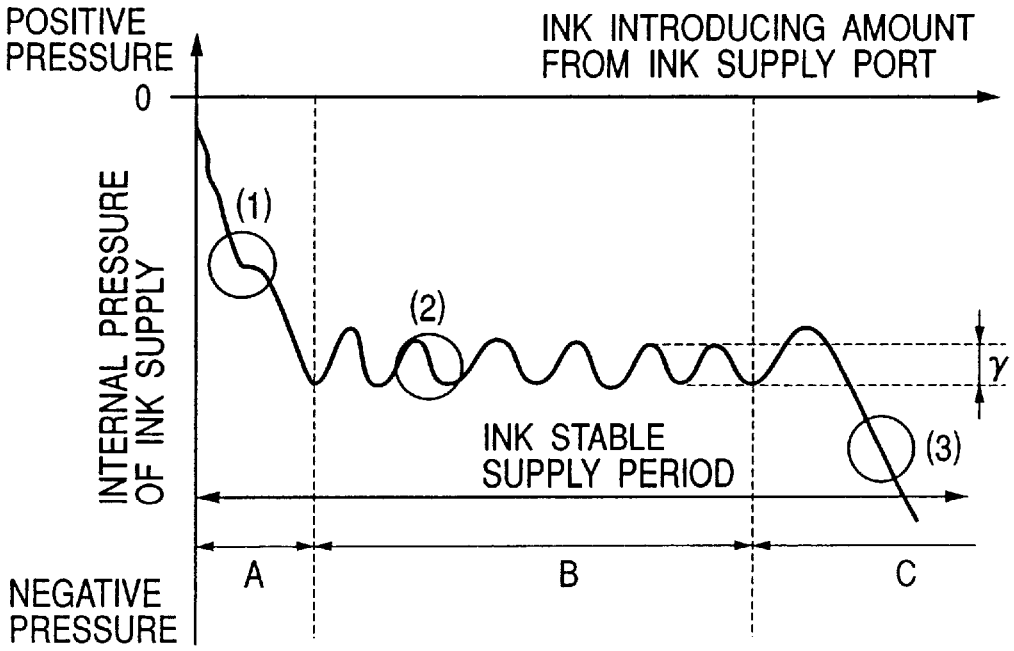
FIGS. 10A and 10B are graphs which indicate the led-out amount of ink from the ink storage unit.
Figure 10B:
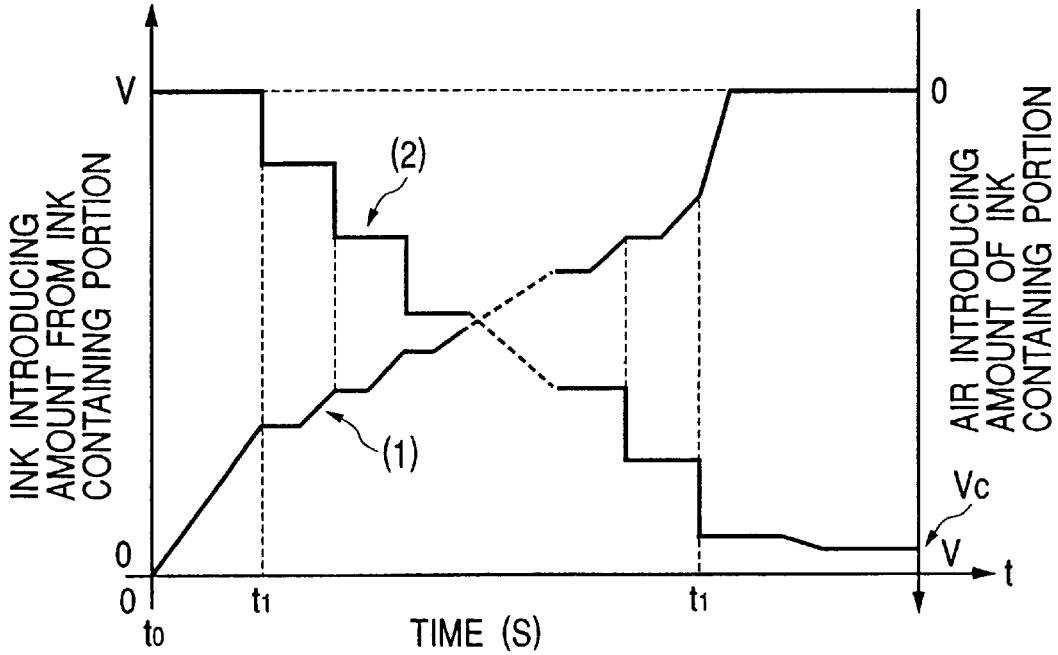

Further, the changes in the static negative pressure are measured for the amount of ink led out at that time. Then, the curbed lines shown in FIGS. 10A and 10B are obtained. Based on this measurement and the result thereof, the following knowledge is acquired as to the details of the ink supply operation with the changes made in the material and thickness of the inner wall of the ink storage unit, and also, with the changes in the capillary forces that may be generated by the capillary force generating material (the negative pressure exerting material).

Figure 11:
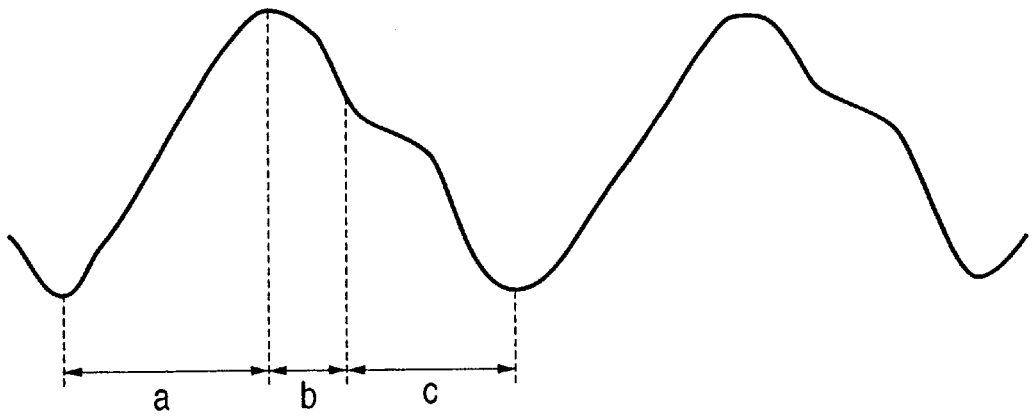
FIG. 11 is a view which illustrates in detail one example of the B area shown in FIGS. 10A and 10B.
Figure 13:
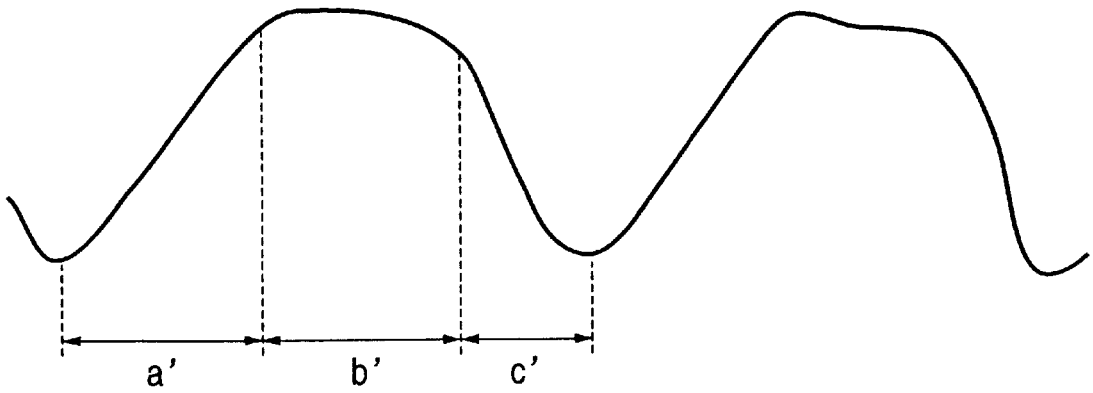
FIG. 13 is a view which illustrates in detail another example of the B area shown in FIGS. 10A and 10B.

In this respect, FIGS. 10A and 10B are views which illustrate in detail one actual example of the negative pressure curve shown in FIG. 8. The reference numerals (1), (2), and (3) in FIG. 10A correspond to the descriptions (1), (2), and (3) which have been made of the operations as above. Also, FIG. 11 is a view which illustrates one example of the region B shown in FIG. 10A further in detail. (FIGS. 12A-1 and 12A-2), (FIGS. 12B-1 and 12B-2) and (FIGS. 12C-1 and 12C-2) are views which illustrate the operation of the ink container in order of (FIGS. 12A-1 and 12A-2), (FIGS. 12B-1 and 12B-2) and (FIGS. 12C-1 and 12C-2), which indicates the pattern represented in FIG. 11. FIG. 13 is a view which illustrates the other example of the region B shown in FIG. 10A further in detail. (FIGS. 14A-1 and 14A-2), (FIGS. 14B-1 and 14B-2) and (FIGS. 14C-1 and 14C-2) are vies which illustrate the operation of the ink container in order of (FIGS. 14A-1 and 14A-2), (FIGS. 14B-1 and 14B-2) and (FIGS. 14C-1 and 14C-2), which indicates the pattern represented in FIG. 13. In (FIGS. 12A-1 and 12A-2), (FIGS. 12B-1 and 12B-2) and (FIGS. 12C-1 and 12C-2), FIG. 13 and (FIGS. 14A-1 and 14A-2), (FIGS. 14B-1 and 14B-2) and (FIGS. 14C-1 and 14C-2), the adscript 1 is a cross-sectional view which is the same as the one shown in FIG. 1, and the adscript 2 is a cross-sectional view of the ink container, taken along line A—A in FIG. 1. In this respect, each of the figures used for the respective descriptions represents the deformation or the like of the ink storage unit emphatically to a certain extent in order to make it readily understandable.

(1) The Description of the Region (1) in FIGS. 10A and 10B

This region (before the operation of the gas-liquid exchange) is illustrated by dividing it into the following three patterns. Each of the patterns is changeable depending on the condition, such as the capillary force of the capillary force generating material, and the thickness and material of the ink storage unit, as well as on the balance of each of them.

<The First Pattern of the Region (1) in FIGS. 10A and 10B>

In general, this pattern takes place when the ink storage unit is more dominant in controlling the negative pressure than the capillary force generating material. More specifically, this pattern tends to occur more often when the thickness of the ink storage unit is comparatively larger or when the robustness of the inner wall of the ink storage unit is comparatively higher.

Ink is led out in its initial state, beginning with the capillary force generating material. This is because the resistance force against ink to be led out is smaller on the capillary force generating material than the resistance force against it to be led out from the ink storage unit. After ink begins to be led out from the capillary force generating material, ink is led out from each of the capillary force generating material and the ink storage unit, while taking balance between them. When ink is led out from the ink storage unit, the inner wall thereof is gradually deformed inwardly.

<The Second Pattern of the Region (1) in FIGS. 10A and 10B>

Contrary to the first pattern, this pattern takes place when the capillary force generating material is more dominant in controlling the negative pressure than the ink storage unit. In this case, the pattern tends to occur more often when the thickness of the ink storage unit is comparatively smaller or when the robustness of the inner wall of the ink storage unit is comparatively lower.

Ink is led out in its initial state, beginning with the ink storage unit. This is because the resistance force against ink to be led out is smaller on the ink storage unit than the resistance force against it to be led out from the capillary force generating material. After that, as described above, ink is led out from each of the capillary force generating material and the ink storage unit, while taking balance between them.

<The Third Pattern of the Region (1) in FIGS. 10A and 10B>

This pattern tends to occur more often when both the capillary force generating material and the ink storage unit are substantially the same in dominating the negative pressure control.

In this case, ink is led out in its initial state, beginning with each of the capillary force generating material and the ink storage unit, while taking the balance on each of them. Then, taking the balance as it is, the ink lead-out shifts to the gas-liquid exchange which will be described later.

(2) The Description of the Region (2) in FIGS. 10A and 10B

Now, the region of the gas-liquid exchange operation will be described. This region is illustrated into two patterns. In order to describe it more in detail, FIGS. 10A and 10B will be used, which is an enlarged view of the negative pressure curve in the region (2) in FIGS. 10A and 10B.

<The First Pattern of the Region (2) in FIGS. 10A and 10B>

In general, this pattern take place when the ink storage unit is more dominant in controlling the negative pressure than the capillary force generating material. More specifically, this pattern tends to occur more often when the thickness of the ink storage unit is comparatively larger or the robustness of the inner wall of the ink storage unit is comparatively higher.

Figures 1, 12A:
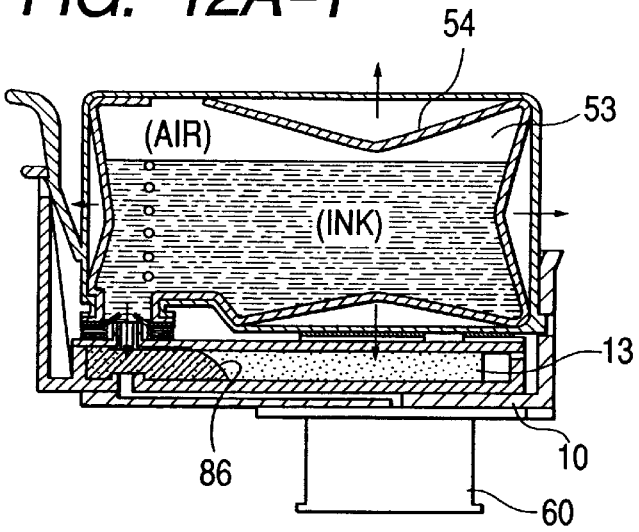
Figures 2, 12A:
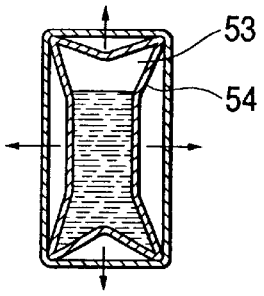
Figures 1, 12B:
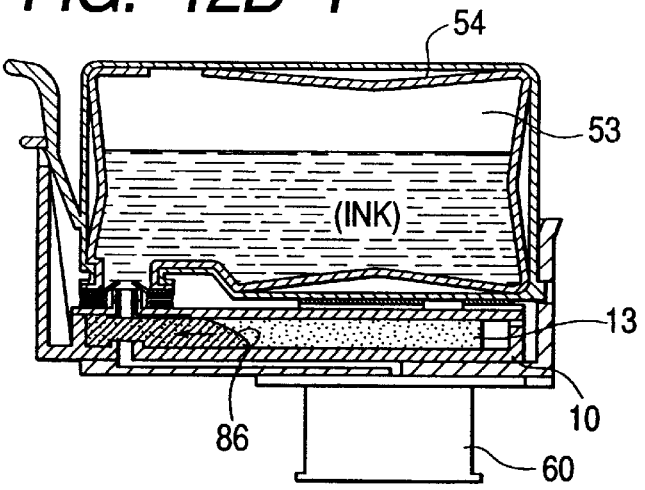
Figures 2, 12B:
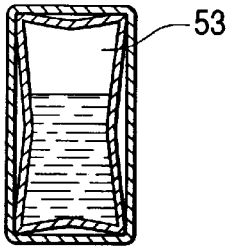

In the region of the gas-liquid exchange operation, the air outside is introduced from the chamber that contains the capillary force generating material to the ink storage unit (at a in FIG. 11). This is performed in order to ease the balance between the respective negative pressures as described earlier. With this introduction of the air into the ink storage unit, the inner wall 54 of the ink storage unit 53 is minutely deformed outward as shown in FIGS. 12A-1 and 12A-2. Also, with this introduction of the air outside, ink is supplied from the ink storage unit 53 to the chamber 10 that contains the capillary force generating material, hence causing the gas-liquid interface 86 of the chamber 10 that contains the capillary force generating material to shift slightly in the right direction (FIGS. 12A-1, 12A-2, 12B-1 and 12B-2).

When ink is further discharged from the recording head 60, ink is at first led out from the capillary force generating material 13 in accordance with this example. Then, as shown at b in FIG. 11 and FIGS. 12B-1 and 12B-2, the gas-liquid interface 86 of the chamber 10 that contains the capillary force generating material shifts in the left direction.

Figures 1, 12C:
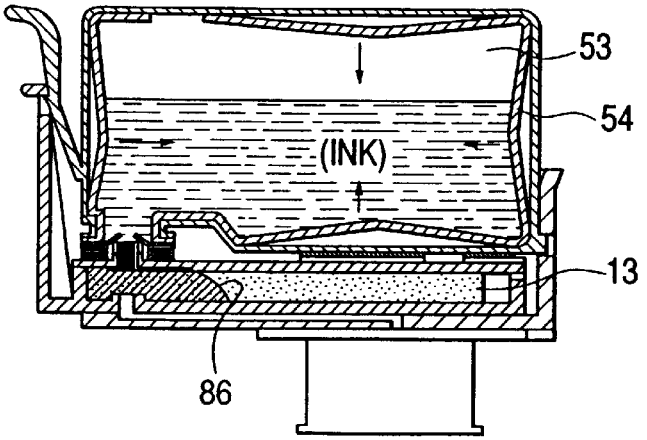
Figures 2, 12C:
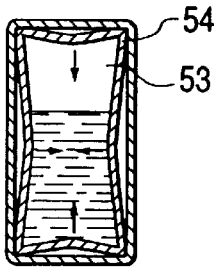

Through this state, ink is then led out from each of the capillary force generating material 13 and the ink storage unit 53, while taking the balance on each of them. In this manner, the gas-liquid interface 86 of the capillary force generating material 13 is caused to shift further in the left direction, thus changing the inner wall 54 of the ink storage unit 53 inwardly (at c in FIG. 11) (FIGS. 12C-1 and 12C-2).

After succession of this state, the air outside is introduced into the ink storage unit 53 through the air introducing groove 17 with the shift to the region a in FIG. 11 to follow.

<The Second Pattern of the Region (2) in FIGS. 10A and 10B>

Contrary to the previous example, this pattern take place when the capillary force generating material is more dominant in controlling the negative pressure than the ink storage unit. In this case, this pattern tends to occur more often when the thickness of the inner wall of the ink storage unit is comparatively smaller or the robustness of the inner wall of the ink storage unit is comparatively lower.

Figures 1, 14A:
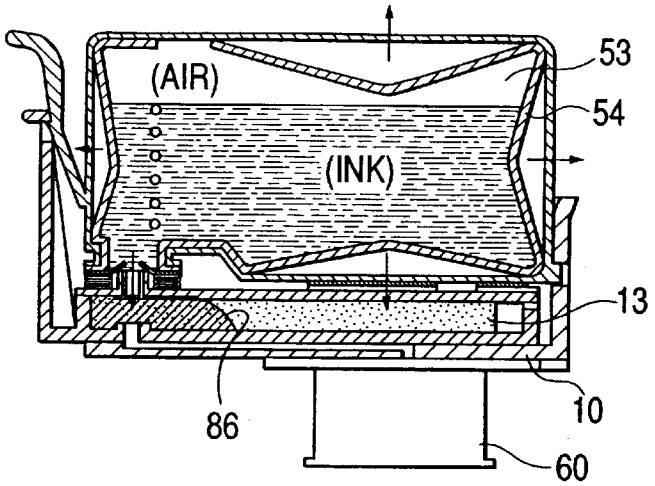
Figures 2, 14A:
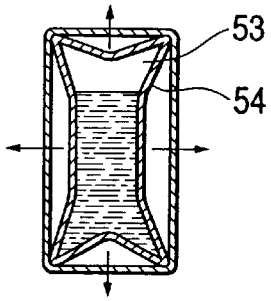
Figures 1, 14B:
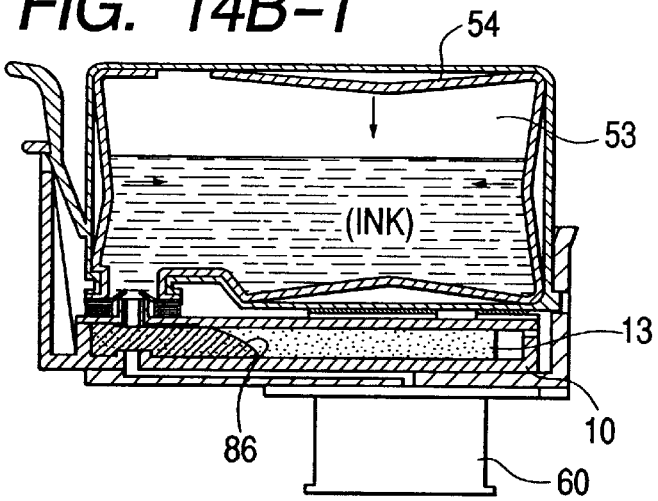
Figures 2, 14B:
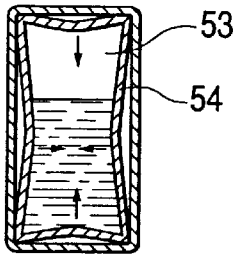

As described above, In the region of the gas-liquid exchange operation, the air outside is introduced from the chamber that contains the capillary force generating material to the ink storage unit (at a' in FIG. 13). With this introduction of the air into the ink storage unit, the inner wall 54 of the ink storage unit 53 is minutely deformed outward as shown in FIGS. 14A-1 and 14A-2. Also, with this introduction of the air outside, ink is supplied from the ink storage unit 53 to the chamber 10 that contains the capillary force generating material, hence causing the gas-liquid interface 86 of the chamber 10 that contains the capillary force generating material to shift slightly in the right direction (a'→b' in FIG. 13).

When ink is further discharged from the recording head 60, ink is dominantly led out from the ink storage unit 53 in accordance with this pattern. In this case, due to the characteristics of the thickness and the robustness of the ink storage unit 53, the negative pressure does not show any particular changes, but it is increase smoothly. As ink is led out, the inner wall 54 of the ink storage unit 53 is deformed gradually inwardly (at b' in FIG. 13). Here, in this region, almost no ink is led out from the capillary force generating material 13. Consequently the gas-liquid interface 86 of the capillary force generating material 13 presents almost no change.

Figures 1, 14C:
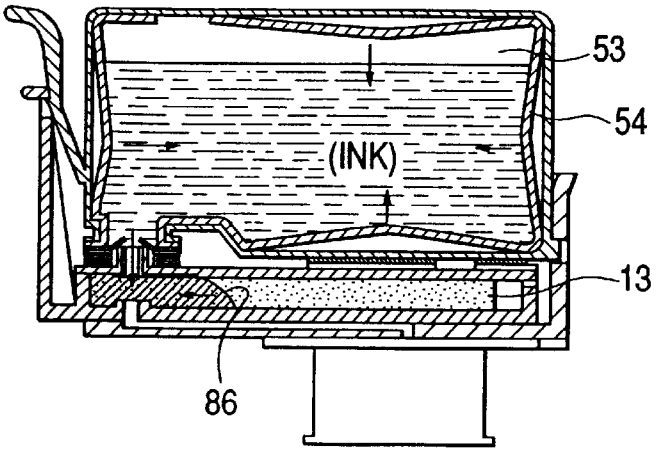
Figures 2, 14C:
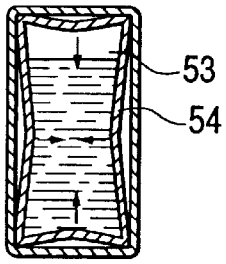

Throughout the region b', ink is further led out from each of the capillary force generating material 13 and the ink storage unit 53, while taking the balance on each of them. Then, the shift is made to the region c' in FIG. 13. In this region, as described earlier, the gas-liquid interface 86 of the capillary force generating material 13 is caused to shift further in the left direction, thus changing the inner wall 54 of the ink storage unit 53 inwardly (at c' in FIG. 13) (FIGS. 14C-1 and 14C-2).

After succession of this state, the air outside is introduced into the ink storage unit 53 through the air introducing groove 17 with the shift to the region a' in FIG. 13 to follow.

(3) The Description of the Region (3) in FIG. 10A

Lastly, the description will be made of the region (3) in FIG. 10A, which follows the gas-liquid exchange region.

This region is the one where only ink in the capillary force generating material is mainly led out after the gas-liquid exchange is completed with the advancement of the ink lead-out, that is, after the ink in the ink storage unit has been almost led out. This region will be described by dividing it into the following two patterns.

<The First Pattern of the Region (3) in FIG. 10A)

In accordance with this example, the description will be made of the case where the pressure in the ink storage unit has become almost the atmospheric pressure subsequent to the operation in the gas-liquid exchange region.

In the state where the gas-liquid exchange has been completed as described above, ink in the ink storage unit is almost consumed. Generally, in this state, meniscus enters the air communication path, the communication passage (communication tube) between the chamber that contains the capillary force generating material and the ink storage unit or the capillary force generating material. However, if the gas-liquid interface of the capillary force generating material is positioned nearer to the communication tube than the leading end of the air introducing groove, the aforesaid meniscus is broken due to the vibration of the carriage or the like. Thus, the air outside is in the state of being communicated with the ink storage unit through the air introducing groove, and the inner pressure of the ink storage unit is substantially equal to the atmospheric pressure. Therefore, the inner wall of the ink storage unit which has been displaced inwardly tends to be restored to the original shape by the elasticity thereof itself. In general, however, it is not restored to the initial state completely, because there often occurs the so-called buckling where the ink storage unit has been deformed inwardly more than the state of ink being led out from the ink storage unit. Due to this buckling, it is often observed that the ink storage unit is not allowed to be restored to its original shape completely even if the pressure of its interior becomes atmospheric.

After the inner pressure of the ink storage unit has become atmospheric to enable the inner wall thereof is allowed to be restored to the original state, ink in the capillary force generating material is led out, hence the gas-liquid interface in the capillary force generating material being positioned nearer to the ink supply port. In this manner, the negative pressure is increased almost in proportional thereto.

<The Second Pattern in the Region (3) in FIG. 10A>

Now, the description will be made of the pattern which represents the case where the interior of the ink storage unit maintains the state of the negative pressure even when the gas-liquid interface of the capillary force generating material is placed nearer to the communication tube than to the leading end of the air introducing groove.

As described earlier, the interior of the ink storage unit is cut off from the air outside by the presence of meniscus in the air introducing groove, the communication tube, and the capillary force generating material. Then, there is a case where ink is consumed in such state as it is so that the gas-liquid interface of the capillary force generating material may shift continuously toward the communication tube. Thus, ink in the capillary force generating material is consumed while the inner wall of the ink storage unit maintains its inward deformation as it is.

Even in this case, however, the pressure in the ink storage unit may become almost atmospheric because of the breakage of the meniscus due to the carriage vibration while ink is consumed or the environmental changes. In such a case, the inner wall of the ink storage unit is restored almost to its original shape as described earlier.

Now, as the characteristics of the gas-liquid exchange operation under the structure applied hereof, it is possible to state, as described above, that the pressure changes (amplitude $\gamma$) during the gas-liquid exchange is comparatively larger than the ink container system that performs the conventional gas-liquid exchange.

For the reasons thereof, as described in conjunction with the region (1) in FIGS. 10A and 10B of the structure hereof, the inner wall is in the state where it is deformed inwardly in the tank due to ink being led out from the ink storage unit before the gas-liquid exchange is performed. As a result, due to the elasticity of the inner wall, the outward force acts always upon the inner wall of the ink storage unit. Consequently, the amount of air, which enters the ink storage unit in order to ease the pressure difference between the capillary force generating material and the ink storage unit before the gas-liquid exchange is performed, may becomes more than a predetermined amount. As a result, ink tends to be more led out from the ink storage unit to the chamber that contains the capillary force generating material. In contrast, if the ink storage unit is not structured to be deformable as in the conventional system, ink is immediately led out to the chamber that contains the capillary force generating material when the air enters in a predetermined amount.

Also, when a solid mode printing should be executed, for example, a larger amount of ink is discharge from the recording head at a time. Then, ink is abruptly led out from the ink container. However, in accordance with the ink container of the structure hereof, ink is more led out by the gas-liquid exchange than the conventional system, there is no possibility that ink shortage takes place, hence enhancing its reliability.

Also, in accordance with the structure hereof, ink is led out in the state where the ink storage unit is deformed inwardly. Therefore, the buffer effect is made higher against the external factors such as vibration of the carriage or the like, and the environmental changes.

Here, from the different point of view, the description will be further made of the above-mentioned series of the operations in the process of ink consumption in conjunction with FIG. 10B.

In FIG. 10B, the axis of abscissa indicates time, and the axis of ordinate indicates one example of the amount of ink led out from the ink storage unit and the amount of air introduced into the ink storage unit. Also, it is assumed that the amount of ink supply from the recording head is constant as the time elapses.

From the above point of view, the amount of ink led out from the ink storage unit is indicated by the solid line (1), and the amount of air introduced into the ink storage unit is indicated by the solid line (2).

From the $t=0$ to $t=t_1$ is the region that corresponds to the region before the gas-liquid exchange (the region A) shown in FIG. 10A. In this region, ink is led out from the recording head, while taking the balance between the capillary force generating material and the ink storage unit as described earlier. Each of the led-out patterns is the same as described earlier.

Then, from the $t=t_1$ to $t=t_2$ is the region that corresponds to the gas-liquid exchange region (the region B) shown in FIG. 10A. In this region, the gas-liquid exchange is performed on the basis of the negative pressure balance as described earlier. As indicated by the solid line (1) in FIG. 10B, the air is introduced into the ink storage unit (indicated by the steps on the solid line (2)). Then, ink is led out from the ink storage unit. At this juncture, ink is not necessarily be led out from the ink storage unit in the same amount as the introduced air immediately along with the introduction of the air. For example, it is arranged, for example, so that ink is led out in the amount which is the same as that of the air introduced ultimately after a specific period of time has elapsed since the introduction of the air. As clear from FIG. 10B, there is a deviation of timing as compared with the operation of the ink container whose ink storage unit is not made deformable as described earlier. In the gas-liquid exchange region, this operation is repeated. At a certain point, the air amount and ink amount in the ink storage unit are inverted in this process.

When the $t=t_2$ is passed, the region becomes the one corresponding to the region after the gas-liquid exchange (the region C) in FIG. 10A. In this region, the interior of the ink storage unit becomes almost atmospheric as described earlier. (Depending on conditions, the interior thereof does not become atmospheric in some cases as described earlier). Along with this, the inner wall of the ink storage unit operates to be restored to the initial state by the elasticity thereof. However, as described earlier, due to the so-called buckling, it is not restored to the initial state completely. As a result, the ultimate amount Vc of the air introduced into the ink storage unit is smaller than the inial amount of ink V in the ink storage unit. Also in this region, ink is in the state where all of ink from the ink storage unit is used out completely.

Now, in conjunction with FIGS. 15A to 15C, the description will be made of the ink container replacement operation in each of the states where ink is being consumed.

Figure 15A:
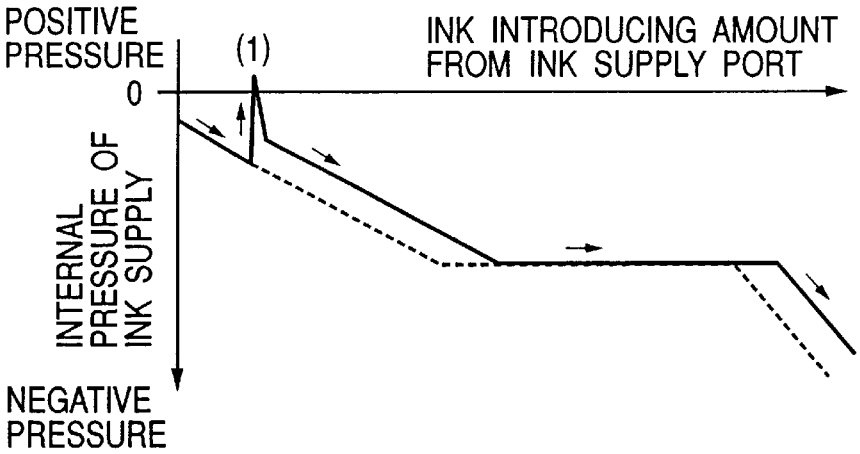
FIGS. 15A, 15B and 15C are views which illustrate the operation of the ink container replacement.

(a) The Ink Containers are Replaced before the Gas-liquid Exchange (FIG. 15A)

In the state before the gas-liquid exchange, ink is consumed from the capillary force generating material and the ink storage unit, while the balance is being taken between the capillary force generating material, the ink storage unit, as described earlier. In this state, the negative pressure is increased almost in proportional to each other. Also, the gas-liquid interface of the capillary force generating material is position nearer to the communication tube than the leading end of the air introducing groove.

When the ink containers are replaced at this juncture, the negative pressure in the ink storage unit is weaker in the initial stage in general, and also, the pressure in it may be positive in some cases. Therefore, if the ink container is mounted anew, ink in the ink storage unit is supplied to the capillary force generating material. Then, the amount of ink retained in the chamber that contains the capillary force generating material is increased, and the gas-liquid interface is stabilized when the balance is taken between them. In this case, since the buffer area is in the position which is farthest from the communication tube of the capillary force generating material, there occurs no ink leakage from the air communication port even if the position of the gas-liquid interface shifts in the parting direction.

With the installation of the ink container, the negative pressure becomes smaller or the pressure may becomes positive in some cases, it is possible to form the appropriate negative pressure state by conducting the initial recovery promptly at the time of tank installation. After that, ink is consumed as in the consumption patterns described earlier.

Here, even if ink is not filled in the capillary force generating material in the vicinity of the gas-liquid exchange passage of the chamber that contains the capillary force generating material, the liquid supply system of the present invention makes it possible to allow ink in the ink storage unit to shift to the capillary force generating material by the utilization of the capillary force of the chamber that contains the capillary force generating material if the ink passage is formed from the ink storage unit to the chamber that contains the capillary force generating material. Therefore, with the installation of the ink container, it is possible to use ink in the ink storage unit reliably irrespective of the retaining condition of ink in the capillary force generating material in the vicinity of the coupling portion.

Figure 15B:
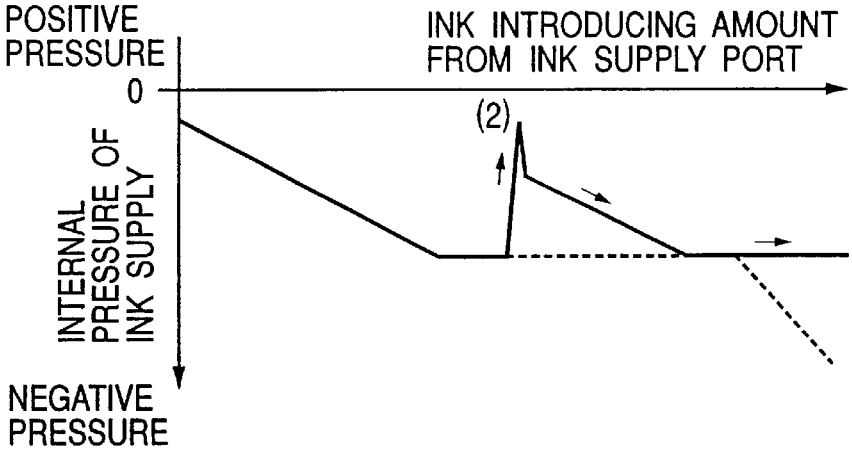

(b) When the Ink Containers are Replaced During the Gas-liquid Exchange (FIG. 15B)

During the operation of the gas-liquid exchange, the gas-liquid interface of the capillary force generating material is stabilized at the leading end of the air introducing groove as described earlier. The inner wall of the ink storage unit is in the deformed condition.

If the ink container is removed in this state for the installation of an ink container anew in the initial state, ink in the ink storage unit is supplied to the capillary force generating material as described earlier to increase the amount of ink retained in the capillary force generating material. In other words, the gas-liquid interface shifts to the portion beyond the air introducing groove. In this way, the inner wall of the ink storage unit is displaced inwardly so that the interior of the ink storage unit is slightly pressurized negatively.

After the position of the gas-liquid interface is stabilized, ink is consumed. Then, in the consumption patterns ((1)-1 to (1)-3) as described earlier, ink is consumed to perform the gas-liquid exchange when the negative pressure reaches a specific condition.

Figure 15C:
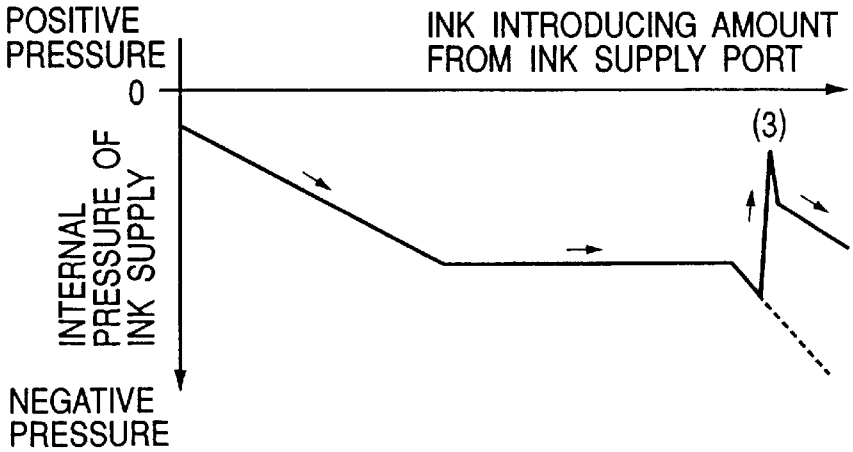

(c) When the Ink Containers are Replaced after the Gas-liquid Exchange (FIG. 15C)

The state after the gas-liquid exchange is such that the gas-liquid interface of the capillary force generating material is in the position nearer to the communication tube than the air introducing groove as described earlier, and that the inner wall of the ink storage unit is restored almost to the original shape substantially under the atmospheric pressure or the interior thereof is negatively pressurized to maintain the state of inwardly deformed.

If the ink containers are replaced in this state, ink in the ink storage unit is also supplied to the capillary force generating material to increase the amount of ink retained in the capillary force generating material. Generally, in this case, the gas-liquid interface has reached the position beyond the air introducing groove. However, in some cases, the gas-liquid interface may be balanced in the position nearer to the communication tube than the air introducing groove. With ink thus led out, the inner wall of the ink storage unit is displaced inwardly to be substantially in the negatively pressurized state.

When the gas-liquid interface is displaced to the position beyond the air introducing groove, the shift is made to the region of the gas-liquid exchange operation through the consumption process described earlier. Also, if the gas-liquid interface is in the position nearer to the communication tube than the air introducing groove, the gas-liquid exchange operation is immediately performed.

As described above, even when the ink containers are replaced in each of the consumption processes of (a) to (c), it is possible to generate the stabilized negative pressure, hence executing the ink supply operation more reliably.

Further, under the structure formed in accordance with the present invention, it becomes possible to cope with the environmental changes by the method of solution which differs from the conventional method even in the second ink supply state or the like where the air is contained in the ink storage unit.

Now, therefore, in conjunction with FIGS. 16A-1 to 16D-2, and FIG. 17, the description will be made of the stabilized liquid retaining mechanism of the ink container represented in FIG. 1 when the environmental condition is changed.

(FIGS. 16A-2 and 16A-2), (FIGS. 16B-1 and 16B-2), (FIGS. 16C-1 and 16C-2) and (FIGS. 16D-1 and 16D-2) are views which illustrate the function of the capillary force generating material that serves as the buffer absorbent, as well as the buffering function of the ink storage unit, and which illustrate the changes in the ink storage unit in order of (FIGS. 16A-2 and 16A-2), (FIGS. 16B-1 and 16B-2), (FIGS. 16C-1 and 16C-2) and (FIGS. 16D-1 and 16D-2) when the expansion of the air in the ink storage unit due to the reduction of the atmospheric pressure, the temperature rise, or the like from the state shown in FIGS. 6A and 6B (in the state of the gas-liquid exchange). The adscript 1 designates the cross-sectional view which is the same as the section represented in FIG. 1. The adscript 2 designates the cross-sectional view taken along line A—A in FIG. 1.

Figures 1, 16A:
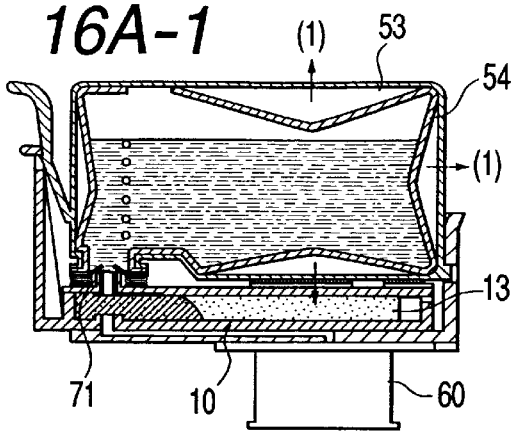
Figures 2, 16A:
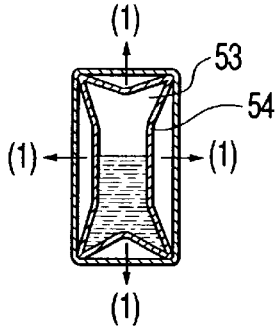
Figures 1, 16B:
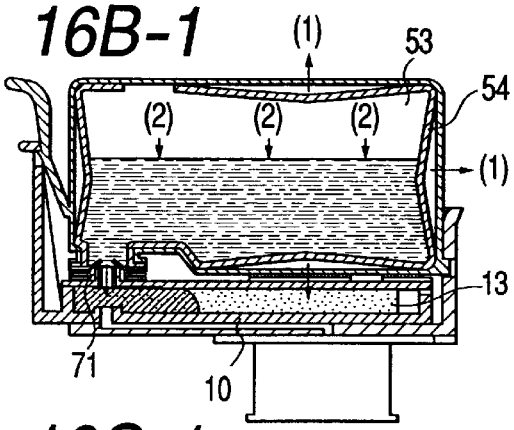
Figures 2, 16B:
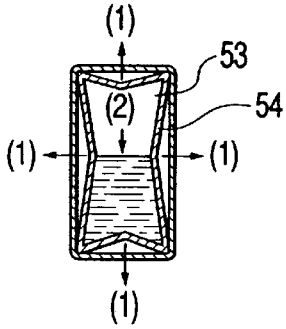

With the reduction of the atmospheric pressure (or the temperature rise), the air in the ink storage unit 53 is expanded. Then, as shown in FIGS. 16B-1 and 16B-2, the wall surface at (1) and the liquid level at (2) that constitute the ink storage unit 53 are pressed to increase the inner volume of the ink storage unit 53, and at the same time, a part of ink is caused to flow out from the ink storage unit 53 to the chamber 10 that contains the capillary force generating material through the communication tube 71. Here, since the inner volume of the ink storage unit 53 increases, the amount of ink that flows out to the capillary force generating material 13 (that is, the shift of the liquid level of the capillary force generating material 13 shown at (3) in FIG. 16C-1) is significantly smaller than the case where the ink storage unit 53 is not deformable.

Here, the amount of ink that flows out through the communication tube 71 results in the increase of the inner volume of the ink storage unit 53 by easing the negative pressure in the ink storage unit 53 if the changes of the atmospheric pressure is abrupt. Then, the resistance force of the wall surface, which is generated by mitigating the inward deformation of the inner wall surface of the ink storage unit 53, and the resistance force for absorbing ink into the capillary force generating material 13 by shifting ink, are dominant in exerting initial influences.

Particularly, in the case of the structure formed herein, the flow resistance of the capillary force generating materials 13 is greater than the resistance to the restoration of the inner wall 54. Therefore, along with the expansion of the air, the inner volume of the ink storage unit 53 is increased, at first, as shown in FIGS. 16A-1 and 16A-2. Then, if the voluminal increase brought about by the expansion of the air is greater than the upper limit of this increased portion, ink is allowed to flow out from the ink storage unit 53 to the chamber 10 that contains the capillary force generating material through the communication tube 71 as shown in FIGS. 16B-1 and 16B-2. In other words, the wall surface of the ink storage unit 53 functions as a buffer against the environmental changes, thus making the shift of ink easier in the capillary force generating material 13 to stabilize the characteristics of the negative pressure at the ink supply port.

Figures 1, 16C:
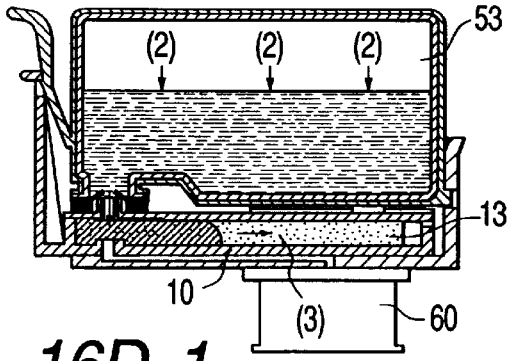
Figures 2, 16C:
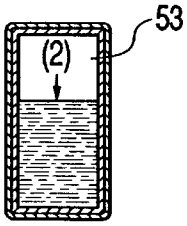

Here, in accordance with the present embodiment, ink which flows out to the chamber 10 that contains the capillary force generating material is retained in the capillary force generating material 13. In this case, as shown in FIGS. 16C-1 and 16C-2, the amount of ink in the chamber 10 that contains the capillary force generating material is increased temporarily to enable the gas-liquid interface to shift in the right direction in FIG. 16C-1. As a result, the inner pressure becomes slightly on the positive side temporarily than the stabilized period of the ink inner pressure as in the initiation period of use. However, the influence on the discharge characteristics of liquid jet recording means, such as the recording head 60, is small enough, and there is no problem at all as to the practical use. Also, when the atmospheric pressure is recovered to the level before the reduction of pressure (that is, one atmospheric pressure) or (restored to the original temperature), ink which has leaked into the chamber 10 that contains the capillary force generating material and retained in the capillary force generating material 13 is allowed to return to the ink storage unit 53, and at the same time, the volume of the ink storage unit 53 is allowed to return to the original state.

Figures 1, 16D:
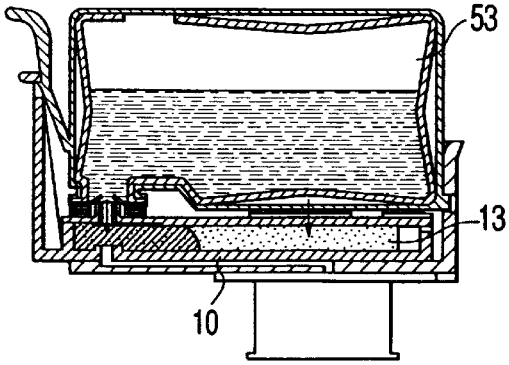
Figures 2, 16D:
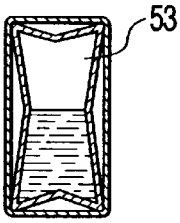

Now, in conjunction with FIG. 17, the description will be made of the principle operation after the initial operation subsequent to the changes in the atmospheric pressure, which is in the steady state that has been reached as shown in FIGS. 16D1 and 16D2 under the atmospheric pressure thus changed.

The characteristic aspect of this state is that not only the amount of ink led out from the ink storage unit is changed, but also, the interface of ink retained in the capillary force generating material is caused to change, and that the balance is kept to the fluctuation of the negative pressure due to the voluminal changes of the ink storage unit itself.

Here, with respect to the relationship between the amount of ink absorption by the capillary force generating material, and the ink container for the present invention, the maximum amount of ink absorption by the chamber that contains the capillary force generating material is determined in consideration of the flow-out amount of ink from the ink container under the worst condition, and the amount of ink to be retained in the chamber that contains the capillary force generating material at the time of ink supply from the ink container with a view to preventing ink leakage from the air communication port or the like due to the reduction of pressure or the temperature change. Then, it should be good enough if only the volume of the chamber that contains the capillary force generating material is set to be large enough to contain at least the capillary force generating material capable of retaining such portion.

Figure 17:
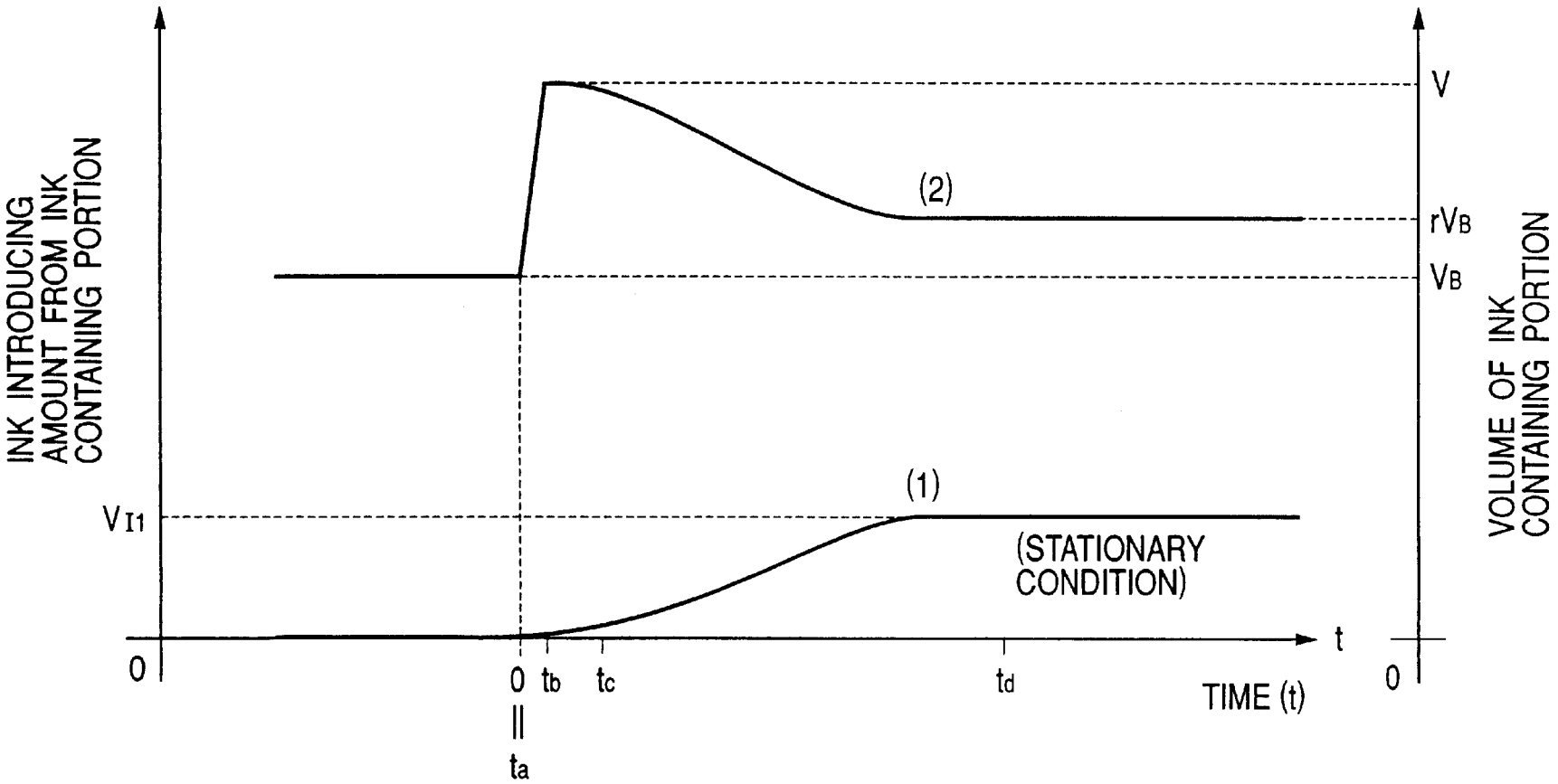
FIG. 17 is a view which illustrates changes in the amount of ink led out from the ink storage unit and the volume of the ink storage unit along with the elapse of time when decompressing the ink jet cartridge shown in FIG. 1.

FIG. 17 is a view which schematically shows the amount of ink led out from the ink storage unit as the time elapses, and the voluminal changes of the ink storage unit where the initial volume of the air is given as $V_{A1}$, and the use environment of the ink container is changed by reducing the atmospheric pressure to the P atmospheric pressure ($0<P<1$). In FIG. 17, the axis of abscissa indicates time (t), and the axis of ordinate indicates the amount of ink led out from the ink storage unit and the value of the ink storage unit. The temporal changes of the amount of ink led out from the ink storage unit is indicated by the solid line (1), the temporal changes of the volume of the ink storage unit is indicated by the solid line (2).

In FIG. 17, each state of the ink container that corresponds to $t=t^a$, $t=t_b$, $t=t^c$, and $t=t_d$, is as shown, respectively, in FIGS. 16A-1 and 16A-2, 16B-1 and 16B-2, 16C-1 and 16C-2, and 16D-1 and 16D-2.

As shown in FIG. 17, as to the abrupt changes of environment, it is possible to cope with the air expansion mainly in the ink storage unit before the steady state is reached, where the chamber that contains the capillary force generating material and the ink storage unit keep the balance of the negative pressure ultimately. As a result, it becomes possible to deter the timing to lead out ink from the ink storage unit to the chamber that contains the capillary force generating material even under the abrupt changes of environment.

Under various use environments, therefore, it is possible to provide the ink supply system capable of supplying ink under the stable condition of the negative pressure during the use of the ink storage unit, while making its allowable power higher against the expansion of the air outside that has been introduced in it by means of the gas-liquid exchange.

In accordance with the present invention, it becomes possible to determine the voluminal ratio arbitrarily between the chamber that contains the capillary force generating material and the ink storage unit by selecting the materials appropriately for the capillary force generating material and the ink storage unit to be used. Even if such ratio is greater than 1:2, it is possible to use the system practically.

Particularly when more importance should be attached to the buffer effect of an ink container, it is good enough if only the deformable amount of the ink storage unit is made greater in the gas-liquid exchange condition with respect to the use initiation state within the feasible range of the elastic deformation.

In this respect, in order to enable the aforesaid buffer effect of the ink storage unit to function efficiently, it is desirable to make the amount of the air that resides in the ink storage unit as small as possible in a state where the deformation of the ink storage unit is small, that is, the amount of the air that resides in the ink storage unit should desirably be as small as possible after connection and before the performance of the gas-liquid exchange.

The description has been made so far of the principal part of the present invention in accordance with the first embodiment thereof. Now, the other embodiments of the invention will be described as follows. In this respect, it is of course possible to arbitrarily combine any one of the elements that may be usable for combination from among each of the second to the seventh embodiments to follow, and the embodiment which has been described above.

(Second Embodiment)

Figure 18:
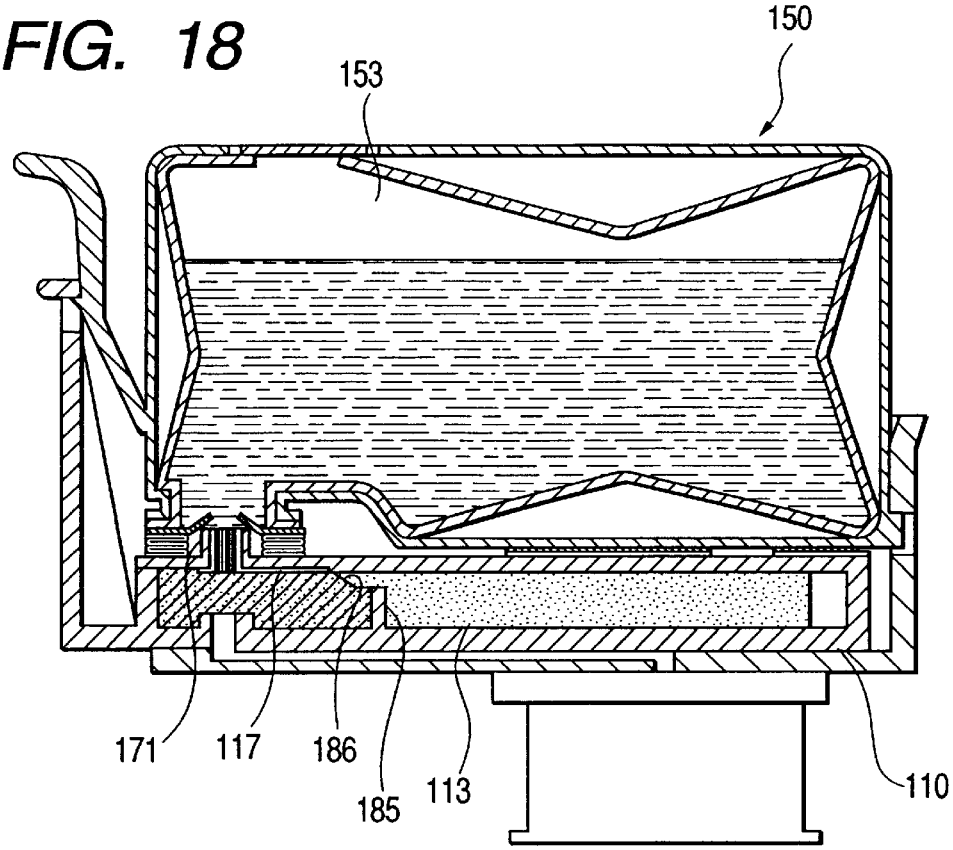
FIG. 18 is a cross-sectional view which shows the ink jet cartridge to which the liquid supply system is applied in accordance with a second embodiment of the present invention.

FIG. 18 is a cross-sectional view which shows the ink jet cartridge to which the liquid supply system is applicable in accordance with a second embodiment of the present invention.

In accordance with the present embodiment, an ink dam 185 is arranged on the bottom wall of the chamber 110 that contains the capillary force generating material in order to regulate the horizontal position of the gas-liquid interface 186 of ink absorbed by the capillary force generating material 113. All the other structures are the same as those of the first embodiment. Therefore, the description thereof will be omitted.

With the arrangement of such ink dam 185, ink is not absorbed by the capillary force generating material 113 on the right side of the ink dam 185 in FIG. 18. In other words, while maintaining the negative pressure in the ink storage unit 153 of the ink container 150 in good condition, it becomes possible to suppress the excessive ink absorption in the position away from tin ink dam 185 with respect to the communication tube 171. As a result, even if ink in the capillary force generating material 113 is influenced greatly by the gravity, it is not allowed to spread widely on the lower part. Then, ink is retained stably between the communication tube 171 and the ink supply path. At the same time, the position of the gas-liquid interface 186 can be settled stably in the vicinity of the end portion of the air introducing groove 117 on the air communication unit side.

(Third Embodiment)

Figure 19:
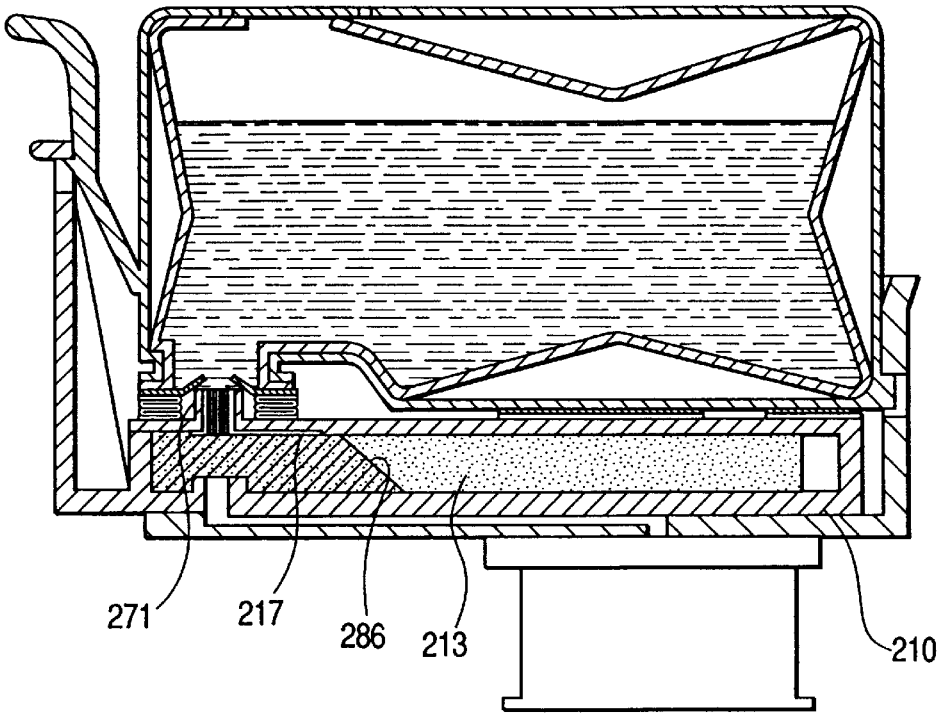
FIG. 19 is a cross-sectional view which shows the ink jet cartridge to which the liquid supply system is applied in accordance with a third embodiment of the present invention.

FIG. 19 is a cross-sectional view which shows the ink jet cartridge to which the liquid supply system is applicable in accordance with a third embodiment of the present invention.

In accordance with the present embodiment, a porous material, such as polyurethane form, whose distributional density of fine holes is arranged to change continuously in the horizontal direction, is used for the capillary force generating material 213. The distributional density of fine holes is the highest on the end portion that abuts upon the communication tube 271. Then, farther away from that portion, the lower it becomes. In other words, the capillary force generating material 213 is formed to absorb ink most easily in the vicinity of the portion that abuts upon the communication tube 271, and the structure is arranged so that it becomes more difficult to absorb ink as it farther away from the communication tube 271. All other structures are the same as those of the first embodiment. Therefore, the description thereof will be omitted.

Using the capillary force generating material 213 described above the ink, which is introduced from the communication tube 271 to the chamber 210 that contains the capillary force generating material, is absorbed into the capillary force generating material 213 priority in the vicinity of the communication tube 271. Then, the excessive ink absorption is suppressed in the position away from the communication tube 271. As a result, it becomes possible to retain ink stably between the communication tube 271 and the ink supply path. At the same time, the position of the gas-liquid interface 286 can be settled stably in the vicinity of the end portion of the air introducing groove 217 on the air communication unit side.

(Fourth Embodiment)

Figure 20A:
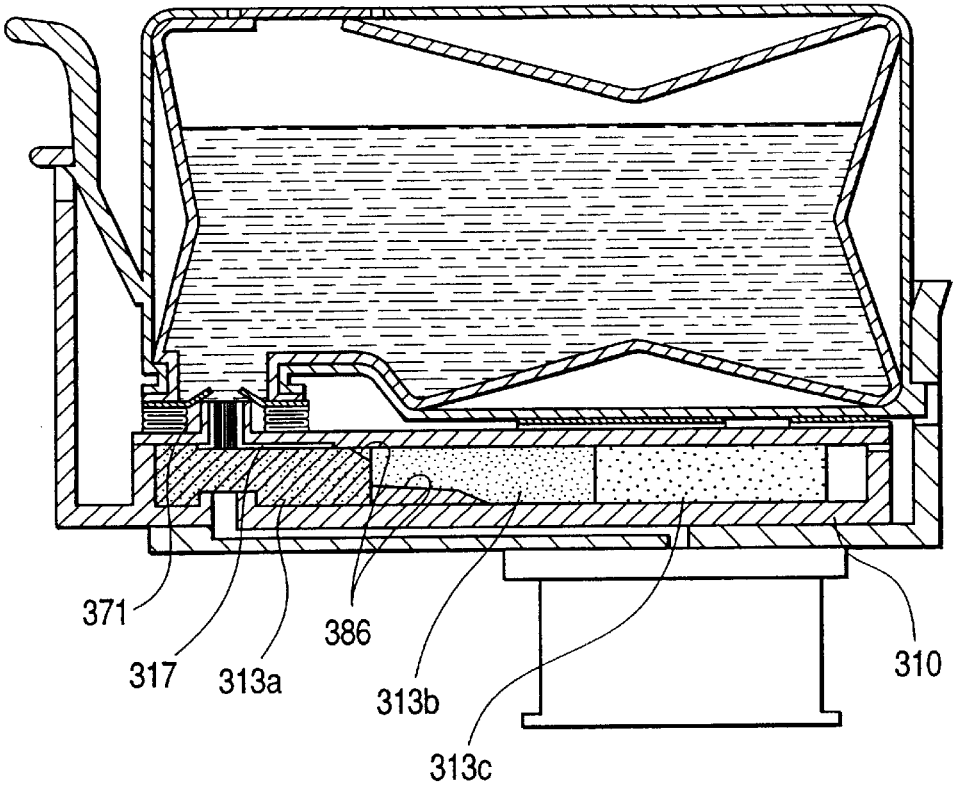
FIGS. 20A, 20B and 20C are cross-sectional views showing each of the ink jet cartridges to which the liquid supply system is applied, respectively, in accordance with a fourth embodiment of the present invention.

FIG. 20A is a cross-sectional view which shows the ink jet cartridge to which the liquid supply system is applicable in accordance with a fourth embodiment of the present invention.

In accordance with the present embodiment, three capillary force generating materials are housed in the chamber 310 that contains the capillary force generating materials 313*a*, 313*b*, and 313*c*. Each of the capillary force generating materials 313*a*, 313*b*, and 313*c* is arranged in line from one end portion on the side where the communication tube 371 of the chamber 310 that contains the capillary force generating material is arranged to the other end thereof. One of the capillary force generating materials, 313*a*, is in contact with the communication tube 371. Also, each of the capillary force generating materials 313*a*, 313*b*, and 313*c* is formed by the porous material each having the different distributional density of fine holes. The distributional density of fine holes of the capillary force generating material 313*a*, which is in contact with the communication tube 371, is the highest. Then, that of the capillary force generating material 313*b*, which is in contact with the capillary force generating material 313*a* is high, and that of the material 313*c* which is in the position farthest from the communication tube 371 is the lowest.

In this way, by use of the three capillary force generating materials 313*a*, 313*b*, and 313*c* each having the different distributional density of fine holes, the material 313*a* which is arranged to absorb ink most easily is positioned to be in contact with the communication tube 371. Then, the ink, which is introduced from the communication tube 371 to the chamber 310 that contains the capillary force generating material is priority absorbed into the material 313*a*, while suppressing the excessive absorption of ink in the portions away from the communication tube 371. As a result, ink is stably retained between the communication tube 371 and the ink supply path. At the same time, the position of the gas-liquid interface can be settled stably in the vicinity of the end portion of the air introducing groove 317 on the air communication unit side. Here, the capillary force generating materials are not necessarily limited to three. It may be possible to modify such number as required.

Also, the arrangement of the plural capillary force generating materials is not necessarily limited to the mode described above.

Figure 20B:
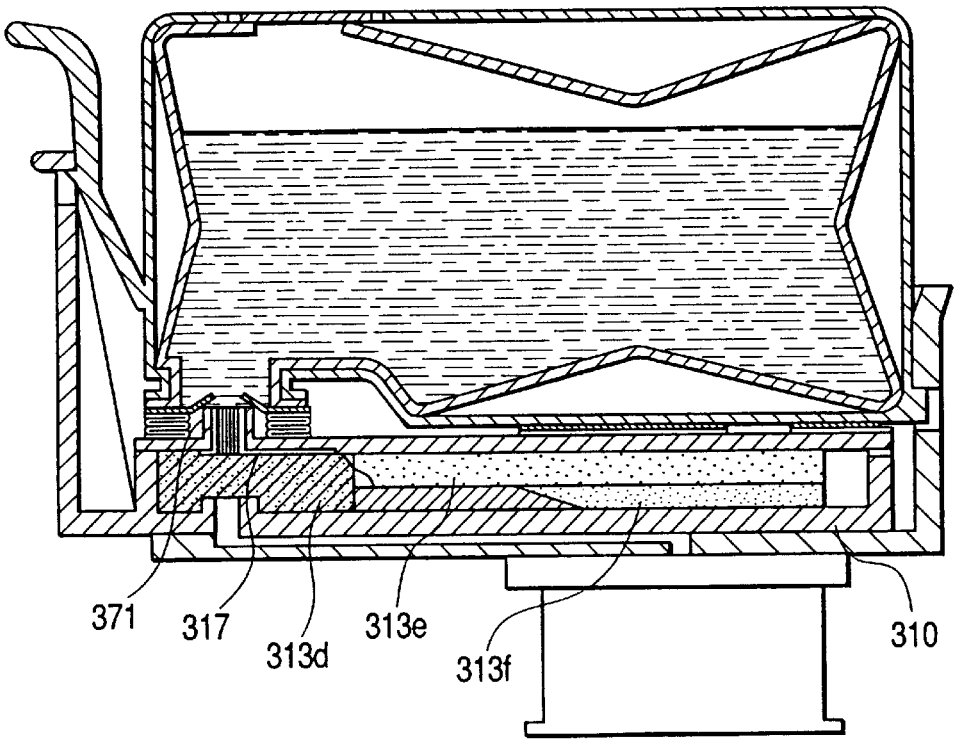

FIG. 20B is a cross-sectional view which shows the ink jet cartridge to which the liquid supply system is applicable in accordance with the variational example of the fourth embodiment of the present invention. In accordance with the present embodiment, three capillary force generating materials are housed in the chamber 410 that contains the capillary force generating materials 313*d*, 313*e*, and 313*f* as in the aforesaid fourth embodiment. However, the arrangement of each of the capillary force generating materials 313*d*, 313*e*, and 313*f* is different from that of the fourth embodiment. In other words, the capillary force generating material 313*d*, which is in contact with the communication tube 371, is arranged in the same manner as the fourth embodiment. However, the remaining two materials 313*e* and 313*f* are arranged up and down, respectively. Also, as to the distributional density of fine holes of the capillary force generating materials 313*d*, 313*e*, and 313*f*, the highest one is the material 313*d* which is in contact with the communication tube 371, and the next is the lower material 313*e*, and then, the last is the upper material 313*f* in that order.

In this way, the capillary force generating material 313*d*, which is in contact with the communication tube 371, is arranged to absorb ink most easily. Then, as to the capillary force generating materials 313*e* and 313*f*, which are not in contact with the communication tube 371, the arrangement is made so that the lower material 313*f* is made easier to absorb ink. In this way, while settling the position of the gas-liquid interface stably in the vicinity of the end portion of the air introducing groove 317 on the air communication unit side, it becomes possible to perform the ink consumption in the chamber 410 that contains the capillary force generating material smoothly along in the gravitational direction.

Figure 20C:
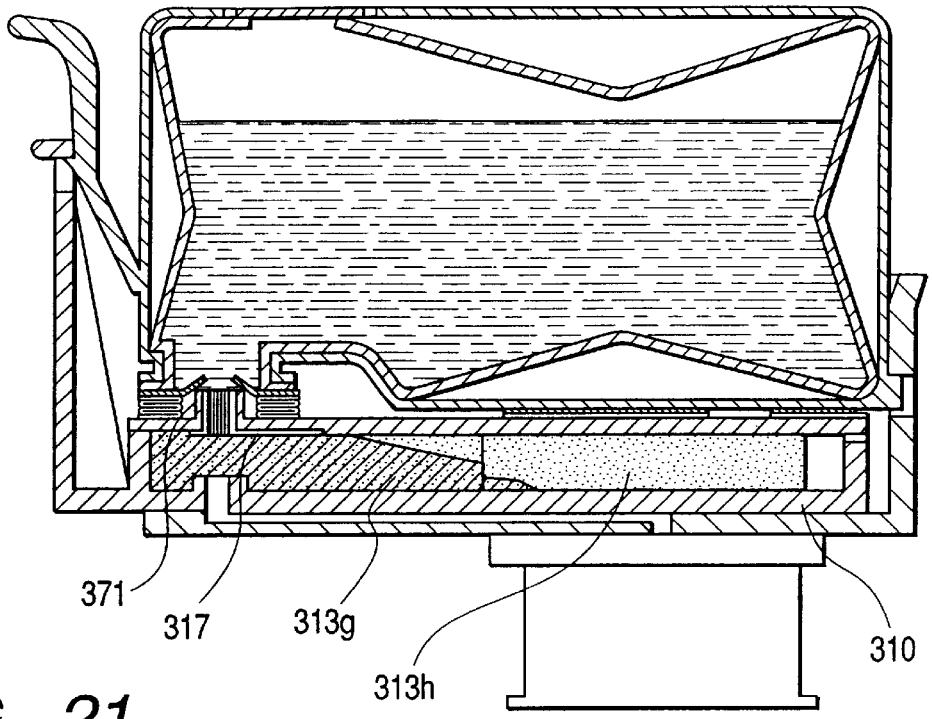

Further, as the capillary force generating material to be adopted, it may be possible to use the one having the different distributional density of fine holes depending on the locations (the density of fabric if textile is used as an absorbent) as disclosed in the third embodiment described above. FIG. 20C is a cross-sectional view which shows the ink jet cartridge in accordance with such variational example as this.

In accordance with the present embodiment, two capillary force generating materials 313*g* and 313*h* are housed in the chamber 310 that contains the capillary force generating material. Each of the materials 313*g* and 313*h* is arranged in line along one end portion on the side where the communication tube 371 is arranged for the chamber 310 that contains the capillary force generating material to the other end portion. Also, the distributional density of the fine holes of each of the materials 313*g* and 313*h* is arranged to change continuously in the horizontal direction, and each distributional density is made higher on the side nearer to the communication tube 371.

With the structure thus arranged, it becomes possible to settle the position of the gas-liquid interface of ink introduced from the communication tube 371 to the chamber 310 that contains the capillary force generating material more stably in the vicinity of the end portion of the air introducing groove 317 on the air communication unit side.

(Fifth Embodiment)

Figure 21:
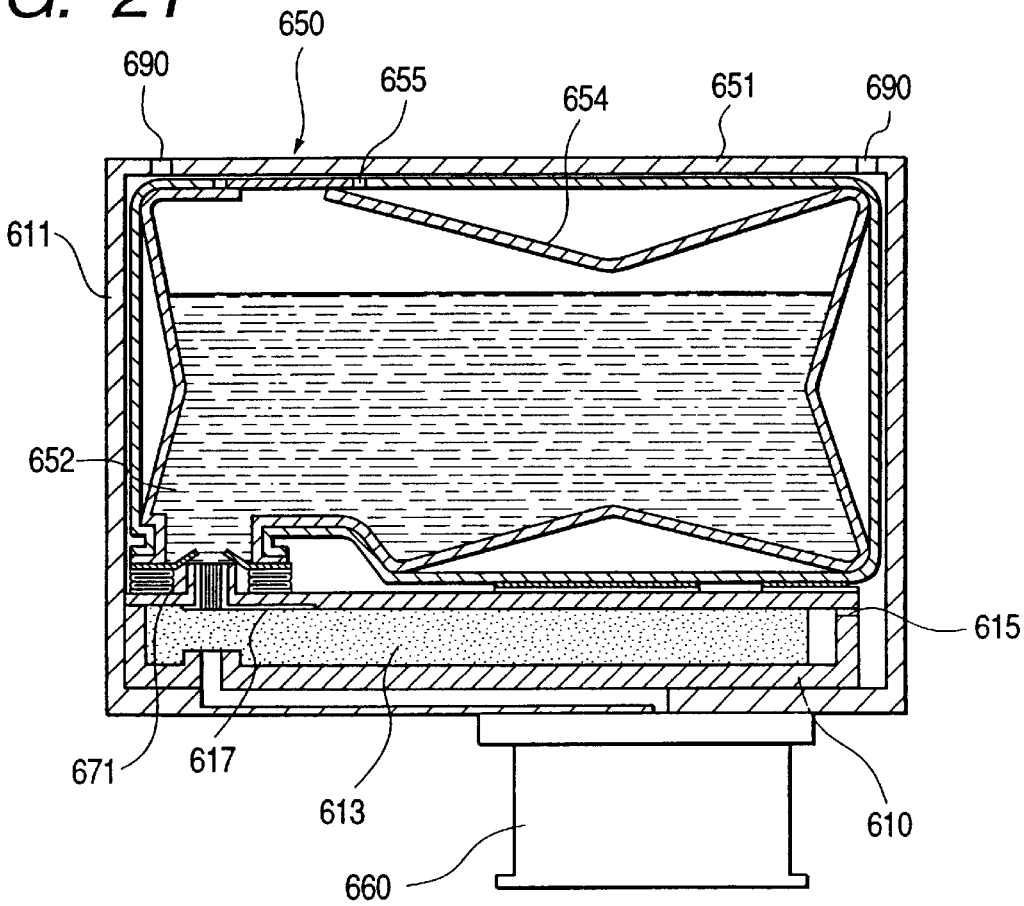
FIG. 21 is a cross-sectional view which shows the ink jet cartridge to which the liquid supply system is applied in accordance with a fifth embodiment of the present invention.

FIG. 21 is a cross-sectional view which shows the ink jet cartridge to which a liquid container is applicable in accordance with a fifth embodiment of the present invention.

In accordance with the present embodiment, the ink jet cartridge is contained integrally with an ink container 650 and a chamber 610 that contains the capillary force generating material having a capillary force generating material 613 in it in a housing 611 of box type having a recording head 660 installed thereon as in the first embodiment.

In other words, the ink container 650 is formed by the outer wall 651 and the flexible inner wall 654. Then, in the interior of the inner wall 654, ink is stored. For the lower wall on the one end portion of the ink container 650, the ink supply unit 652 is arranged. The ink container 650 is connected with the chamber 610 that contains the capillary force generating material,which is arranged below the ink container 650 through the communication tube 671 installed on the upper wall of the chamber 610 that contains the capillary force generating material. Also, on the inner side of the upper wall surface of the chamber 610 that contains the capillary force generating material in the vicinity of the communication tube 671, the air introducing groove 617, which is communicated with the interior of the communication tube 671, is formed to extend toward the other end side of the chamber 610 that contains the capillary force generating material.

For the housing 611, the communication port 690 is formed to be communicated with the interior and exterior of the housing 611. The interior of the housing 611 is communicated with the air outside through this communication port 690. Therefore, it is possible to introduce the air outside between the outer wall 651 and the inner wall 654 of the ink container 650 through the communication port 690 and the air communication port 690 of the outer wall 651. Also, it is possible to introduce the air outside into the chamber 610 that contains the capillary force generating material through the communication port 690 and the air communication port 615 of the chamber 610 that contains the capillary force generating material.

Then, in the cartridge which is formed integrally with the ink container 650 and the chamber 610 that contains the capillary force generating material, it is possible to cope with the environmental changes even if the limit of the inner volume of the ink container 650 is eased as in the first embodiment described earlier. Further, it is possible to maintain the stabilized supply condition at all times.

Here, in accordance with the present embodiment, the description has been made of the chamber 610 that contains the capillary force generating material, which contains only the capillary force generating material 613. However, it may be possible to adopt the structure described for the second to fourth embodiments, such as to make the capillary force different depending on the distances from the communication tube 671: the farther away from the communication tube 671, the more is the capillary force different continuously or stepwise.

Also, in accordance with the present embodiment, the recording head 660 is integrally formed with both the ink container 650 and the chamber 610 that contains the capillary force generating material. However, it may be possible to arrange the recording head separably from the integrally formed ink container 650 and chamber 610, and to use the head together with them as one body for operation.

(Sixth Embodiment)

Figure 22A:
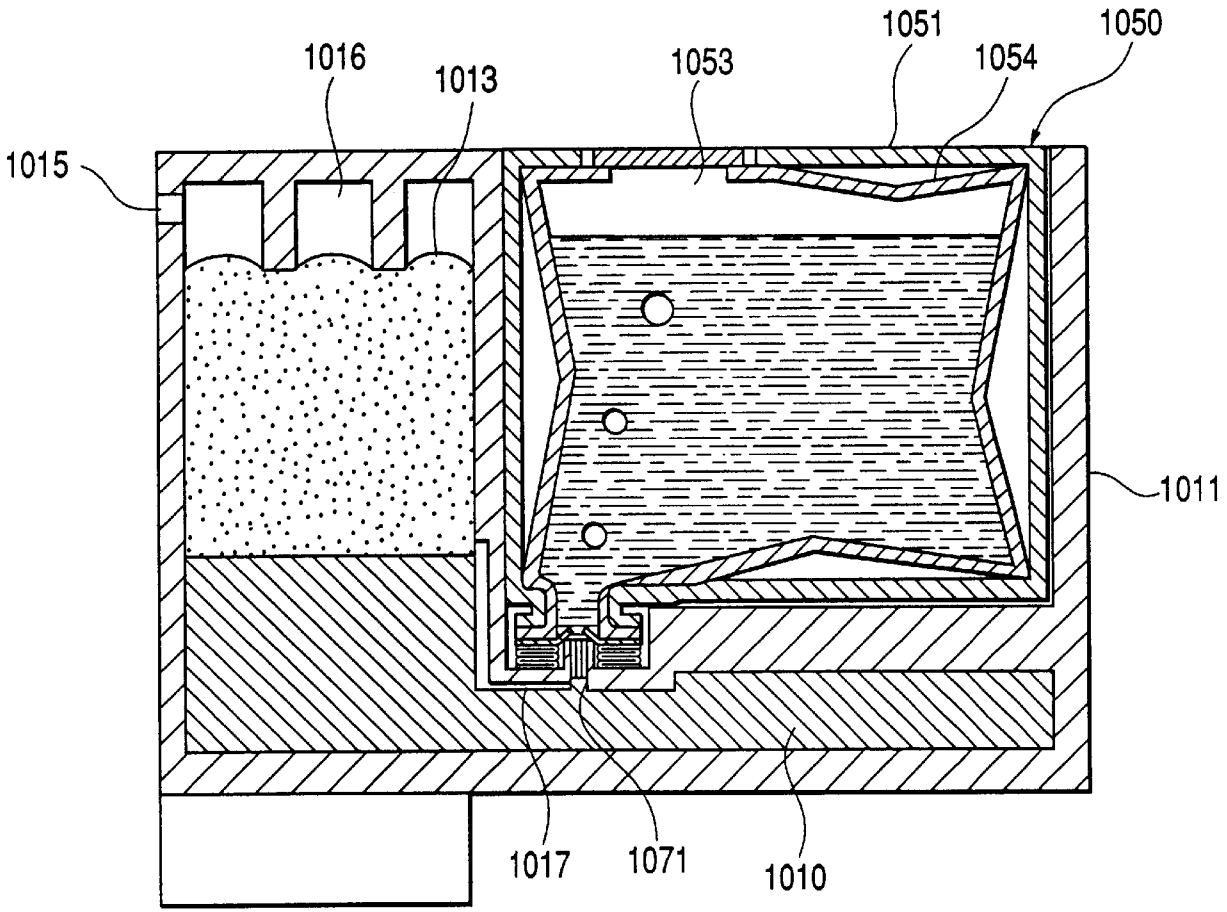
FIGS. 22A, 22B and 22C are cross-sectional views showing each of the ink jet cartridges to which the liquid supply system is applied, respectively, in accordance with a sixth embodiment of the present invention.

FIG. 22A is a cross-sectional view which shows the ink jet cartridge to which the liquid supply system is applicable in accordance with a sixth embodiment of the present invention.

For the present embodiment, the configuration of the capillary force generating material 1013 is different from those of the first to the fifth embodiments described above. In other words, the chamber 1010 that contains the capillary force generating material, which is integrally formed with the tank holder 1011 that detachably holds the ink container 1050, is structured substantially in a L-letter shape, observed from the side, in which one portion thereof rises upward when used. Along with this configuration, the capillary force generating material 1013 and the air introducing groove 1017 are also configured to be substantially in the L-shape. Then, the communication tube 1071, which serves as the connecting portion with the ink container 1050, is installed in the vicinity of the curved portion of an L-shaped horizontal part.

The air communication port 1015 is arranged on the uppermost part of the extended portion of the chamber 1010 that contains the capillary force generating material. In the vicinity of the air communication port 1015, the buffer unit 1016 is formed by the ribs extended from the inner wall surface of the chamber 1010 that contains the capillary force generating material. At the same time, the capillary force generating material 1013 is compressed and held in the chamber 1010 that contains it.

The ink container 1050 comprises the outer wall 1051 that serves as the housing to form the chamber as in each of the embodiments described above, and the deformable inner wall 1054 having the inner surface which is equal or analogous to the outer wall 1051. Ink is retained in the ink storage unit 1053 inside the inner wall 1054. Also, the structure of the connection portion, which connects the chamber 1010 that contains the capillary force generating material with the ink container 1050, is the same as each of the embodiments described above.

Here, in FIG. 22A, there is no representation of the ink supply port that supply ink from the chamber 1010 that contains the capillary force generating material to the recording head. However, it is preferable to arrange the ink supply port in the vicinity of the communication tube 1071 on the bottom end of the chamber 1010 that contains the capillary force generating material as in each of the embodiments described above.

As in the present embodiment, with one portion of the capillary generating material 1013 which rises up substantially in the L-shape, it becomes possible to make the height of the gravitational direction greater in the portion of the material 1013 thus raised. Then, the buffer effect is enhanced against the external causes such as to be brought about by the temperature changes, the pressure changes, or the like. Further, the chamber 1010 is substantially in the L-shape, which makes it possible to install the communication tube 1071 on the upper surface of the L-shaped horizontal portion, which enhancing the buffer effect more against the external causes as described above. Therefore, the possible ink leakage is dealt with on the tank holder 1011 side when the ink container 1071 is attached or detached.

Also, with the structure hereof, the freedom of connection portion between the tank holder 1011 and the ink container 1050 is enhanced, and as shown in FIG. 22A, it becomes possible to adopt the method of the vertical attachment and detachment, the latch lever method as described for the embodiments described above, or various other connecting methods. Further, as described earlier, it becomes possible to operate the air introduction more smoothly for the communication tube 1071 at the time of the ink container 1050 installation or at the time of the gas-liquid exchange.

Figure 22B:
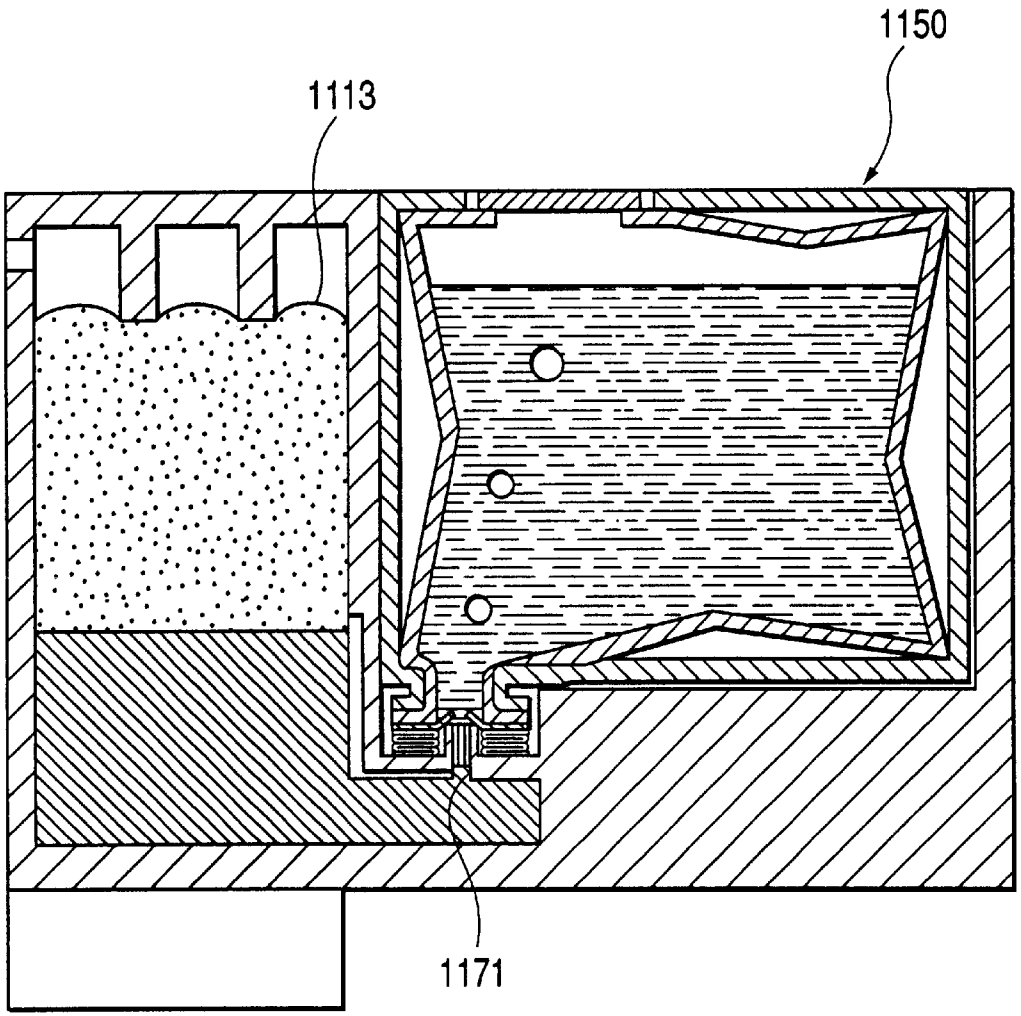
Figure 22C:
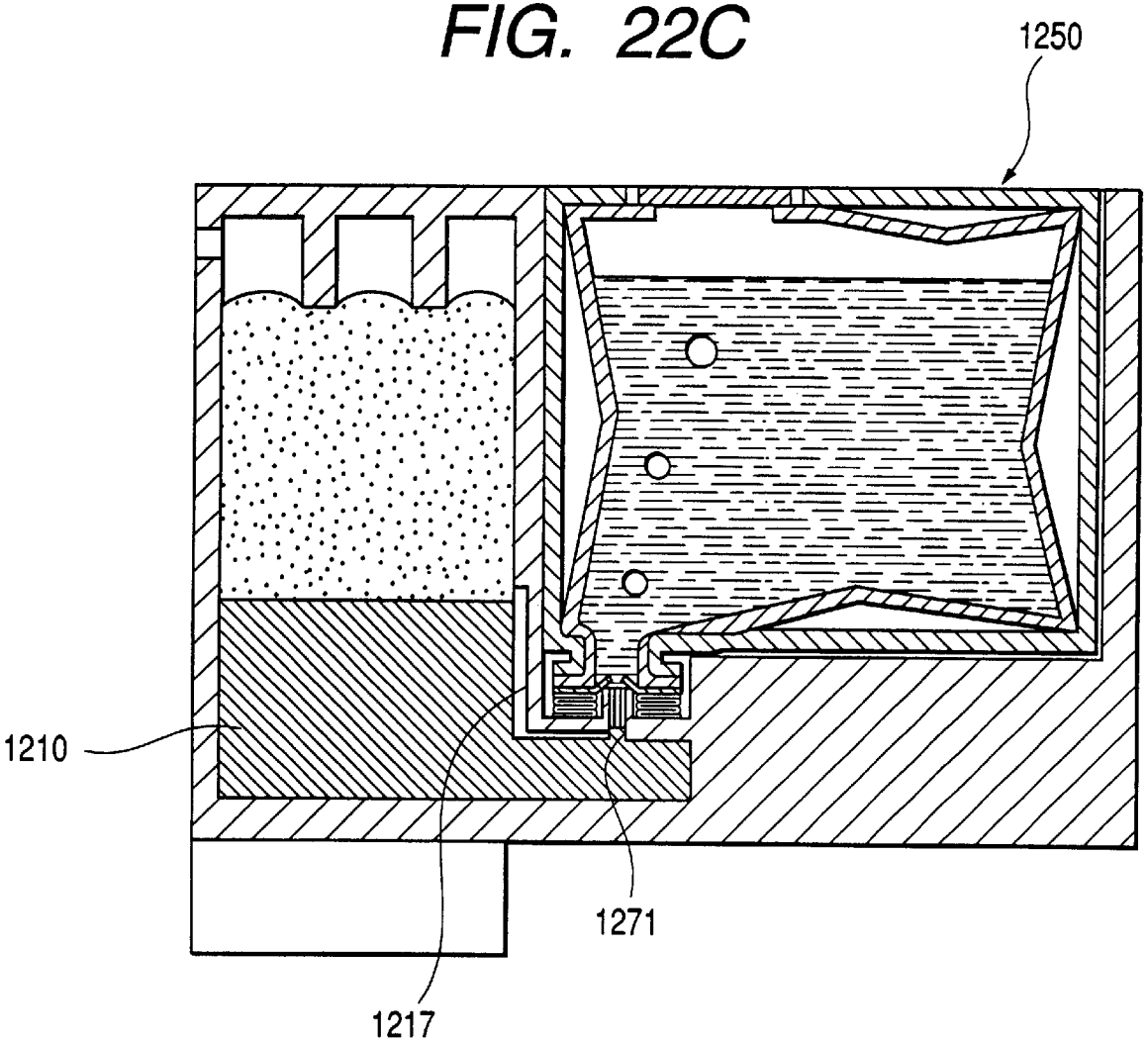

FIGS. 22B and 22C are views which illustrate the variational examples of the L-shape capillary force generating material.

The variational example shown in FIG. 22B is such that the length of the portion positioned below the ink container 1150, that is, the horizontal portion of the capillary force generating material 1113, is made shorter that of the sixth embodiment. Then, below the ink container 1150, the capillary force generating material 1113 is positioned only in the vicinity of the communication tube 1171. With the structure thus arranged, it becomes possible to make the reminders of ink in the capillary force generating material 1113 smaller still, thus using ink more efficiently. Here, in accordance with this variational example, too, there is no possibility that the aforesaid buffer effect is reduced.

Also, the variational example shown in FIG. 22C is different from the variational example sown in FIG. 22B in the configuration of the air introducing groove 1217 which is formed on the inner wall surface of the chamber 1210 that contains the capillary force generating material. In other words, whereas the air introducing groove is in the L-shape for the variational example shown in FIG. 22B, the air introducing groove 1217 of the present example is formed only on the rising portion of the L-shaped chamber 1210 that contains the capillary force generating material. Even when the air introducing groove 1217 is formed only on the rising portion of the chamber 1210 that contains the capillary force generating material, the air introduced into the chamber 1210 from the ink container 1250 through the communication tube 1271 is allowed to reach the air introducing groove 1217 after passing on the supper surface of the horizontal portion of the chamber 1210 that contains the capillary force generating material. In this way, the gas-liquid exchange can be performed in the same manner as each of the embodiments described above to make it possible to perform the ink supply stably.

Further, in the sixth embodiment described above, it may be possible to adopt the plural capillary force generating materials as shown in the fourth embodiment. The variational examples thus arranged will be shown in FIGS. 23A to 23C. Here, in FIGS. 23A to 23C, ink which is retained by the negative generating member is omitted for the representation therein.

Figure 23A:
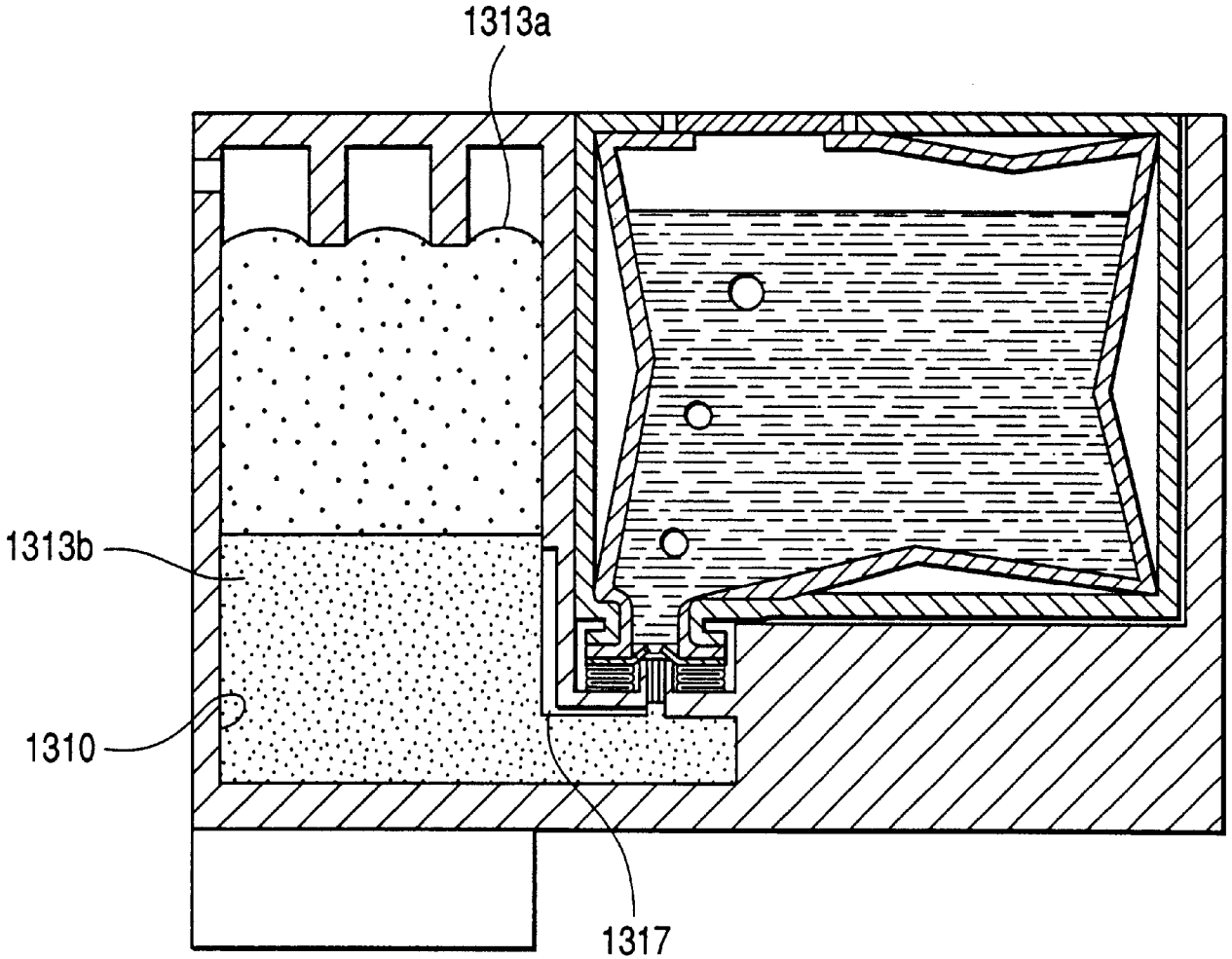
FIGS. 23A, 23B and 23C are cross-sectional views showing each of the ink jet cartridges to which the liquid supply system is applied, respectively, in accordance with a sixth embodiment of the present invention.

For the variational example shown in FIG. 23A, the configurations of the chamber 1310 that contains the capillary force generating material and the air introducing groove 1317 are the same as those of the variational example shown in FIG. 22B. However, what differs is that two capillary force generating materials 1313*a* and 1313*b* are contained in the chamber 1310 that contains them. Each of the capillary force generating materials 1313*a* and 1313*b* is formed by porous material, respectively, and arranged in the top and bottom direction. Also, the distributional density of the fine holes of the lower material 1313*b* is higher than that of the upper material 1313*a*. In other words, the lower material 1313*b* provides higher capillary force than the upper material 1313*a*. Also, the boundary between the two capillary force generating materials 1313*a* and 1313*b* is positioned above the upper end of the air introducing groove 1317.

In this way, the two capillary force generating materials 1313*a* and 1313*b* whose distributional densities of fine holes are different from each other are arranged up and down so as to position the capillary force generating material 1313*b* having the higher distributional density of fine holes below. Thus, the gas-liquid interface in the chamber 1310 that contains the capillary force generating material can be positioned stably on the boundary between these materials 1313*a* and 1313*b*. As a result, ink distributions in these materials 1313*a* and 1313*b* are stabilized to enhance the reliability of ink supply, because with this arrangement there hardly occurs any possible ink shortage.

Also, in some cases, the interface of retained ink may vary in each of the capillary force generating materials 1313*a* and 1313*b*, but if the boundary between the two materials 1313*a* and 1313*b* is positioned above the upper end of the air introducing groove 1317, it becomes possible to use ink in the upper material 1313*a* sufficiently, and then, use in the lower material 1313*b*. As a result, it is made possible to secure the buffer area stably for the chamber 1310 that contains the capillary force generating material.

With these in view, it is preferable to set the boundary position between the two capillary force generating materials 1313*a* and 1313*b* above the upper end of the air introducing groove 1317, and to position it as near as possible to the upper end of the air introducing groove 1317. Also, when these two materials 1313*a* and 1313*b* should be arranged so that these materials 1313*a* and 1313*b* are in contact with each other under pressure at the boundary portion thereof, the capillary force is made higher on that connecting portion to enable ink in the lower material 1313*b* to be used more reliably after ink in the upper material 1313*a* is used sufficiently in its own region.

Figure 23B:
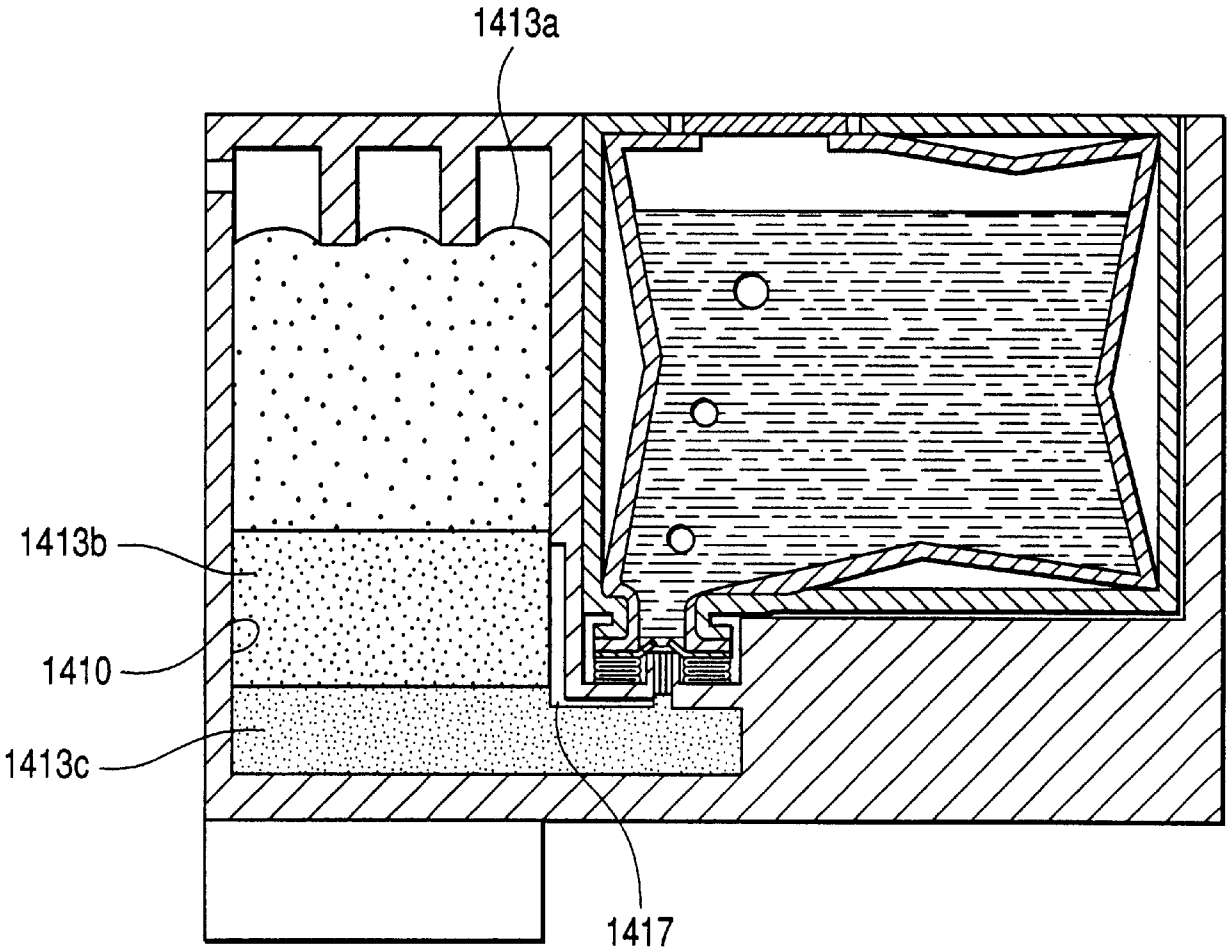

For the variational example shown in FIG. 23B, the three capillary force generating materials 1413*a*, 1413*b*, and 1413*c* are contained in the chamber 1410 that contains them. Each of the capillary force generating materials 1413*a*, 1413*b*, and 1413*c* is arranged in the top and bottom direction. Also, the distributional densities of the fine holes are made higher in order of the higher positioned material 1413*a*, the middle positioned material 1413*b*, and the lower positioned material 1413*c*. Also, the boundary between the higher positioned material 1413*a* and the middle positioned material 1413*b* is positioned above the upper end of the air introducing groove 1417, and the boundary between the middle positioned material 1413*b* and the lower positioned material 1413*c* is positioned above the L-shape corner portion from chamber 1410 that contains them (that is, the lower end portion of the air introducing groove 1417). All other structures are the same as those shown in FIG. 23A.

With the arrangement of these three capillary force generating materials 1413*a*, 1413*b*, and 1413*c* in the top to bottom direction, the area where the middle positioned material 1413*b* resides can be utilized as the operating area so as to keep the gas-liquid interface to reside in that area even if the position of the gas-liquid interface varies slightly. As a result, it becomes possible to make the lower positioned material 1413*c* the area that retains ink at all times (that is, the so-called ink rich area), hence performing the ink supply more stably. Also, with the boundary between the middle positioned material 1413*b* and lower positioned material 1413*c* being positioned above the lower end portion of the air introducing groove 1417, it becomes possible to use ink in the lower positioned material 1413*c* after ink in the area in the middle positioned material 1413*b* is used sufficiently. As a result, the buffer area in the chamber 1410 that contained the capillary force generating material can be secured more stably. Here, in accordance with the present variational example, the description has been made of the case where distributional densities of the fine holes are different for the middle positioned and lower positioned materials 1413*b* and 1413*c*, but it may be possible to make them equal.

Figure 23C:
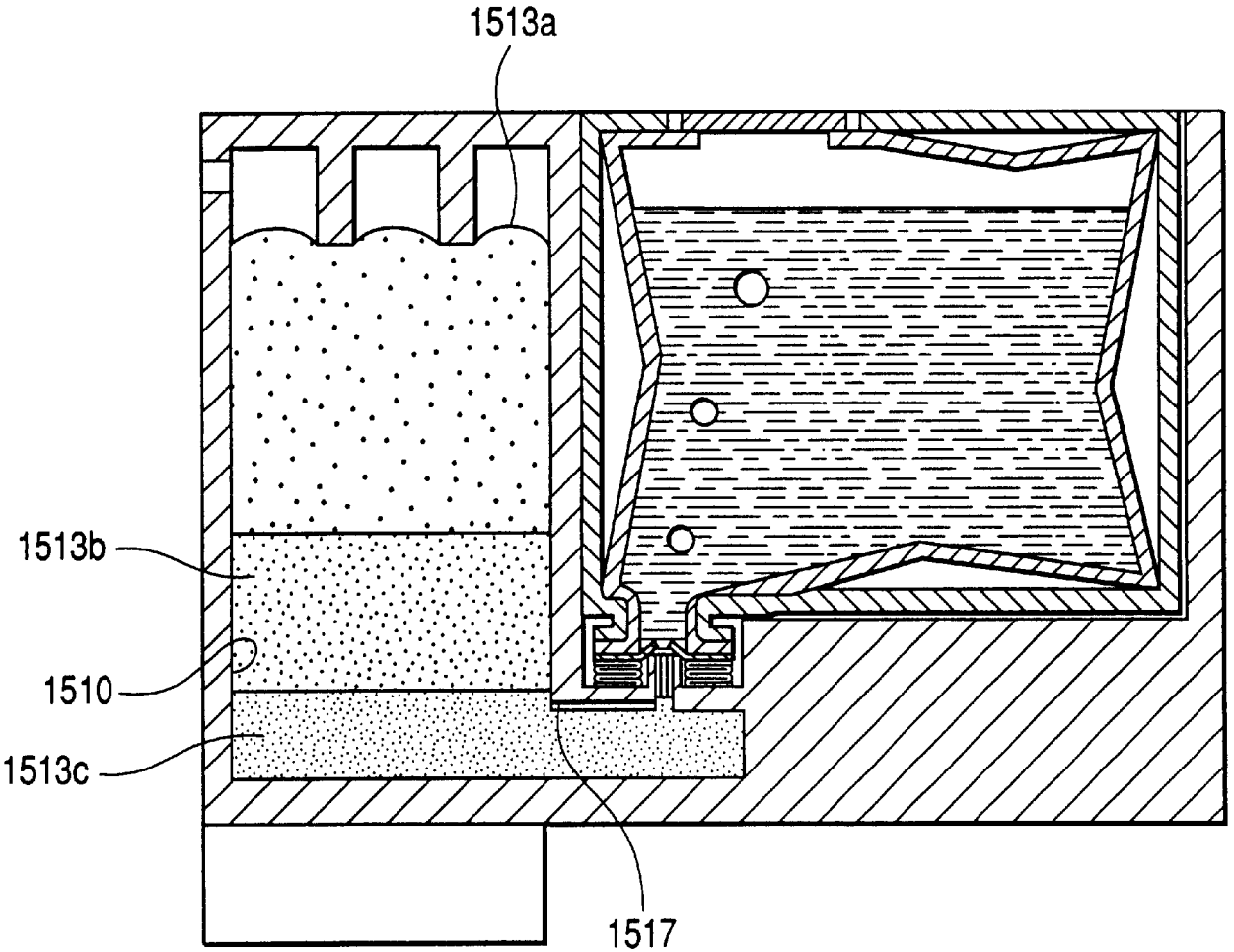

Further, for the variational example shown in FIG. 23C, the configuration of the air introducing groove 1517 formed in the chamber 1510 that contains the capillary force generating material is different from the variational example shown in FIG. 22B. Whereas the air introducing groove of the variational example shown in FIG. 22B is in the L-shape, the one in the present example forms only its horizontal portion below the connecting tube from the opening portion of the connecting tube to the rising portion of the chamber 1510 that contains the capillary force generating material. In this way, the three capillary force generating materials 1513*a*, 1513*b*, and 1513*c* are arranged in the top to down direction in the substantially L-shaped chamber 1510 that contains them. Further, the boundary between the middle positioned material 1513*b* and the lower positioned material 1513*c* is positioned at the L-shaped corner portion from chamber 1510 that contains them. Thus, it becomes possible to form the gas-liquid interface during the operation of the gas-liquid exchange in the boundary area between the middle positioned material 1513*b* and the lower positioned material 1513*c* without the installation of the air introducing 1517 on the rising portion of the chamber 1510 that contains the capillary force generating material. Hence, the stabilized ink supply is possible, and also, since the gas-liquid interface can be positioned below, the buffer effect is enhanced against the temperature and pressure changes and other environmental changes.

(Seventh Embodiment)

Figure 24:
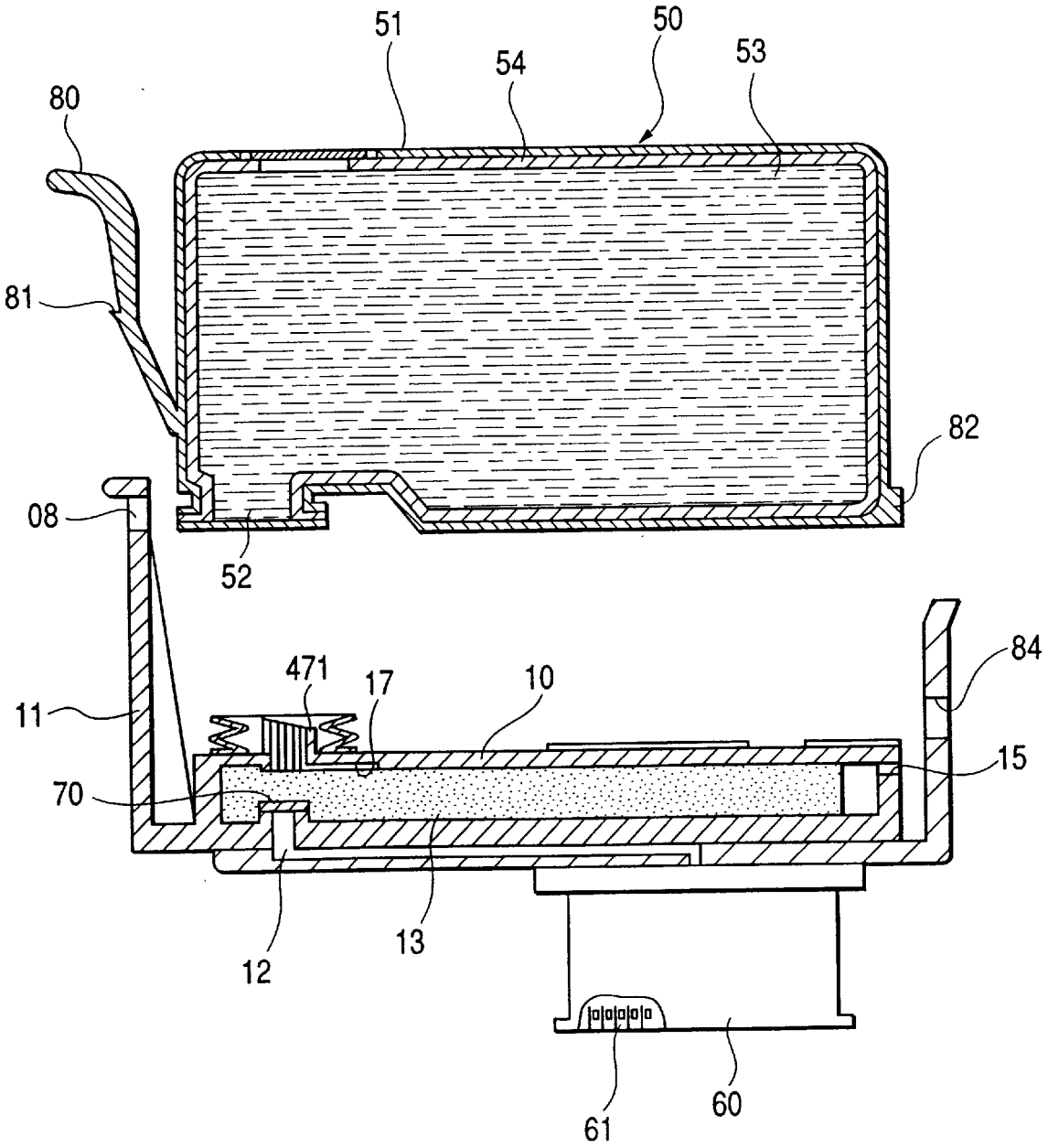
FIG. 24 is a view which schematically illustrate the ink jet cartridge to which the liquid supply system is applied in accordance with a seventh embodiment of the present invention, and which is a cross-sectional view showing the ink jet cartridge before the ink container is mounted on the holder with head.
Figure 25A:
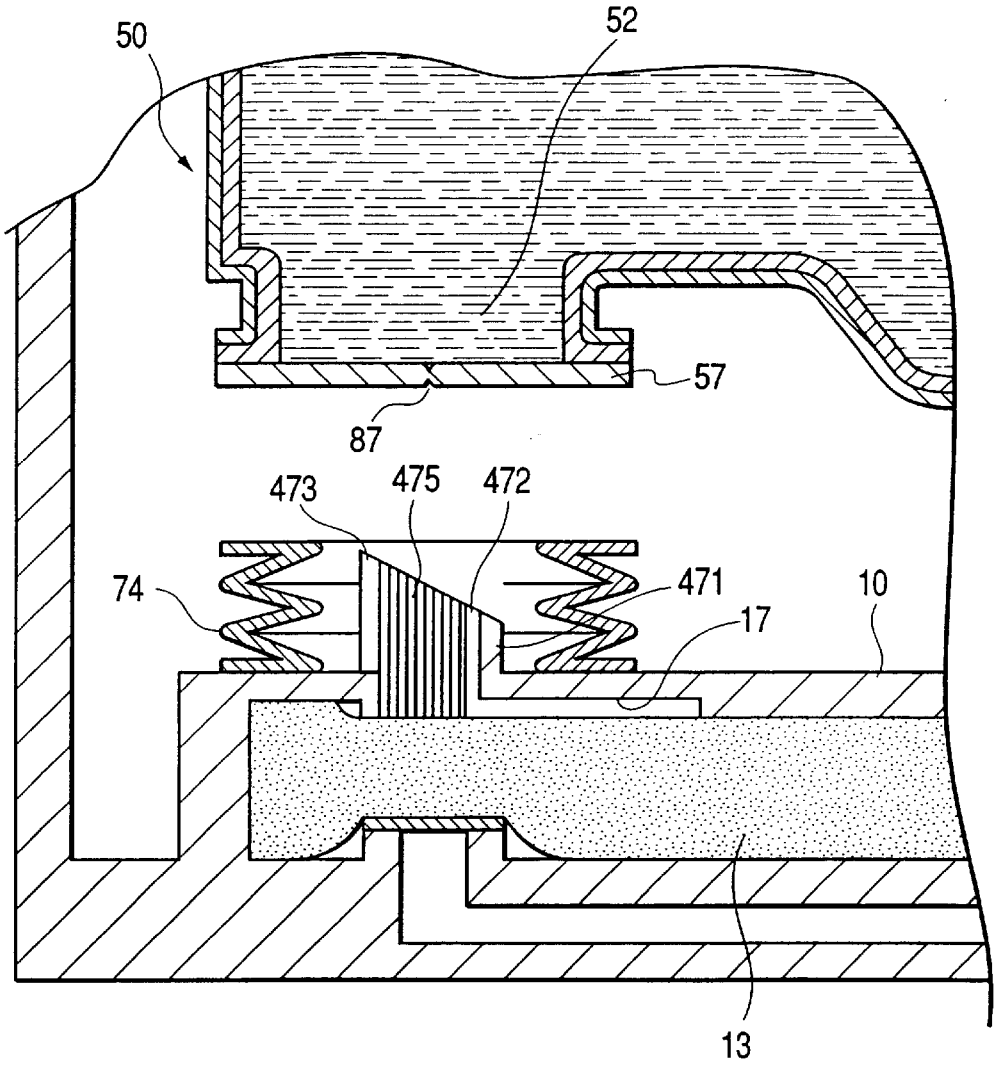
FIGS. 25A and 25B are the enlarged views which illustrate the connecting unit of the ink passage between the ink container and the holder with head shown in FIG. 24.
Figure 25B:
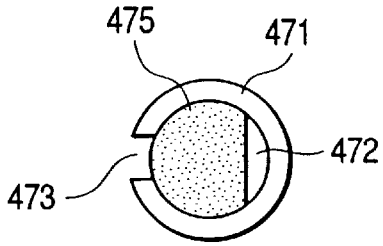

FIG. 24 is a view which schematically illustrates the ink jet cartridge to which the liquid supply system is applicable in accordance with a seventh embodiment of the present invention, which is a cross-sectional view showing the state before the ink container is mounted on the holder with head. Also, FIGS. 25A and 25B are enlarged views which shows the connecting portion of the ink passage between the ink container and the holder with head represented in FIG. 24.

In accordance with the present embodiment, the upper end face of the communication tube 471 is formed slantly so that the position of the upper end of the ink introducing device 475 is arranged to be higher than the position of the aperture end of the air introducing path 472. This is different from the first embodiment. All the other structures are the same as those of the first embodiment.

With the slanted formation of the upper end face of the communication tube 471, it becomes possible to supply ink in the ink storage unit 53 to the capillary force generating material 13 efficiently in addition to the same effect obtainable by the first embodiment, because the ink inducing device 475 is communicated with the ink storage unit 53 earlier when the connecting tube 471 is inserted into the ink supply unit 52 of the ink container 50, hence enabling ink in the ink storage unit 53 to flow priority into the ink introducing device 475.

(Other Embodiments)

So far, the embodiments of the present invention have been described. Hereinafter, the description will be made of the other embodiments applicable to each of the embodiments and the variational examples of each of the embodiments. In this respect, unless otherwise stated specifically, the following description will be applicable to each of the embodiments described above.

<The Structure of the Chamber that Contains the Capillary Force Generating Material>

At first, the supplemental description will be made of the structure of the chamber that contains the capillary force generating material in accordance with each of the embodiments described above.

As the capillary force generating material contained in the chamber that contains it (the container of the capillary force generating material), it is possible to use the felt type fabrics, the thermally formed fabric floc, or the like, in addition to the porous material, such as polyurethane form.

In accordance with the third, fourth, and sixth embodiments, the porous materials whose distributional densities are different are used, respectively, as the capillary force generating material, thus making the capillary forces different accordingly. In these embodiments, the fabric materials may be used as the capillary force generating material. When the fabric material is used as the capillary force generating material, it should be good enough if only the gaps which correspond to the fine holes of the porous material are made different in order to differentiate the capillary forces to be generated. As specific methods, there are those which can differentiate the diameters of the fabrics or the densities of the fabrics to be used, and those which combine these methods for use, among some others.

Also, of the embodiments that use plural capillary force generating materials having different capillary forces generated, it is preferable to arrange them in the top to bottom direction in the use state as referred to in the sixth embodiment, because, as described earlier, ink is consumed stably from the above in the chamber that contains the capillary force generating material, and also, the buffer area can be secured. This tendency becomes more conspicuous if the fabric material is used as the capillary force generating material. This is because as compared with the porous material, the resistance of the fabric material is less to the ink flow, and ink is consumed priority from the portion, if any, which is easier for ink to pass no matter how slight it is.

For the communication tube, the description has been made of the tubular type. However, it may be possible to use any type if only a communication tube of such type does not impede the gas-liquid exchanged in the state where the gas-liquid exchange is executable.

Also, in accordance with each of the embodiments described above, the space (the buffer portion) where no capillary force generating material is present is arranged in the vicinity of the end portion opposite to the communication tube. However, it may be possible to eliminate this portion, and fill such space with the capillary force generating material which does not retain liquid in the usual state instead. With the presence of the capillary force generating material that does not retain liquid in the buffer space, it becomes possible to retain ink which shifts to the chamber that contain the capillary force generating material when the environment is caused to change as described earlier.

Also, in accordance with each of the embodiments described above, the air communication groove is arranged on the inner surface of the housing, but such arrangement is not necessarily needed.

However, with the provision of the air introducing groove that serves as a structure to promote the gas-liquid exchange, it becomes easier to form the aforesaid gas-liquid interface. Consequently, there is an advantage that it is possible to implement the more stabilized ink supply. In other words, not only the operation of the liquid supply becomes more stabilized to the outside, such as the recording head, but also, with the formation of the gas-liquid interface, it becomes easier to consider such conditions as to each of the supply states, because there are the first supply state and the second supply state or the like, as described above, which should be taken into account when the capillary force generating material and the ink storage unit are designed.

<The Structure of the Ink Container>

Now, the supplemental description will be made of the structure of the ink container in accordance with each of the embodiments described above.

When the ink container is detachably mountable with respect to the capillary force generating material, the communication unit of the ink container with the chamber that contains the capillary force generating material is provided with the sealing material which serves as the member to prevent the leakage of liquid and air from the communication unit at the time of connection and also, to prevent ink from being led out from the interior of the ink storage unit before connection. In accordance with each of the embodiments described above, a film type member is used for all the sealing materials adopted therefor. However, it may be possible to use a ball type plug or the like. Also, while making the communication tube a hollow needle, it may be possible to use a rubber plug as the sealing material.

Also, the ink container of each embodiment described above is formed by the direct blow method of manufacture. In other words, the housing (the outer wall) and the ink storage unit (the inner wall) which are separable from each other are formed by expanding the cylindrical parison uniformly by means of air blow against the polygonal column. In place of this formation of the housing and the storage unit, it may be possible to generate the negative pressure as ink is led out, while arranging a metal spring or the like in the flexible bag, for example.

However, by the adoption of the blow formation, it is not only easier to produce the ink storage unit whose outer surface shape is equal or analogous to the inner face configuration of the housing, but also, there is an advantage that the negative pressure can be obtained easily by changing the material and the thickness of the inner wall that forms the ink storage unit. Further, by the utilization of thermoplastic resin as the material of the inner wall and the outer wall, it is possible to provide an ink container which is capable of being recycled with ease.

Now, the supplemental description will be made of the structure of the "outer wall" and the resultant structure of the "outer wall" that may affect that of the "inner wall" for each of the embodiments described earlier.

In accordance with each of the embodiments, the ink container is produced by means of the blow formation. As a result, the thickness of the inner wall in the vicinity of the corners is thinner than that of the area near the central portion of the surface that forms the container. Likewise, the thickness of the outer wall in the vicinity of the corners is thinner than that of the area near the central portion of the surface that forms the container. Further, with respect to the outer wall, the inner wall is formed by being laminated on the outer wall whose thickness distribution is gradually reduced toward the corners of each surface from the central portion thereof.

As a result, the inner wall has its outer surface which is in agreement with the inner surface of the outer wall. The outer surface of the inner wall is provided along with the thickness distribution of the outer wall. Therefore, it becomes convex to the ink storage unit side formed by the inner wall. Then, the inner surface of the inner wall has the thickness distribution of the inner wall described above. Therefore, it becomes more convex to the ink storage unit. With these structures, the functions which are described earlier are demonstrated particularly on the portion having the largest area. Therefore, for the present invention, it is good enough if only these convex configurations should be present at least on the largest area. Also, as the inner wall surface, it is good enough to make the convex configuration to be 2 mm or less, and to be 1 mm or less on the outer surface of the inner wall. The convex configuration may be in the dimension which is within the range of measurement errors on the portion having a smaller area. However, this configuration may become one of the factors that bring about the displacement priority on each surface of the ink container which is substantially polygonal column. This is, therefore, one of preferable conditions of the present invention.

Here, in addition, the structure of the outer wall will be described supplementally. As one of the functions of the outer wall, it is described earlier that the outer wall regulates the deformation of the corner portions of the inner wall. As the structure that demonstrates this function, it should be good enough if only the configuration can be maintained against the deformation of the inner wall, and that such configuration is formed to cover the circumference of the corners (that is, provided with a corner surrounding material). Therefore, it may be possible to arrange the structure to cover the outer wall or inner wall with plastic, metal, thick paper, or the like. As the outer wall, it may be possible to form it with surfaces or with the surface structure only on the corners, or with the surface structure which is connected by metallic bars or the like. Further, the outer wall may be formed by meshes.

Figure 35:
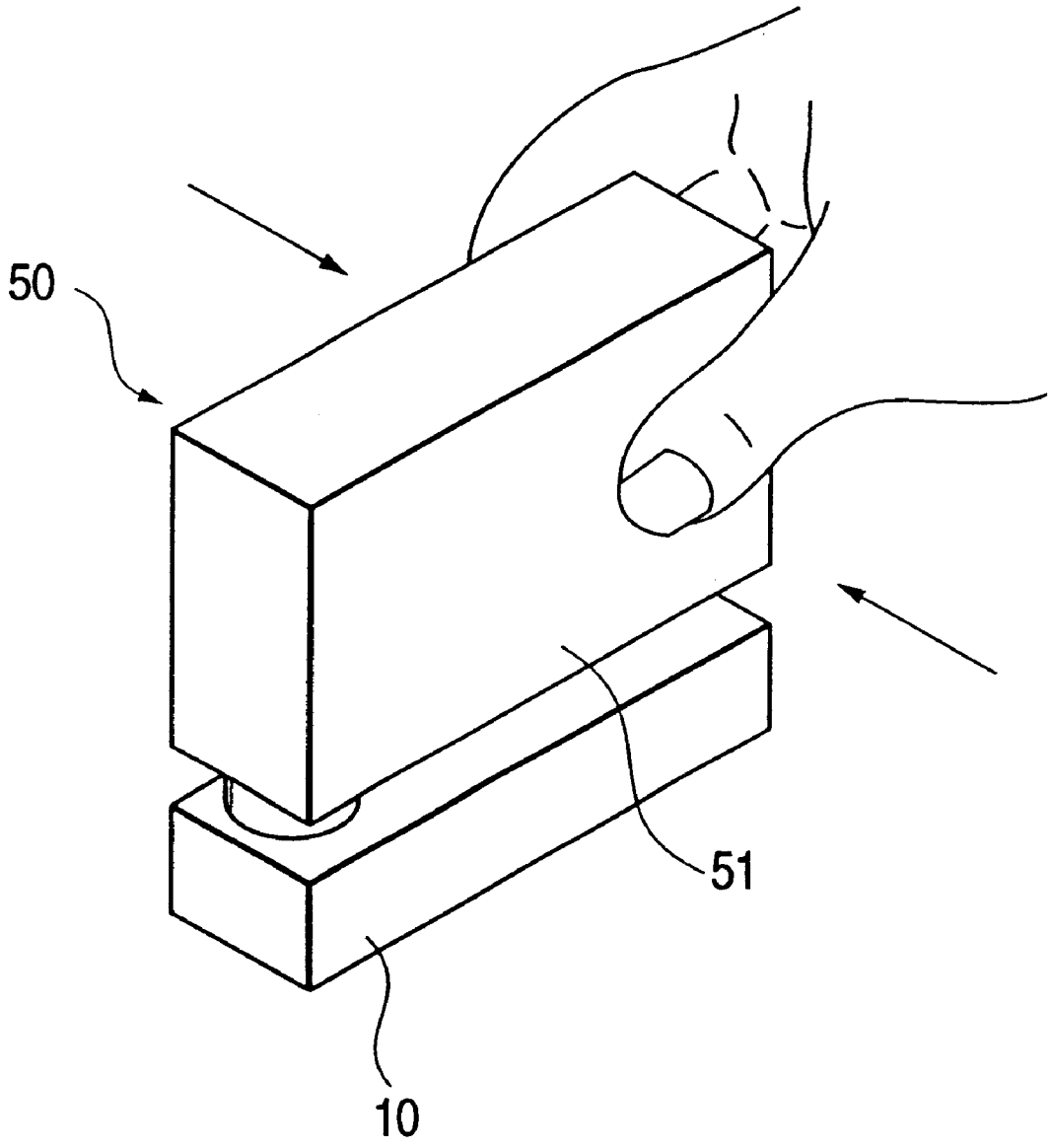
FIG. 35 is a perspective view which schematically shows the ink container and the chamber that contains the capillary force generating material to illustrate one example of the pressure recovery processing method manually operated when ink shortage takes place in the capillary force generating material.

Also, if the ink shortage takes place in the area between the vicinity of the gas-liquid exchange passage of the pressure generating material and the vicinity of the ink supply port by some reason when the exchangeable ink containers are replaced, ink in the ink container 50 is forced to shift to the chamber 10 that contains the capillary force generating material by manually pressing the elastically deformable outer wall 51 temporarily together with the inner wall as shown in FIG. 35, for example. Thus, recovery is executed easily. A pressurized recovery process of the kind is not necessarily executable by hand, but may be executed automatically. To this end, it may be possible to provide the recording apparatus, which will be described later, with pressurized recovery means. Here, if the inner wall is partly exposed, it may be possible to press only such exposed part for the purpose.

Also, in accordance with the embodiments of the present invention, the ink storage unit is formed almost in polygonal column. However, the invention is not necessarily limited to this form. It may be possible to achieve the objectives of the invention by the adoption of any mode if it is at least in a deformable form along with ink to be led out, hence generating negative pressure by the deformation thus made.

Further, in order to obtain the buffer effect by the ink storage unit as described earlier, the ink storage unit should be elastically deformable, and also, the ink storage unit should be able to return to the shape before deformation by the expansion of the contents in it. In other words, it is required that the ink storage unit is able to deform itself within the range of the elastic deformation. If there is any case where the rate of changes of negative pressure along with ink to be led out is to change abruptly (for example, the deformed portions abut upon themselves or the like), it is desirable that the first ink supply state should be completed before such abrupt changes of the state even within the range of the elastic deformation, and then, it is arranged so as to allow the second ink supply state to begin.

Also, as the material to be used for the liquid container of the present invention, it should be good enough to adopt the one with which to made the inner wall and the outer wall separable. It may be possible to structure the inner wall or the outer wall, respectively, in a multiple layer by use of plural materials. Also, it is possible to use a highly elastic material for the inner wall as compared with the case where the ink accomodating chamber is adopted as a single container of negative pressure generating type that contains liquid. In consideration of the influence that may be exerted upon ink or the like to be contained in it, polyethylene resin, polypropylene resin, or the like is suitable usable, for example.

<The Liquid Supply Operation and Ink Supply System>

Now, the supplemental description will be made of the liquid supply operation and ink supply system.

As to the ink supply operation in the ink supply system of each of the embodiments described above, the operation is carried out through the initial state where the ink container and the chamber that contains the capillary force generating material are not connected; the use initiation state at the time of connection; and the first and second ink supply states.

Here, as a first variational example of each of the embodiment described above, it may be possible to consider only the air that has been introduced to the ink storage unit at the time of connection with respect to the restriction on the inner volume of the liquid container, because there is a process in which ink in the ink storage unit is used without introduction of the air outside to the ink storage unit in the gas-liquid exchange condition, that is, the ink supply system which does not need the second ink supply state. In other words, there is an advantage that it is possible to cope with the environmental changes even if the restriction is eased on the inner volume of the ink container. This is the structure whereby to make the objectives of the present invention attainable, but in terms of the usage efficiency of the ink storage unit, it is easier to consume ink in the ink storage unit in the gas-liquid exchange condition that follows the first ink supply state as in each of the embodiments described above.

As a second variational example, there is a case where the consumption speed is extremely great when ink is consumed by the recording head. In this case, ink in the chamber that contains the capillary force generating material is consumed priority until the difference between the negative pressures in this chamber and the ink accomodating chamber becomes greater than a specific value without taking the balance of the negative pressures in them constantly in the first supply state, and then, there may occur the ink shift from the ink accomodating chamber to the chamber that contains the capillary force generating material when the difference in the negative pressures become more than the specific value.

Here, for the ink container having these two chambers integrally formed as one body, the use initiation state is in the stage where it has been completed at the time of use initiation. For each of the supply operations other than this use initiation state, it is possible to apply the effect of each of the embodiments as it is to this variational example so that it may produce the same effect.

<The Structure of the Aperture of the Communication Tube>

Now, the supplemental description will be made of the structure of the communication tube which is the connecting portion between the ink container and the recording head in accordance with each of the embodiments described above.

For each of the embodiments, there is arranged an aperture in the location different from the main aperture for the liquid supply. This aperture is arranged to be essentially in the communicating condition with the unit that generates the capillary force. In this manner, ink adhering to the supply tube is collected into the unit that generates the capillary force, hence preventing it from being solidified. Further, the aperture which is essentially in the connecting state with the unit that generates the capillary force may be connected with the main aperture of the liquid supply.

Here, on the basis of the communication tube of the connecting portion on the recording head side as described above, which is applicable to the supply system other than the liquid supply system of the present invention, the following knowledge is acquired anew.

In other words, for the conventional ink jet cartridge for which the ink container is separable, no consideration has been given to the ink that adheres to the connecting tube installed on the recording head side, although the attention is given to the ink leakage on the ink container side.

Along with the attachment and detachment operation of the ink container, ink that adheres to the connecting tube is caused to adhere to it firmly if it is led intact for a long time. As a result, the effective sectional area of the liquid supply path is reduced for the connecting tube from the ink container, and there is a fear that an unfavorable effect is produced on the ink supply. Particularly when there should be arranged the structure which is needed for the functional separation in the connecting tube (the structure that has the function to introduce the gas into the ink container priority, and the structure that has the function to lead out ink from the ink container priority when the ink container is connected, for example), either one of the structures is clogged by the firmly fixed ink to make the structure no longer functional in the worst case.

Also, when a valve is arranged on the ink container side, there is a fear that the opening and closing of the valve is impeded, because the valve is often arranged to be open by the pressure exerted by the connecting tube.

Further, when the ink container is mounted on the recording head unit, the user feels resistance due to the ink that adheres to the connecting tube, hence making it impossible for him to confirm the completion of the installation. Consequently, there is a fear that the mounting operation becomes incomplete.

The structure of the communication tube that serves as the connecting tube, which has been disclosed in the embodiments described above, makes it possible to solve by itself the technical problems encountered by the new knowledge of the kind. Here, therefore, in conjunction with FIG. 26 and FIG. 27, the description will be made of the examples of the application to another liquid supply system.

Figure 26:
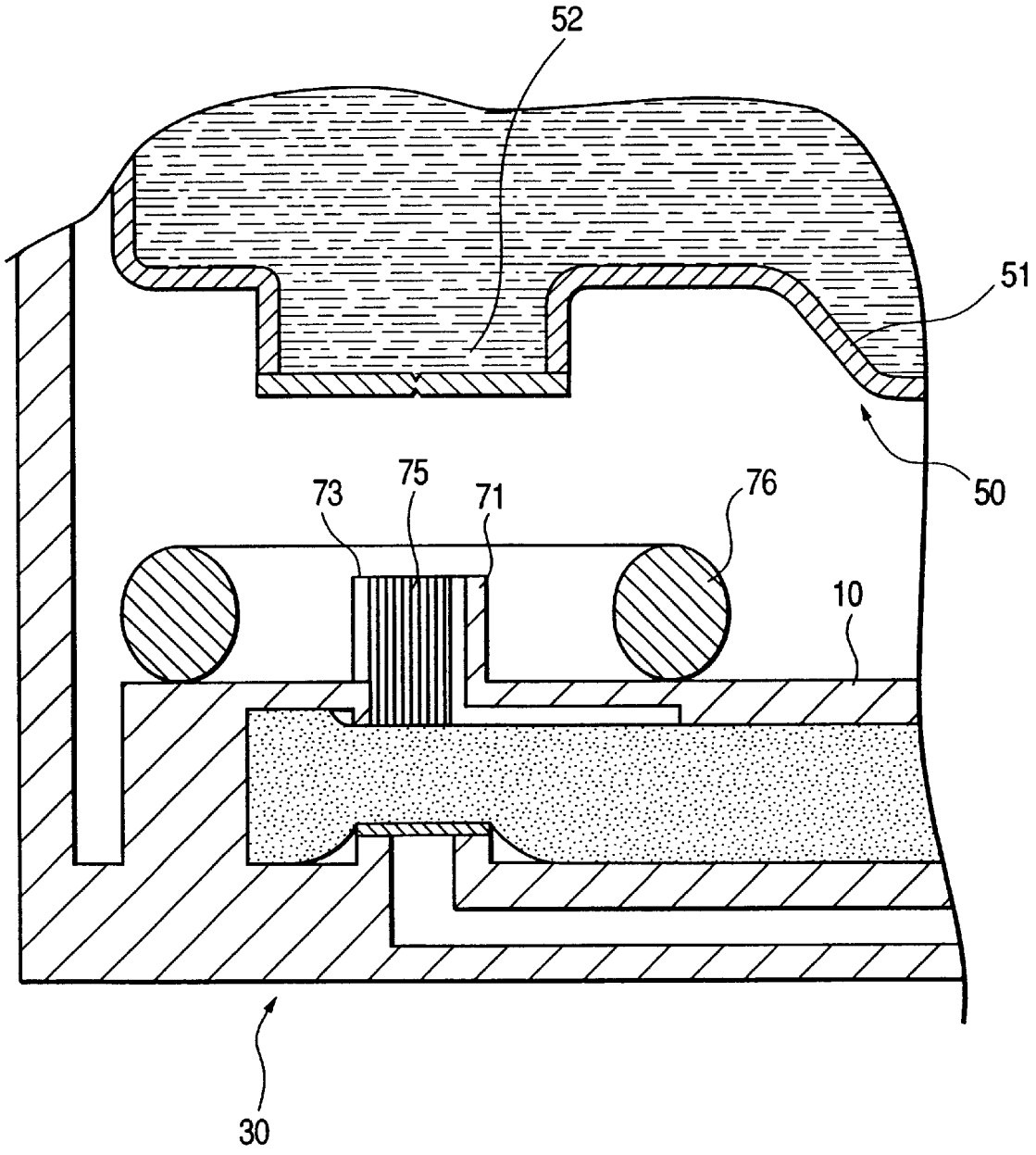
FIG. 26 is a view which shows another application example of the head cartridge provided with the communication tube in accordance with the present invention.

FIG. 26 is a view which shows another application example of the head cartridge provided with the communication tube of the present invention. In accordance with this application example, the ink container 50 is not the double-type container. The one used therefor is formed only by the outer wall 51. Also, on the upper wall of the chamber 10 that contains the capillary force generating material, the O ling 76 is fixed as the closing member that closes the space on the circumference of the communication tube 71 in the state where the ink container 50 is mounted on the holder 30 with head. All the other structures are the same as those of the first embodiment described earlier.

With the structure thus arranged, the ink that adheres to the communication tube 71 along with the attaching and detaching operations of the ink container 50 or the ink that leaks between the communication tube 71 and the O ling 76 along with the insertion of the communication tube 71 into the ink supply unit 52 is absorbed by the ink introducing device 75 through the slit 73 formed on the side end of the communication tube 71 to flow into the communication tube 71. In this way, it becomes possible to suppress the adhesion of ink to the communication tube 71 and the ink hold on the circumference of the communication tube 71.

Figure 27:
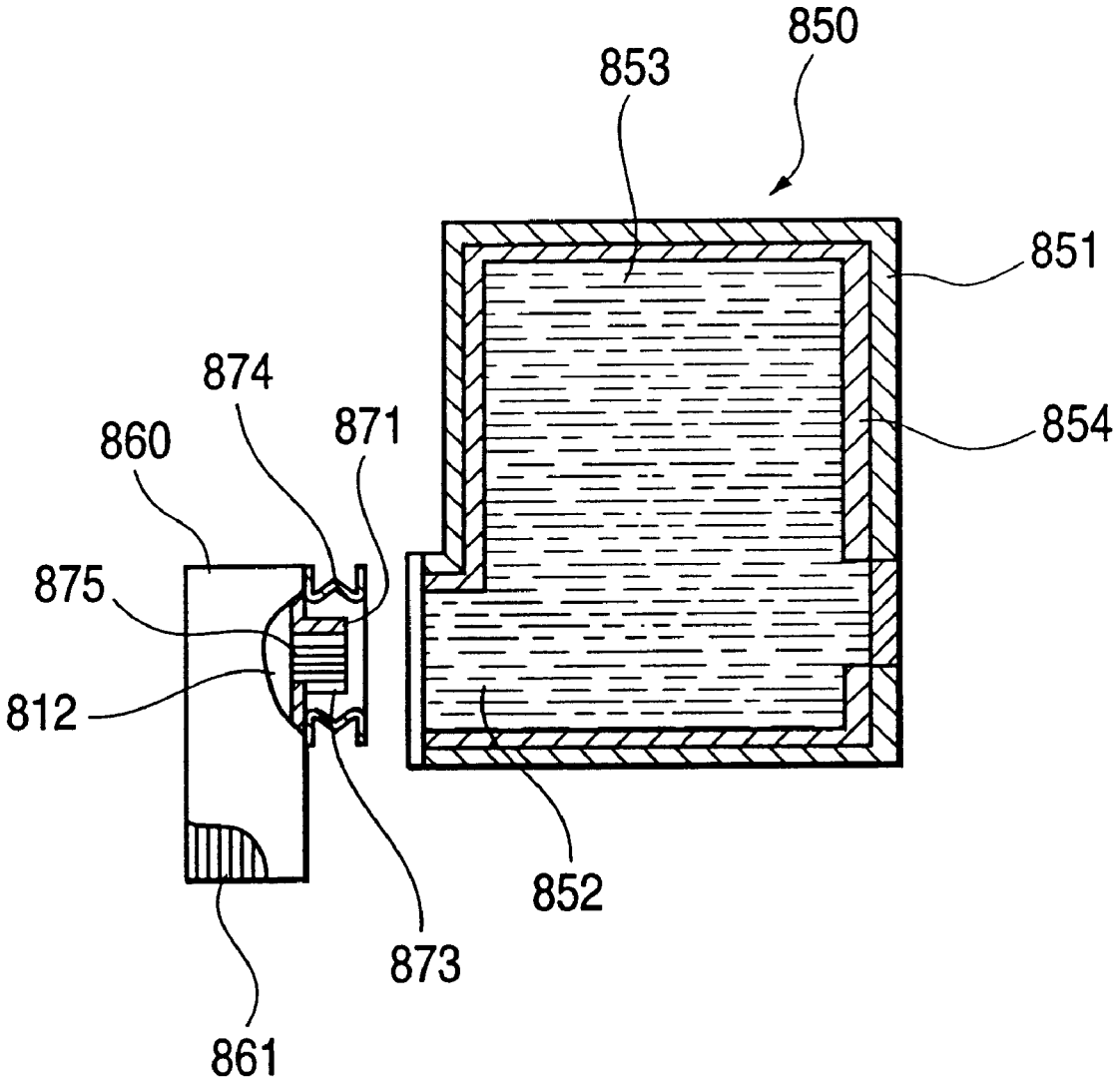
FIG. 27 is a view which shows still another application example of the head cartridge provided with the communication tube in accordance with the present invention.

Also, FIG. 27 is a view which shows another example of the application to the head cartridge provided with the communication tube of the present invention. In accordance with the present application example, the ink container 850 is directly connected with the recording head 860.

The ink container 850 is detachably mounted on the recording head 860, and as in the first embodiment, it is formed by the outer wall 851 and the inner wall 854, and then, comprises the ink storage unit 853 that stores ink in it, and the ink supply unit 852 that leads out ink to the recording head 860. However, in accordance with the present embodiment, the ink supply unit 852 is positioned on the lower end portion of the ink container 850 to open to the side end face of the ink container 850.

On the other hand, the recording head 860 comprises the communication tube 871 which is inserted into the ink supply unit 852 of the ink container 850 in order to introduce ink from the interior of the ink container 850, and the ink supply path 812 for supplying ink introduced through the communication tube 871 to the discharge port 861. The communication tube 871 is arranged to protrude sideward on the lower end portion of the recording head 860, and the recording head 860 and the ink container 850 are connected laterally. In the interior of the communication tube 871, the ink introducing device 875 is inserted so as to form the space on the upper part of the interior of the communication tube 871. On the side face of the communication tube 871, the slit 873 is arranged on the lower end portion thereof in the axial direction of the communication tube 871 and formed from the base of the communication tube 871 to the leading end thereof. Also, the circumference of the communication tube 871 is surrounded by the bellows 874 as in the first embodiment.

With the structure thus arranged, the ink that adheres to the circumference of the communication tube 871 along with the attachment and detachment operations of the ink container 850 is allowed to enter the slit 873 through the side wall of the communication tube 871. Thus, the ink is absorbed into the ink introducing device 875 and supplied to the ink supply path 812. In this manner, the adhesion of ink to the communication tube 871 is suppressed.

Here, in accordance with the first embodiment, the example is shown in which the communication tube and the ink container is connected in the top to bottom direction (vertical direction), but the present invention is not necessarily limited to this direction. As shown in this application example, it is possible to apply the invention to the connection in the lateral direction (horizontal direction). In other words, the connecting direction of the communication tube and the ink container is not particularly confined. However, it is desirable to connect the communication tube and the ink container in the top to bottom direction in order to prevent ink from adhering to the circumference of the communication tube.

<The Structure of the Communication Unit for the Gas Preference Introduction>

Now, the supplemental description will be made of the gas preference introduction structure of the communication unit between the ink container and the recording head unit, which includes the aforesaid communication tube.

For the present invention, all of the ink containers are detachably mountable on the container that contains the capillary force generating material, and the communication unit of the invention may be installed any place if only it has the function described above. Also, the structure may be arranged so that the communication unit is completely separated from the ink container and the container that contains the capillary force generating material.

Figure 28A:
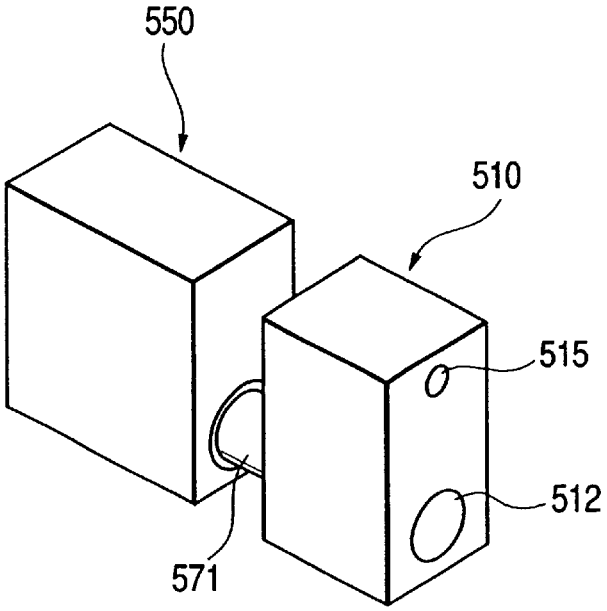
FIGS. 28A and 28B are views which illustrate an application example of the liquid supply system provided with the gas preference introduction path.
Figure 28B:
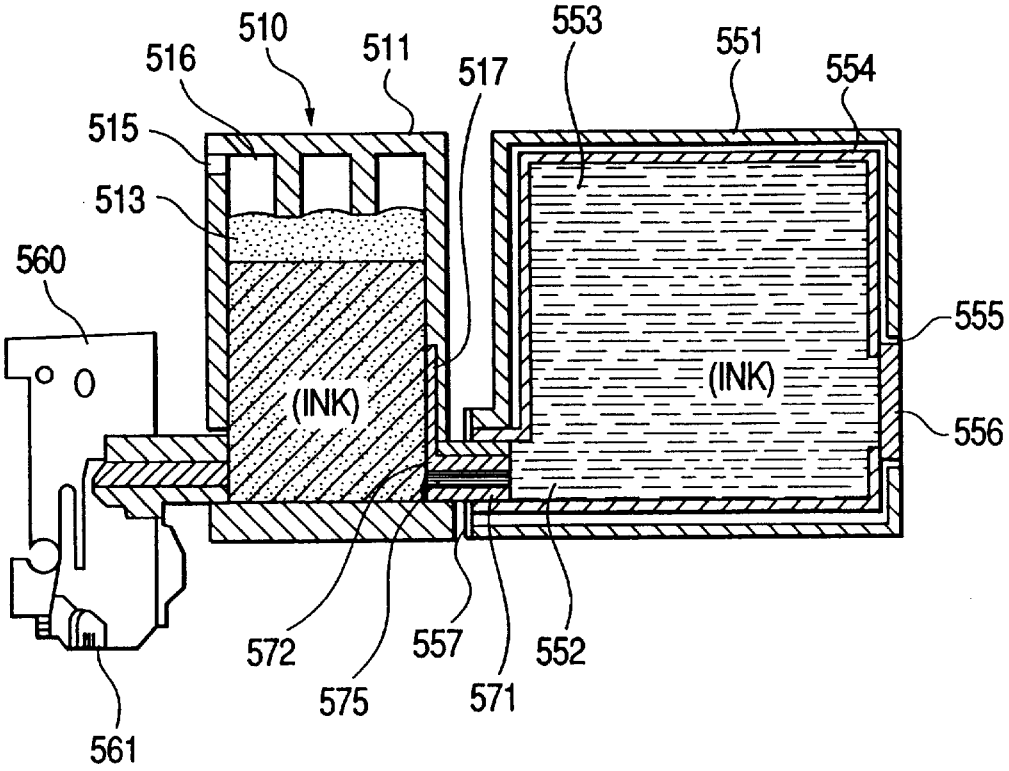

As the example of application as shown in FIGS. 28A and 28B, the system is formed in such a manner that the communication tube 571 is installed in the vicinity of the bottom portion of the chamber 510 that contains the capillary force generating material when it is used, and the bottom end of the ink container 550 is arranged to be substantially equal to the bottom end of the chamber that contains the capillary force generating material, for example. This structure is able to function effectively in such system. In this case, the ink introducing device 575 should desirably be installed on the bottom end side in the communication tube 571 than on the air introducing path 572 side. Also, if the air introducing groove is installed in the chamber 510 that contains the capillary force generating material, it is desirable to connect the air introducing passage 572 and the air introducing groove as the air preference introduction structure.

Figure 29A:
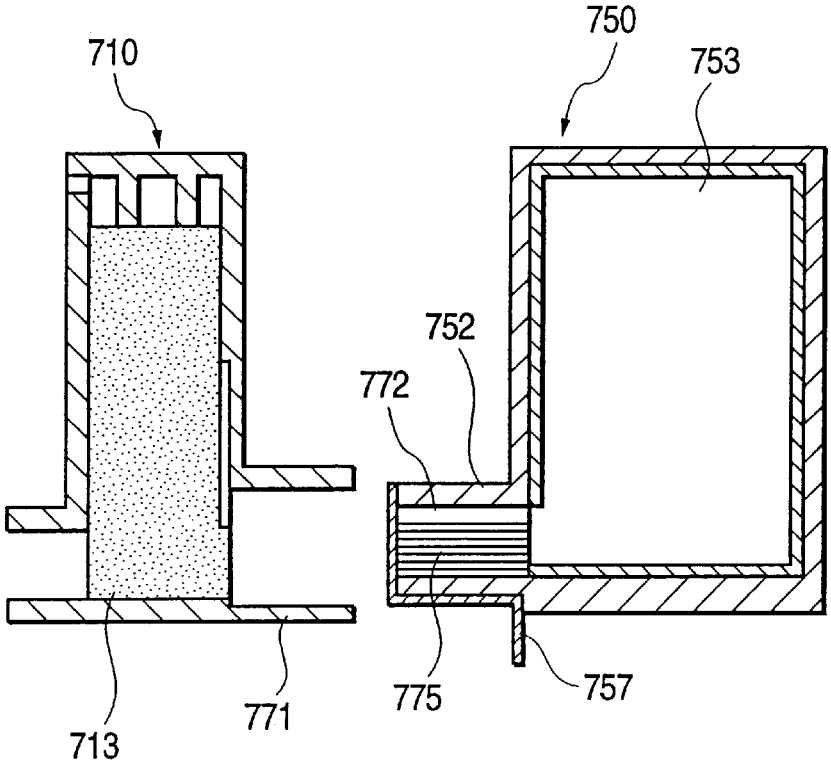
FIGS. 29A and 29B are cross-sectional views which illustrate another application example of the liquid supply system provided with the gas preference introduction path.
Figure 29B:
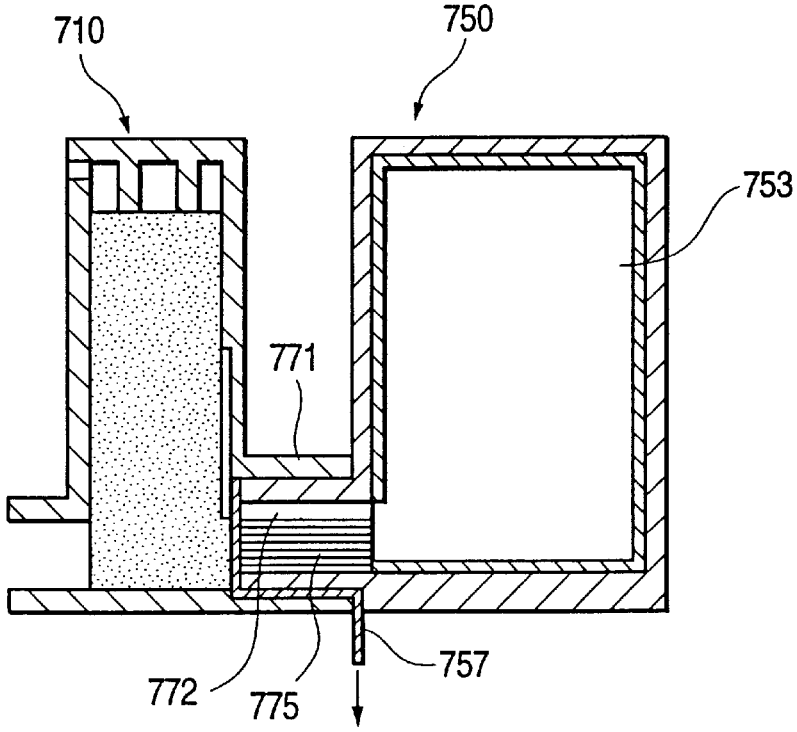

Also, as the application example shown in FIGS. 29A and 29B, it may be possible to install the ink introducing device 775 and the air introducing passage 772 on the ink container 750 side. FIG. 29A shows the state before the chamber that contains the capillary force generating material and the ink container are connected. FIG. 29B shows the state after the connection. Here, the ink supply unit 752 of the ink container 750 is tubular. In the ink supply unit 752, the ink introducing device 775 is inserted. The space above the ink introducing device 775 in the ink supply unit 752 becomes the air introducing path 772. Also, on the leading end surface of the ink supply unit 752, the film type sealing material 757 is adhesively bonded in such a manner so that it can be pulled to be peeled off. On the other hand, the connecting tube 771 of the chamber 710 that contains the capillary force generating material is in the mode that it receives the ink supply unit 752 of the ink container 750. In this respect, the sealing material 757 is in such a size that when the ink supply unit 752 is inserted into the communication tube 771 with the sealing material 757 is bonded as it is as shown in FIG. 29B, the end portion thereof is protruded from the leading end of the connecting tube 771 to be exposed on the outer wall surface of the ink container 757. All the other structures are the same as those of the application example shown in FIGS. 28A and 28B. Also, in FIGS. 29A and 29B, the recording head is omitted for representation.

When the ink container 750 and the chamber 710 that contains the capillary force generating material are connected, the ink supply unit 752 of the ink container 750 is at first inserted into the communication tube 771 of the chamber 710 that contains the capillary force generating material with the bonded sealing material 757 as it is as shown in FIG. 29B. Then, the exposed portion of the sealing material 757 is pinched and pulled. In this way, the sealing material 757 is peeled off from the ink supply unit 752 and pulled out from the communication tube 771. Thus, the sealing material 757 is pulled out from the communication tube 771 after the ink supply unit 752 has been inserted into the communication tube 771. Therefore, in order to make the pulling off of the sealing material 757 easier, it is desirable to bond the sealing material 757 only to the leading end surface of the ink supply unit 752.

As described above, with the sealing material 757 being pulled off, the ink supply unit 752 is released to enable the ink supply unit 752 and the connecting tube 771 to be communicated, hence ink in the ink storage unit 753 of the ink container 750 being supplied to the capillary force generating material 713 in the chamber 710 that contains it.

Here, when the communication unit is separated completely, the structure is arranged so that the ink container, the communication unit, and the container that contains the capillary force generating material may be connected or disconnected when the ink container and the container that contains the capillary force generating material are attached or detached to and from each other. The timing of the connection between the communication unit with the ink container, and with the container that contains the capillary force generating may be substantially the same as the connection between them or may be either one of them is connected earlier. More preferably, the communication unit should be connected with the container that contains the capillary force generating material first, and then, connected with the ink container.

In this case, the method for fixing the communication unit to the ink container and the container that contains the capillary force generating material may be the fitting of the irregular configurations or may be the adhesive bonding by use of fixing material (such as an adhesive agent).

Further, it may be possible to structure the liquid led-out passage and the gas preference introduction passage separately as individual bodies, and to install them on the ink container or the container that contains the capillary force generating material, respectively. In this mode, it is possible to form the communication unit provided with the liquid led-out passage and the gas preference introduction passage. The timing of connection may be substantially the same for the liquid led-out passage and the gas preference introduction passage. However, it is desirable to connect the liquid led-out passage earlier.

With the gas introduction promoting mechanism described above, it becomes possible to provide the liquid supply system, the ink jet cartridge, the head cartridge, and the like, capable of performing the liquid supply operation more reliably and stably when the chamber that contains the capillary force generating material and the liquid storage chamber are made separable.

<The Installation Structure of the Replacement Container>

Now, the supplemental description will be made of the installation structure of the replacement container which is usable for each of the embodiments described above.

For each of the embodiments described above, an installation method which utilizes the rotary installation is used as disclosed in the specification of Japanese Patent Application Laid-Open No. 8-58107 and the like. The installation method disclosed in the aforesaid application is excellent in the simply operable attachment and detachment mechanism without degrading the positioning precision.

On the other hand, the structure is known in which the lock pin and lever are provided on both side faces of the tank holder side (see Japanese Patent Application Laid-Open No. 5-318758). In this structure, the tank having the hooking extrusions on the end portion of both side faces is inserted into the tank holder from above straightly, and fixed when the hooking extrusions are fitted into the hooking holes arrange on both side faces of the tank holder side. The ink container is released by operating the levers on both side faces of the tank holder to push out the hooking extrusions from the hooking holes by means of the lock pins.

Now, in order to speed up the liquid supply to the ink container, a plurality of liquid supply ports are arranged for one liquid accomodating portion in the ink container in some cases. When an ink container of the kind is installed, it is desirable to connect the plural liquid supply ports with the corresponding liquid supply tubes of the recording head at a time. Particularly, if the liquid accomodating portion of the ink container is closed system, and unsealed at the time of installation on the recording head, it is required to unseal them substantially at a time from the viewpoint of keeping the balance of the liquid supply.

For the simultaneous installation of the kind, it is desirable to insert the ink container from above straightly, because the installation is possible at a time without depending on the positions of the liquid supply unit.

However, there is a problem that the user finds it extremely difficult to install the ink container by the application of the structure disclosed in the aforesaid Japanese Patent Application Laid-Open No. 5-318758, because there is almost no "play" between the ink container and the tank holder in order to secure the positional accuracy between the ink supply port of the ink container and the ink inlet port of the tank holder.

Also, since the lock pins and levers, which are movable members, are fixed on the tank holder which is a component used for a long time, there is a possibility that these movable members are subjected to the breakage when the ink container is detachably mounted repeatedly.

Also, in the case of the ink container described above, the elastically hooking members on both side walls of the ink container extend downward from the middle point of the side walls. Also, the elastically hooking members are extended vertically downward. With the structure thus formed, there is a fear that the liquid supply tube is broken due to the collision between the supply tube of the ink jet head and the ink container if the liquid supply tube protrudes to be coupled with the ink container.

Under such circumstances, the inventors hereof have made studies ardently on the container provided with a plurality of supply ports for one ink container as a variation of the liquid supply system of the present invention which is particularly excellent in the higher recordability. As a result, the inventors hereof have acquired a new knowledge that the insertion is performed after the provisional positioning has been performed for the installation of one ink container having a plurality of supply ports to the tank holder appropriately with ease. Hereunder, therefore, such structure will be described in conjunction with the accompanying drawings.

Figure 30A:
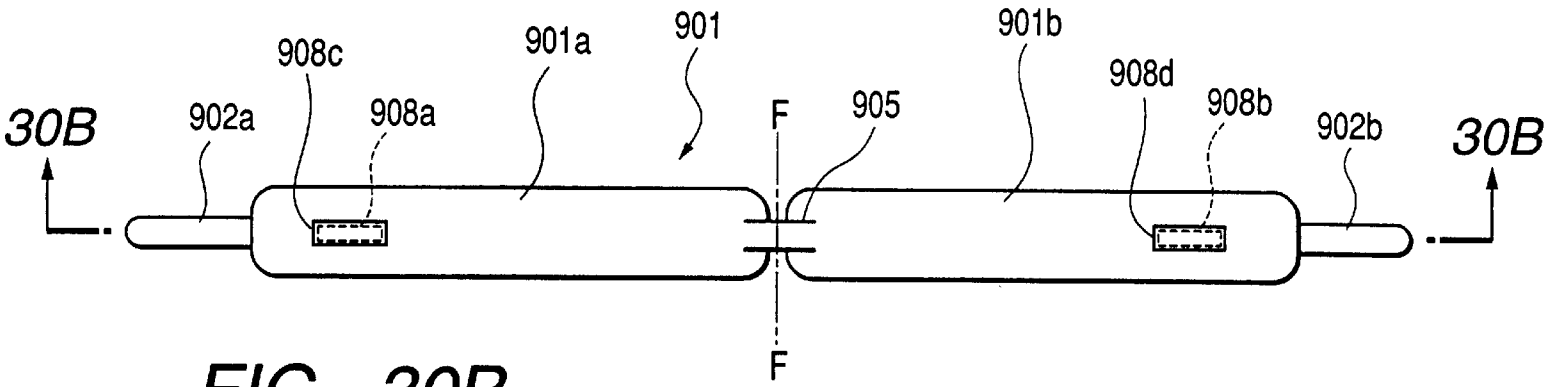
FIGS. 30A, 30B, 30C and 30D are views which illustrate another application example of the ink container provided with the installation mechanism in accordance with the present invention.
Figure 30B:
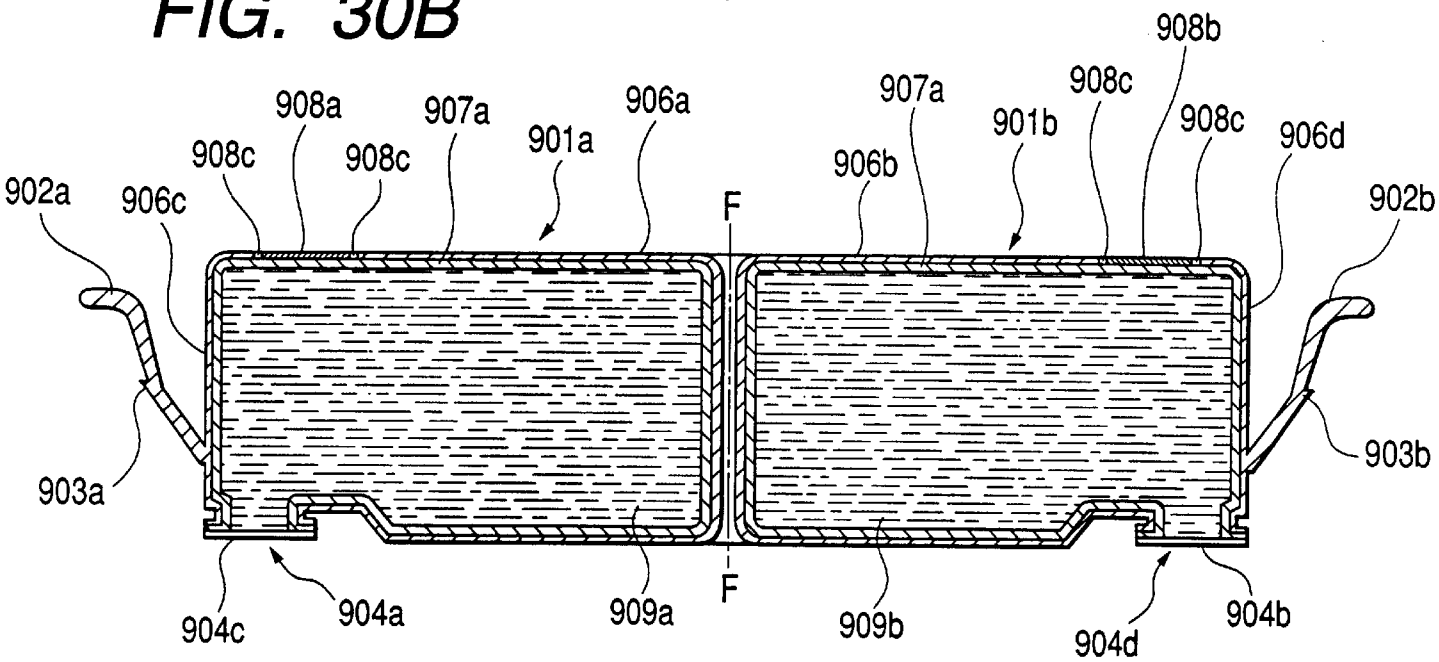
Figure 30C:
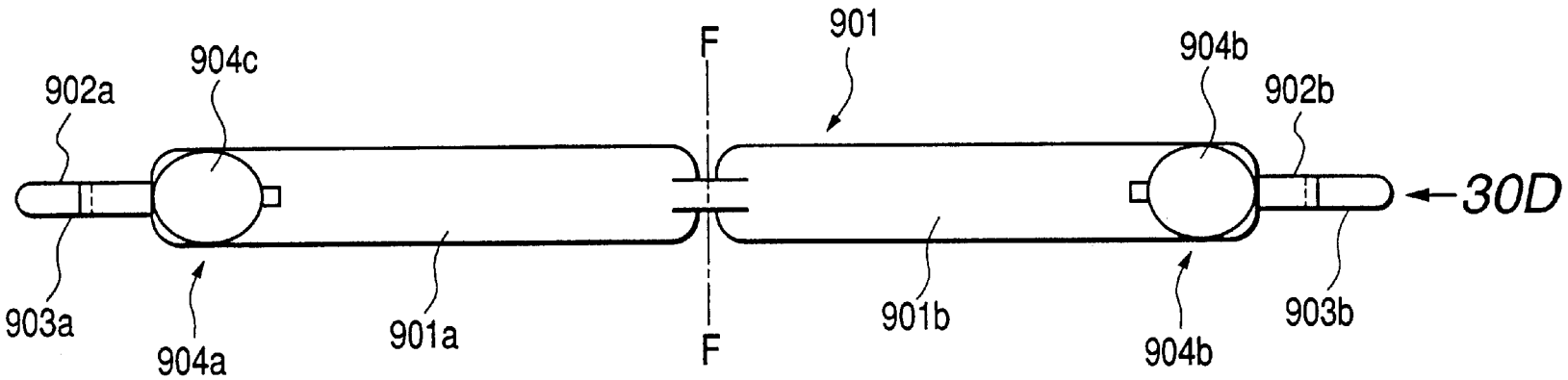
Figure 30D:
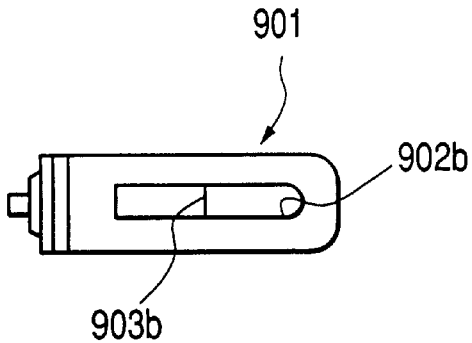

FIG. 30A is a plan view which shows an ink container 901. FIG. 30B is across-sectional view taken along line 30B—30B in FIG. 30A. FIG. 30C is a bottom view. FIG. 30D is a view which is observed in the direction indicated by an arrow C in FIG. 30C.

The ink container 901 that serves as a liquid container is formed by the tank units 901*a* and 901*b* integrally arranged by being symmetrically connected at the line F—F axially by means of the connecting unit 905, which comprises the ink storage units 909*a* and 909*b* that contain ink in them, and the ink supply units 904*a* and 904*b* that lead out liquid in the ink storage units 909*a* and 909*b* to the chambers 924*a* and 924*b* that contain the capillary force generating material, respectively, and which is installed detachably mounted on the holder 910 with head to be described later. The tank units 901*a* and 901*b* are formed by the outer walls 906*a* and 906*b* which constitute the chamber (housing), and the inner walls 907*a* and 907*b* each having the inner surface equal or analogous to the inner surface of each of the outer walls 906*a* and 906*b*.

The ink supply units 904*a* and 904*b* are positioned in the vicinity of both the left and right end portions on the lower face of the tank units 901*a* and 901*b*, respectively. On the side wall faces 906*c* and 906*d* of the outer walls 906*a* and 906*b*, the latch levers 902*a* and 902*b* are elastically arranged with the latch nails 903*a* and 903*b* as the first and second hooking portions. Before the ink container 901 is installed on the holder 910 with head, the ink supply units 904*a* and 904*b* are sealed by the sealing materials 904*c* and 904*d* so that the ink storage units 909*a* and 909*b* are closed from the air outside.

The inner walls 907*a* and 907*b* are flexible, respectively. The ink storage units 909*a* and 909*b* are deformable along with ink to be led out from the interior thereof, respectively. Also, the inner walls 907*a* and 907*b* are provided with the fused portions (pinch off portions) 908. With the fused portions 908*a* and 908*b*, the inner walls 907*a* and 907*b* are supported in the form of being coupled with the outer walls 906*a* and 906*b*. Also, the outer walls 906*a* and 906*b* are provided with the air communication ports 908*c*, respectively, hence making it possible to introduce the air outside between the inner walls 907*a* and 907*b*, and the outer walls 906*a* and 906*b*.

Figure 31:
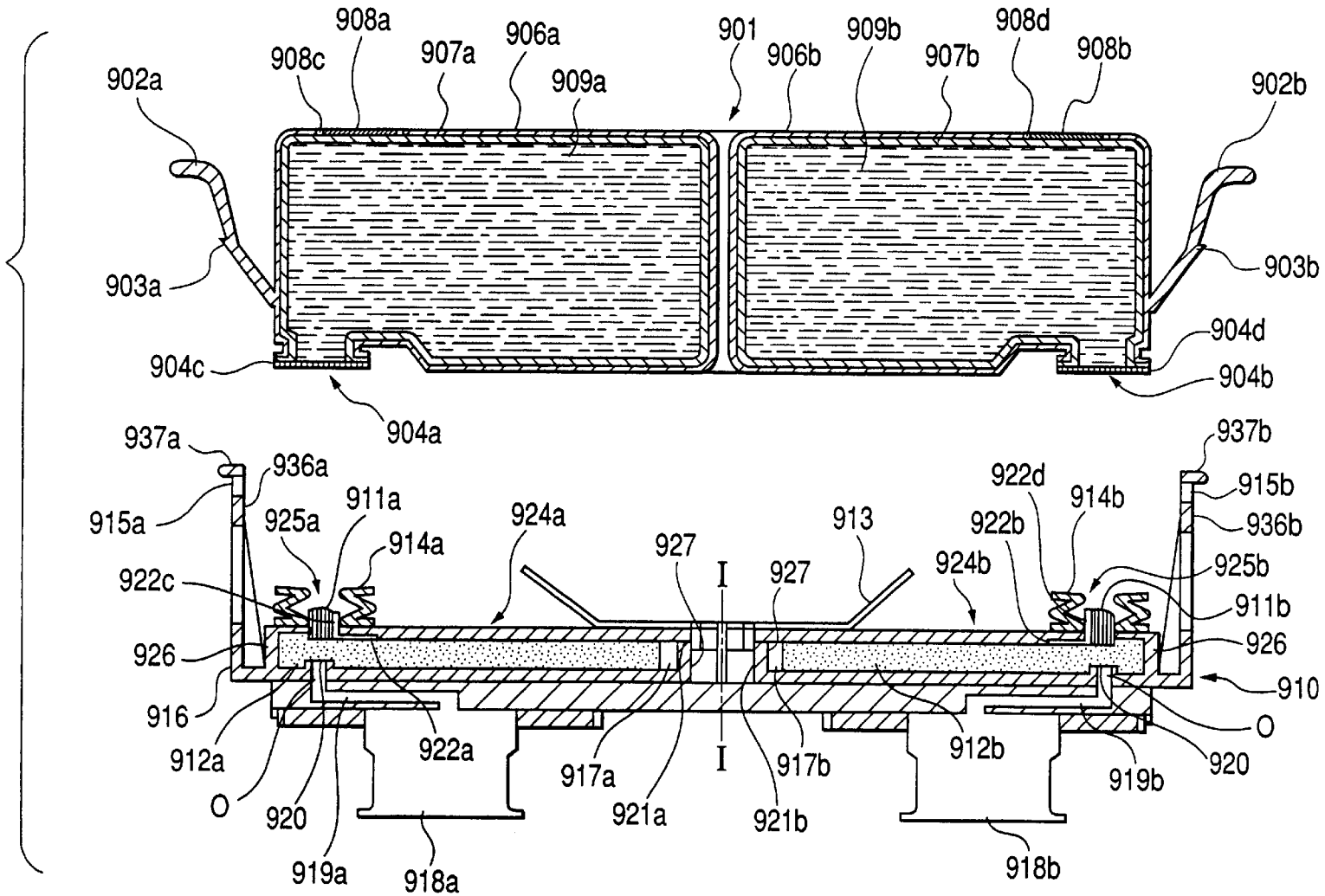
FIG. 31 is a view which illustrates the head holder on which the ink container shown in FIGS. 30A to 30D is detachably mountable.

Now, FIG. 31 is a cross-sectional view which shows the holder 910 with head, and the ink container 901 in the state before it is mounted on the holder 910 with head.

The head holder 910 is structured to be axially symmetrical at line I—I as in the ink container 901. The holder 901 with head comprises the tank holder 916 that holds the ink container 901; the chambers 924*a* and 924*b* that contain two capillary force generating materials installed on the bottom end of the tank holder 916, each of which is axially symmetrical at the line I—I; and the recording heads 918*a* and 918*b* that discharge ink (including liquid such as processing liquid) to record on a recording medium. These are integrated to form the structure. Also, with the line I—I as the center, there is provided on the outer side of the upper wall surface of the chambers 924*a* and 924*b* that contain two capillary force generating materials, the pop-up spring 913 which is flat spring to aid the removal of the ink container 901 from the tank holder 916, which will be described later.

On the side walls 936*a* and 936*b* of both sides of the hank holder 916, the hooking holes 915*a* and 915*b* are formed to engage with the latch nails 903*a* and 903*b* of the ink container 901.

The chambers that contain the capillary force generating material 924*a* and 924*b* contain the capillary force generating materials 912*a* and 912*b* formed by the porous material, such as polyurethane form, or formed by the fabric material, such polyethylene or polypropylene. On the upper wall of the chambers that contain capillary force generating material 924*a* and 924*b*, there are arranged the communication tubes 925*a* and 924*b* which are connected with the ink supply units 904*a* and 904*b* of the ink container 901 and are communicated with the ink storage units 909*a* and 909*b*. On the lower wall, the ink supply paths 919*a* and 919*b* are open as the liquid supply units to supply ink to the recording heads 918*a* and 918*b*. The openings of the ink supply paths 919*a* and 919*b* are positioned below the communication tubes 925*a* and 925*b*. In other words, the openings of the communication tubes 925*a* and 925*b*, and those of the ink supply paths 919*a* and 919*b* are all arranged on the side wall faces 926*a* and 926*b* side of the chambers 924*a* and 924*b* that contain the capillary force generating material. In this respect, the filter 920 is arranged for each of the openings of the ink supply paths 919*a* and 919*b* to prevent foreign particles from entering the recording heads 918*a* and 918*b*.

The chambers 924*a* and 924*b* that contain the capillary force generating material are further provided with the air introducing grooves 922*a* and 922*b*, and the air communication ports 921*a* and 921*b*. The air introducing grooves 922*a* and 922*b* are to promote the gas-liquid exchange which will be described later, and formed on the inner side of the upper wall faces in the vicinity of the communication tubes 925*a* and 925*b* toward the air communication ports 921*a* and 921*b* from the connection side with the connecting tubes 925*a* and 925*b* of the chambers 924*a* and 925*b* that contain the capillary force generating material, and then, communicated with the interior of each of the communication tubes 925*a* and 925*b*. The air communication ports 921*a* and 921*b* are arranged to enable the capillary force generating materials 912*a* and 912*b* to be communicated with the air outside, and formed on the central side walls 927 of the chambers 924*a* and 924*b* that contain the capillary force generating material. The vicinity of each of the air communication ports 921*a* and 921*b* of the chambers 924*a* and 924*b* that contain the capillary force generating material become the buffer units 917*a* and 917*b* where no capillary force generating materials 912*a* and 912*b* are present. In accordance with the present embodiment, the communication tubes 925*a* and 925*b* abut upon the capillary force generating materials 912*a* and 912*b*. At the same time, each of the end portions of these tubes is connected with the air introducing grooves 922*a* and 922*b* to make it possible to implement the liquid supply operation smoothly, which will be described later.

In this respect, the regions of the capillary force generating materials 912*a* and 912*b* that retain ink are indicated by the slanted lines in each of the cross-sectional views in FIGS. 30A to 30D and FIG. 31 to FIG. 34. Also, ink stored in the ink storage units 909*a* and 909*b* are indicated by meshed lines.

Also, since FIGS. 30A to 30D are schematic views, the outer walls 906*a* and 906*b* and the inner walls 907*a* and 907*b* of the ink container 901 are represented as if in contact with each other. Practically, however, it should be good enough if these walls are in the separable state or the structure may be arranged so that the inner walls 907*a* and 907*b* and the outer walls 906*a* and 906*b* are in contact but with a slight space between them. However, before the ink container 901 is mounted on the holder 910 with head, that is, before the ink container 901 is used, the inner walls 907*a* and 907*b* should be formed to follow the contour of the inner surface of each of the outer walls 906*a* and 906*b* so that at least the corners of the inner walls 907*a* and 907*b* are positioned to agree with the corners of the outer walls 906*a* and 906*b* (hereinafter referred to as the corner portion including the case where top portion presents the finely curved surface)(this state is termed the "initial state").

At this juncture, as to the interior of the ink storage units 909*a* and 909*b*, ink is stored in an amount slightly smaller than the storable amount each in the ink storage units 909*a* and 909*b* in order to make the ink supply units 904*a* and 904*b* slightly negative when the sealing materials 904*c* and 904*d* are unsealed. In this way, it becomes possible to reliably prevent ink from leaking outside due to the external force, the temperature changes, and the changes of the atmospheric pressure when the sealing materials 904*c* and 904*d* are unsealed.

Also, from the viewpoint of dealing with the environmental changes, it is desirable to make the amount of air to be retained in each ink storage 909*a* and 909*b* extremely small before connection. In order to reduce the amount of air in the ink storage units 909*a* and 909*b*, the liquid injection method may be used, such as disclosed in the specification of Japanese Patent Application Laid-Open No. 9-200126.

On the other hand, the capillary force generating materials 912*a* and 912*b* in the chambers 924*a* and 924*b* that contain them are allowed to retain ink on the part thereof, respectively.

Here, the amount of ink contained in each of the capillary force generating materials 912*a* and 912*b* may be varied slightly, because it depends on the amount of ink stored in the capillary force generating materials 912*a* and 912*b* when the ink containers 901 are replaced as described later. Also, as to the air introducing grooves 922*a* and 922*b* and the communication tubes 925*a* and 925*b*, liquid is not necessarily filed in them. As shown in FIG. 31, it may be possible to contain the air.

Figure 32:
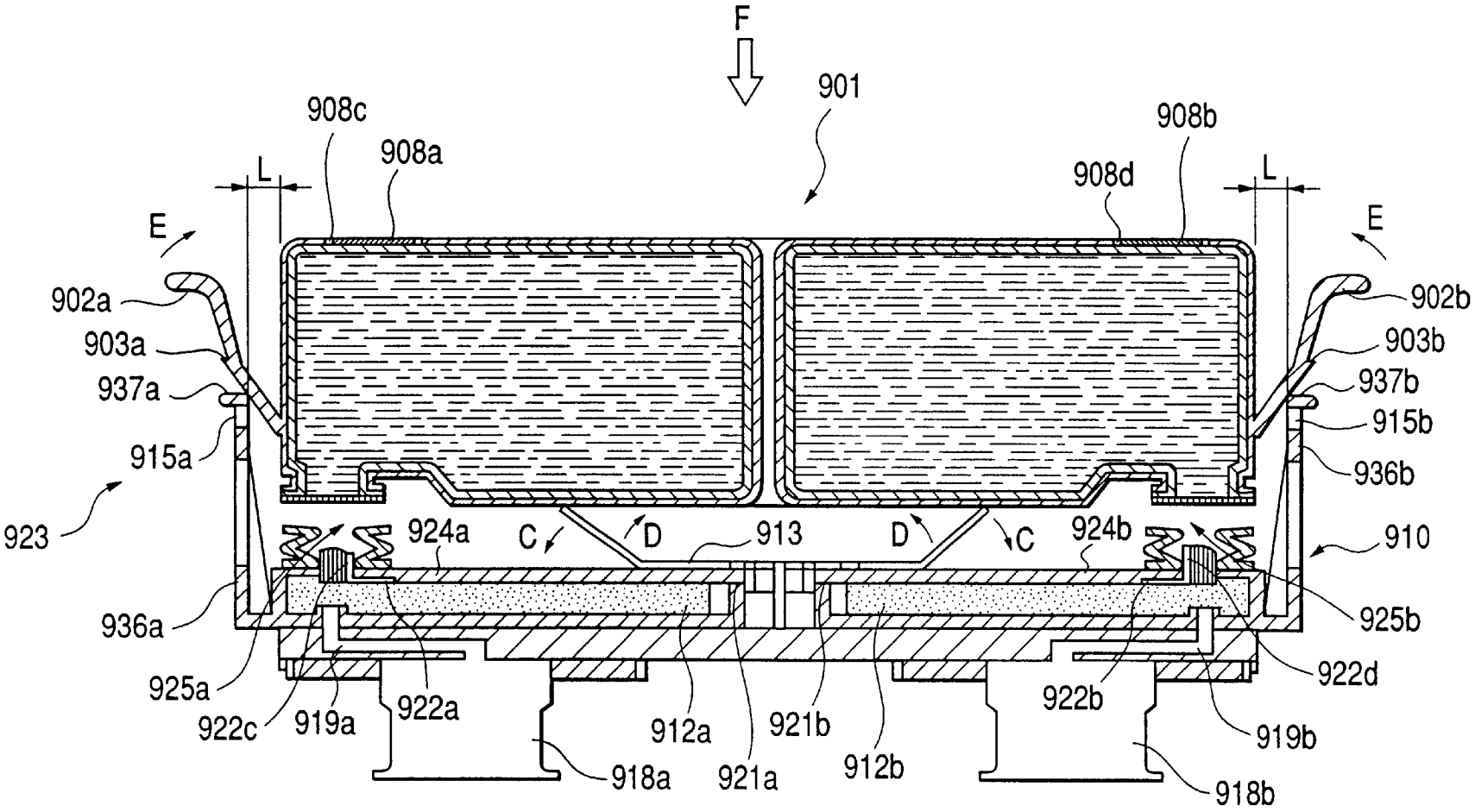
FIG. 32 is a view which illustrates the operation to mount the ink container shown in FIGS. 30A to 30D on the head holder shown in FIG. 31.

Now, in conjunction with FIG. 32, the description will be made of the operation to mount the ink container 901 on the holder 910 with head.

At first, the lower face of the ink container 901 where the ink supply units 904*a* and 904*b* are arranged is depressed toward the opening of the tank holder 916 that forms the holder 910 with head (the direction indicated by an arrow F). At this juncture, the latch levers 902*a* and 902*b* on the left and right sides of the ink container 901 are abut upon the side wall corners 937*a* and 937*b* of the side walls 936*a* and 936*b* on the left and right sides of the tank holder 916, respectively. Then, the ink container 901 is held horizontally, and the ink supply units 904*a* and 904*b* are positioned right above the communication tubes 925*a* and 925*b*.

Also, the latch levers 902*a* and 902*b* on the left and right sides are elastic in the direction toward the side wall of the ink container. Therefore, in this state, one cushion is made available. As a result, even if the user presses the ink container 901 with an excessive force to mount it on the tank holder 916, it is possible to prevent the communication tubes 925*a* and 925*b* from being damaged by means of this elasticity when the ink container 901 collides with the communication tubes 925*a* and 925*b*.

When the ink container 901 is further pressed from this state in the direction indicated by an arrow F, the latch levers 902*a* and 902*b* are bent in the direction indicated by an arrow E. Also, the lower face of the ink container 901 depresses the pop-up spring 913 to bend it in the direction indicated by an arrow C. The ink container 901 receives the reaction force almost evenly from the side wall corners 937*a* and 937*b* on the left and right sides when the latch levers 902*a* and 902*b* are bent uniformly, hence being inserted into the tank holder 916 by the operation which is almost straight. This inserting operation continues until the latch nails 903*a* and 903*b* of the latch levers 902*a* and 902*b* engage with the hooking holders 915*a* and 915*b* of the tank holder 916, thus the ink container 901 being held by the tank holder 916. With the straightly mounting operation, the left and right sealing materials 904*c* and 904*d* are pierced by the ink introducing devices 911*a* and 911*b* almost at a time. Then, the ink supply units 904*a* and 904*b* of the ink storage units 909*a* and 909*b* are connected with the chambers 924*a* and 924*b* that contain the capillary force generating material both on the left and right sides simultaneously.

In this respect, the pop-up spring 913 abuts upon the lower face of the ink container 901 in the state where the latch levers 902*a* and 902*b* abut upon the side wall corners 937*a* and 937*b* of the side walls 936*a* and 936*b* on the left and right sides of the tank holder 916, respectively. As a result, the ink container is provided with a function to aid the ink container 901 to be held horizontally.

With the arrangement thus made, it becomes possible to operate the mounting almost straightly even if the clearance L is not sufficiently small when the ink container 901 is inserted into the tank holder 916. Also, the latch levers 902*a* and 902*b*, which should receive the repeated bending stresses due to the bending at the time of mounting, are arranged on ink container 901 side, which is the expendables. Therefore, the durability of the holder 910 with head does not present any problems even when the attachment and detachment of the ink container 901 are repeated. Also, with the structure arranged as above, and the straight mounting operation, the left and right ink supply units 904*a* and 904*b* and the ink introducing devices 911*a* and 911*b* are connected almost at a time, while any unreasonable force is not given to the communication tubes 925*a* and 925*b*.

Therefore, the communication tubes 925*a* and 925*b* are prevented from any possible damages.

Figure 33:
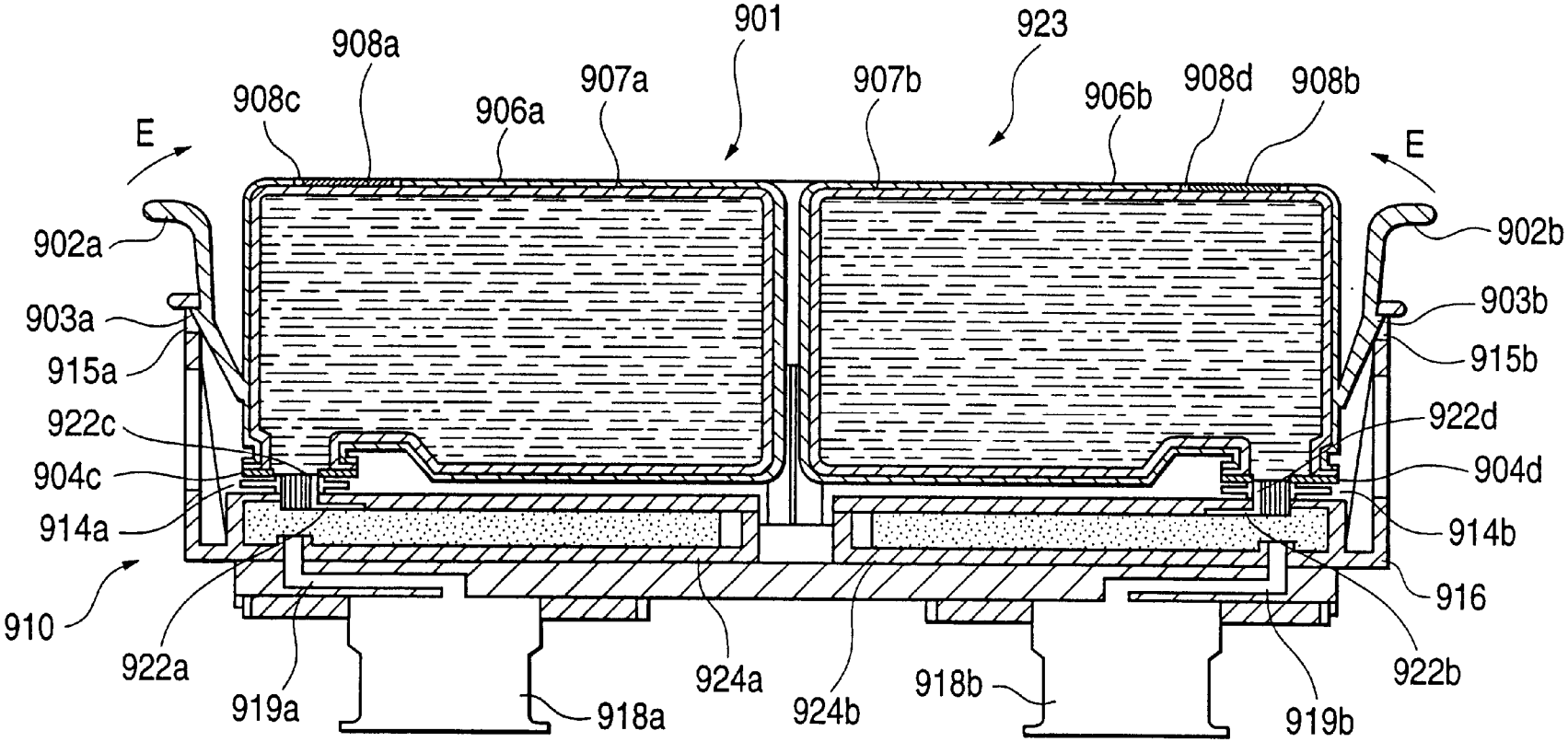
FIG. 33 is a view which illustrates the state where the ink container shown in FIGS. 30A to 30D is mounted on the head holder sown in FIG. 31.

Now, FIG. 33 is a cross-sectional view which shows the ink jet cartridge 923.

Here, the ink jet cartridge 923 is in the state where the ink container 901 is mounted on the holder 910 with head.

As described above, when the latch nails 903*a* and 903*b* of the latch levers 902*a* and 902*b* engage with the hooking holes 915*a* and 915*b* of the tank holder 916, the ink container 901 is mounted on the holder 910 with head.

In this state, the communication tubes 925*a* and 925*b* of the chamber 924*a* and 924*b* that contain the capillary force generating material break through the sealing materials 904*c* and 904*d* to be inserted into the ink supply units 904*a* and 904*b*, hence enabling the ink storage units 909*a* and 909*b* of the ink container 901 to be communicated with the chambers 924*a* and 924*b* that contain the capillary force generating material. At this juncture, the bellows 914*a* and 914*b*, which serve as the closing member, are in contact with the sealing materials 904*c* and 904*d* in advance to close the circumference of the communication tubes 925*a* and 925*b*. Then, the bellows 914*a* and 914*b* are being compressed along with the insertion of the ink container 901 to enable the communication tubes 925*a* and 925*b* to unseal the sealing materials 904*c* and 904*d*. Therefore, ink is not allowed to flow out from the bellows 914*a* and 914*b* externally when the sealing materials 904*c* and 904*d* are unsealed.

Also, to remove the ink container 901 from the tank holder 916, the latch levers 902*a* and 902*b* are bent in the direction indicated by an arrow E until the latch nails 903*a* and 903*b* are disengaged from the hooking holders 915*a* and 915*b*. In accordance with the present embodiment, the latch levers 902*a* and 902*b* are supported on the lower part of the side wall faces 906*c* and 906*d* of the bottom end of the ink container 901, and each of them is slanted or bent upward on the outer sides. Also, between the end portion (operational portion) of each latch levers 902*a* and 902*b* and each fulcrum of the latch levers 902*a* and 902*b*, the latch nails 903*a* and 903*b* are present, respectively. When removing the ink container 901 from the tank holder 916, the end portions (operational portions) of the latch levers 902*a* and 902*b* are bent to the ink container 901 side. Then, the latch nails 903*a* and 903*b* are disengaged from the hooking holes 915*a* and 915*b*, and then, by the elastic force of the latch levers 902*a* and 902*b*, the ink container 901 is raised along the inclination or bend of the latch levers 902*a* and 902*b*. In this manner, a part of the ink container 901 is protruded from the tank holder 916 to make it easier to withdraw the ink container 901.

Further, in accordance with the present embodiment, the pop-up spring 913 is arranged on the bottom of the tank holder 916. Then, when the warped pop-up spring 913 is released, the ink container 901 is pushed up straightly to facilitate the removal of the ink container 901 sill more.

As described above, it is possible to utilize the aforesaid installation structure preferably for the liquid supply system of the present invention. However, this structure may be applicable to the mode other than the liquid supply system of the present invention.

Figure 34:
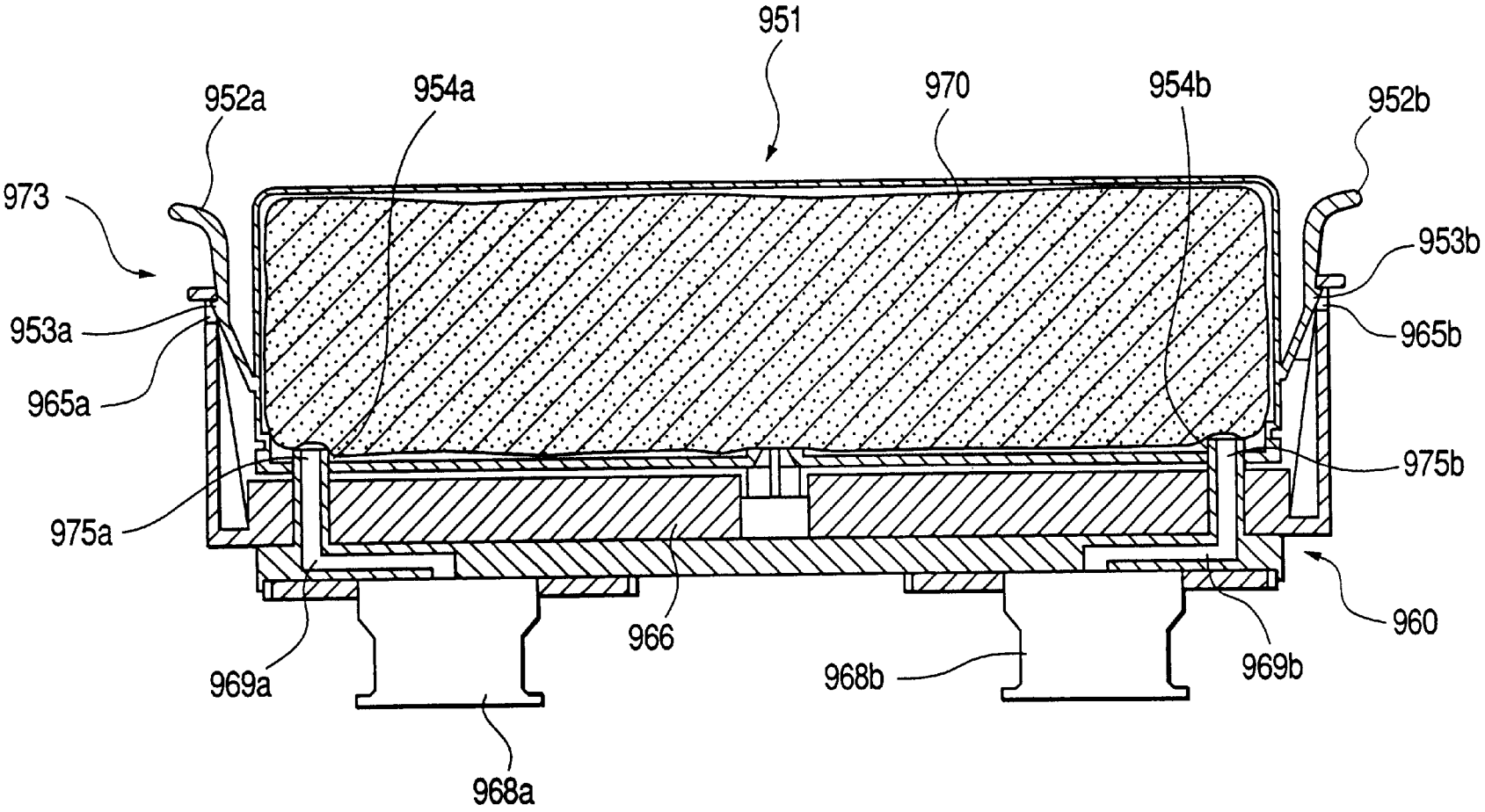
FIG. 34 is a view which shows still another application example of the ink container provide with the installation mechanism in accordance with the present invention.

FIG. 34 is a view which illustrates the application example of the installation structure in accordance with the present invention.

The ink storage mode and the structure of the ink container 951 in accordance with this application example are different in that ink is absorbed in the ink absorbent 970, and that the chamber that retains ink is structured with a single chamber. In accordance with this application example, there are no chambers and capillary force generating materials that correspond to those 912*a* and 912*b*, and 924*a* and 924*b*, which is the difference from the holder 910 with head represented in FIG. 31. Also, whereas the ink supply paths 919*a* and 919*b* and the communication tubes 925*a* and 925*b* are arranged through the capillary force generating materials 912*a* and 912*b*, the ink supply paths 969*a* and 969*b* and the communication tubes 975*a* and 975*b* are arranged integrally. Also, in order to prevent the ink leakage from the gap between the ink supply unit 954 and the communication tubes 975*a* and 975*b*, the sealing material (not shown) is provided instead of the bellows 914*a* and 914*b* described earlier.

The method for mounting the ink container 951 on the holder 960 with head is the same as the previous example. The installation is made by the engagement of the latch nails 953*a* and 953*b* of the latch levers 952*a* and 952*b* provided for the ink container 951 with the hooking holes 965*a* and 965*b* of the tank holder 966.

<The Liquid Jet Recording Apparatus>

Figure 36A:
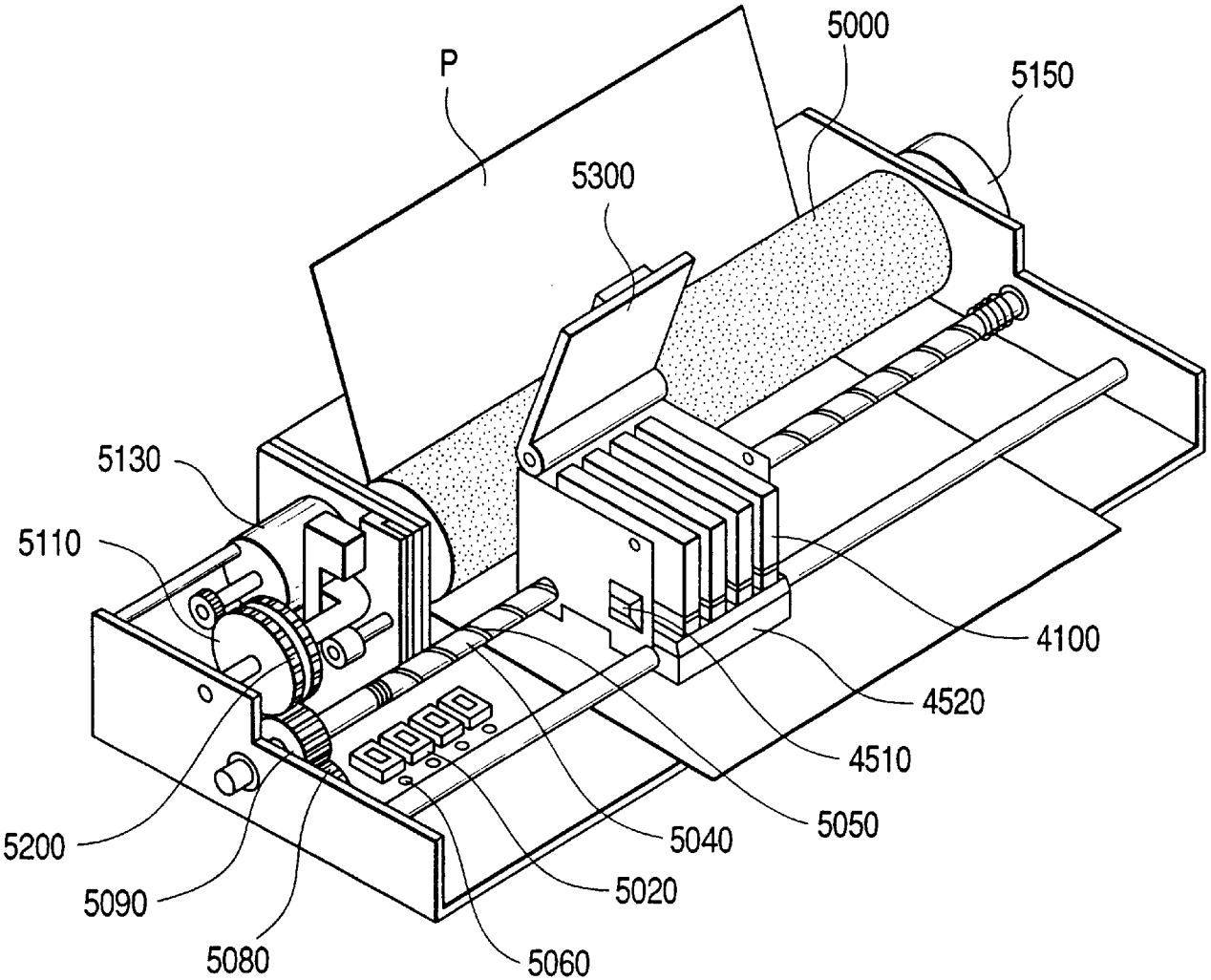
FIGS. 36A and 36B are views which schematically illustrate the examples of the ink jet recording apparatuses to which the liquid supply system is applicable, respectively, in accordance with the present invention.
Figure 36B:
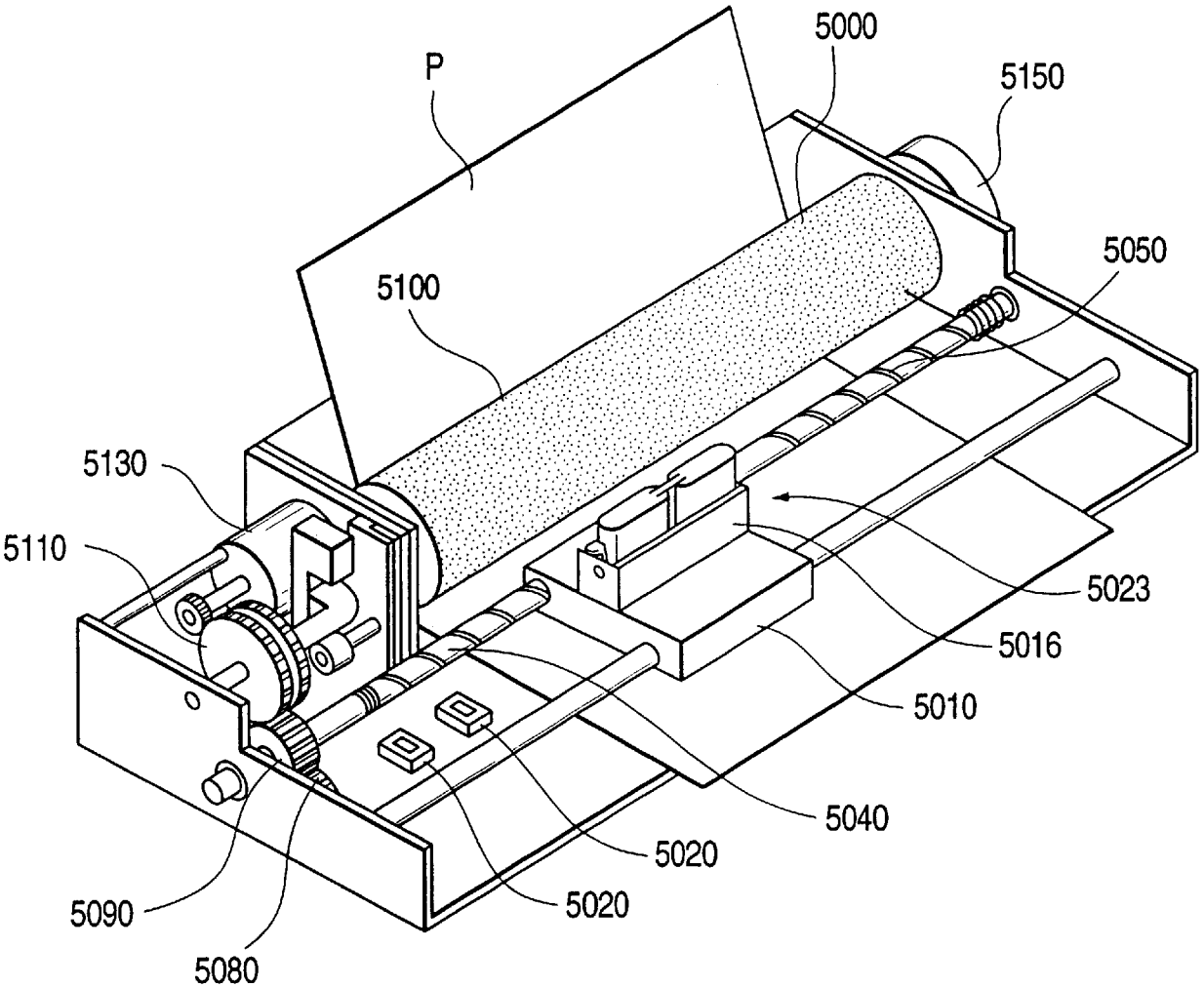

Now, the description will be made of the ink jet recording apparatus that mounts the ink container of the present invention to perform recording. FIGS. 36A and 36B are views which schematically illustrate the ink jet recording apparatus on which the ink container is mounted in accordance with one embodiment of the present invention.

In FIG. 36A, the head unit (not shown) and the ink container 4100 are fixedly supported on the main body of the ink jet recording apparatus by positioning means (not shown) and the connection plate 5300 which rotates around the specific axis. At the same time, these are detachably and respectively installed on the carriage 4520.

The regular and reverse rotations of the driving motor 5130 are transmitted to the lead screw 5040 through the transmission gears 5110 and 5090 to rotate it. Also, the carriage 4520 is provided with a pin (not shown) which engages with the spiral groove 5050 of the lead screw 5040. In this way, the carriage 4520 reciprocates in the longitudinal direction of the apparatus.

On the other hand, the recording material P is carried below the carriage 4520 by the rotation of the carrier roller 5000 by the driving of the sheet feed motor 5150. In this position, ink is discharged from the recording head to record on the recording material P, while the carriage 4520 is traveled in the longitudinal direction of the apparatus.

The cap 5020 that caps the front end of each recording head in the head unit is used for the suction recovery of each recording head by use of suction means through the aperture in the cap. The cap 5020 moves by the driving force transmitted through the gear 5080 and others to cover the discharge port surface of each recording head. In the vicinity of the cap 5020, the cleaning blade (not shown) is arranged. This blade is supported to be movable in the top to bottom direction. The blade is not necessarily limited to this configuration. It is of course possible to apply any one of the known cleaning blades to the present embodiment.

As to these capping, cleaning, and suction recovery, the structure is arranged so that desired process is performed in the respective positions by the function of the lead screw 5050 when the carriage 4520 shifts to the home position. However, if only the desired operation is made possible at the known timing, any type of the structure may be applicable to the present embodiment.

Now, the description will be made of the advantages when the ink container of the present invention is mounted on the carriage that reciprocates as described above.

For the ink container of the present invention, the ink accomodating chamber is the deformable member. As a result, it becomes possible to ease the swinging of ink caused by the scanning of the carriage with the deformation of the ink accomodating chamber. In order not to allow the negative pressure to change by the scanning of the carriage, it is desirable to keep a part of the corners of the ink storage unit so as not to allow it to deviate from the corresponding inner surface of the housing or keep it in the vicinity of such surface even if it is deviated. Also, as in the present embodiment which uses the ink storage unit provided with a pair of the largest areas that face each other, it is possible to produce the easing effect more efficiently on the ink swinging described above by mounting the carriage so that such facing largest surface areas are arranged in the direction almost orthogonal to the scanning direction of the carriage.

Also, as described in the paragraphs of <the structure of the ink accomodating chamber>, it may be possible to mount on the recording apparatus the pressure recovery means 4510 that presses the inner walls through the outer wall of the ink accomodating chamber. In this case, with the provision of the liquid presence and absence detecting means 5060 provided the light emitting means that transmits the light beam through the ink accomodating chamber to detect the presence and absence of ink depending on the state of reflection thereof, and the photodetecting means; the means for detecting disabled discharges that detects the disabled discharges of the recording head (not shown); and controlling means (not shown), it becomes possible to eliminate the ink shortage in the area near the gas-liquid exchange passage of the capillary force generating material to the area near the ink supply port by the adoption of the following sequence, for example.

At first, when the ink accomodating chambers are replaced, the usual suction recovery process is performed by the utilization of the cap 5020. Then, if disabled discharged are detected on the nozzles of the head that correspond to the replaced ink retaining chamber, it is possible to restore such condition to the normal state by the performance of the pressure recovery means 4510. Also, on the way of use, the "ink presence" condition is detected by the liquid presence and absence detecting means 5060, and the "disabled discharges" condition is detected by the means for detecting the disabled discharges, respectively, and then, if the disabled discharge conation is not recovered by the application of the usual suction recovery process, it is possible to restor such condition to the normal state by the operation of the pressure recovery using the pressure recovery means 4510. In either cases, it is desirable to prevent any ink leakage from the recording head unit unexpectedly by perform the capping by use of the cap for the recording head unit that corresponds to the ink container for which the pressure recovery should be executed.

In this respect, the aforesaid means for detecting the presence and absence of liquid is not necessarily limited to the one using the optical method. It may be possible to adopt the dot counting method or some other methods or to combine some of them for use.

Also, FIG. 36B is a view which illustrates the ink jet recording apparatus having on it the ink jet cartridge installed with the new installation mechanism of the present invention described in the paragraphs of <the installation structure of the replacement container>. This application example is different from the mode shown in FIG. 36A in that the shifting direction of the elasticity of the lever, which holds ink container 5100 on the tank with head, is substantially the same as the scanning direction of the reciprocating carriage 5010. With the arrangement to direct the installation of the carriage 5010 on the ink container as described above, the lever provided for the ink container is made to absorb the simultaneous restoration shock given to the ink container that follows the carriage.

<The Opening/Closing Valve for Use of the Liquid Container>

Lastly, the supplemental description will be made of the opening/closing valve for use of the liquid container.

In the conventional field of the ink jet recording apparatus, the recording head and the ink container are separably structured, and it has been practiced to provide the structure that makes only the ink containers exchangeable as required. For the structure thus arranged, it is required to secure sealing means for the connecting portion of the ink container during the distribution or before the ink container and the recording head is connected in the initial stage. Also, after the ink container is once installed, if the attachment and detachment thereof is repeated, it is necessary to implement the reliable closing and opening operations for the opening of the ink container in order to prevent the ink leakage from the opening of the connecting portion.

Conventionally, as the structure of connecting portion to airtightly close the opening of the ink container, there is known a valve mechanism that uses a ball and a spring that biases the ball. The operating value for use of the liquid container formed by such valve mechanism performs the opening and closing by means of the elasticity of the spring member, and particularly it is effective in the mode that ink is directly contained in the ink container of the ink container. The valve mechanism that uses the ball and the spring member is caused to open when ink container is installed on the tank holder or the like. In this case, the ink container is pressed to the tank holder. Then, with the communication tube or the like provided for the tank holder, the ball is compressed to shift, thus opening the valve.

However, the opening/closing valve for use of the liquid container that uses the ball and the spring member as described above has one opening and closing portion for the liquid supply to one liquid supply tube. Then, if the opening and closing portion is solidified or clogged, the liquid supply path is blocked in some cases. As a result, there is a fear that the appropriate liquid supply to the outside of the liquid container becomes impossible, and the system is regarded as insecure in terms of the reliability of liquid supply.

Also, in order to secure the aperture area for the liquid supply, the diameter is made smaller for the abutting member to enable the ball to move, there are some cases where the ball is caught in the space provided for the opening and closing operation depending on the operational resistance of the ball, the abutting portion, or the like, hence making it impossible to execute the reliable and quick operation. In such a case, there is a fear that the liquid supply is disabled when the liquid container is connected or the ink leakage takes place when the liquid container is removed. Also, if the abutting portion is made larger in anticipation of the exact operation, the aperture area becomes smaller. Thus, the security of the aperture area and the reliability of the opening and closing operation are the trade-off between them.

Further, the valve using the ball and the spring member requires many numbers of parts that constitute the valve. Therefore, the parameters that have bearing on the sealing capability are the ball, the bearing surface, the compression force of the spring, and many others. Then, there is a problem that the precision tolerance becomes smaller when the valve is finally assembled. Particularly, if each of the components to form the valve is produced by different materials, the cost of manufacture becomes high inevitably. Also, there is a need for selecting each material for each component while considering the each component in terms of the assembling capability and resistance to ink.

Now, therefore, with a view to making the liquid supply system of the present invention excellent in a better condition, the inventors hereof have considered the provision of the new structure of the opening/closing valve for use of the liquid container which is able to enhance the sealing capability of the opening portion of the liquid container when liquid in the liquid container should be sealed in the initial state such as during distribution, and at the same time, having a higher reliability of the liquid supply when liquid is supplied from the liquid container to the outside, as well as the exact opening and closing operations. This valve has a simple and low-cost structure, but has a capability to operate its opening and closing exactly and reliably. The valve is also made applicable to other containers. Here, in conjunction with the accompanying drawings, the description will be made of the structure of the valve, and the principle of the opening and closing operation thereof.

Figure 37:
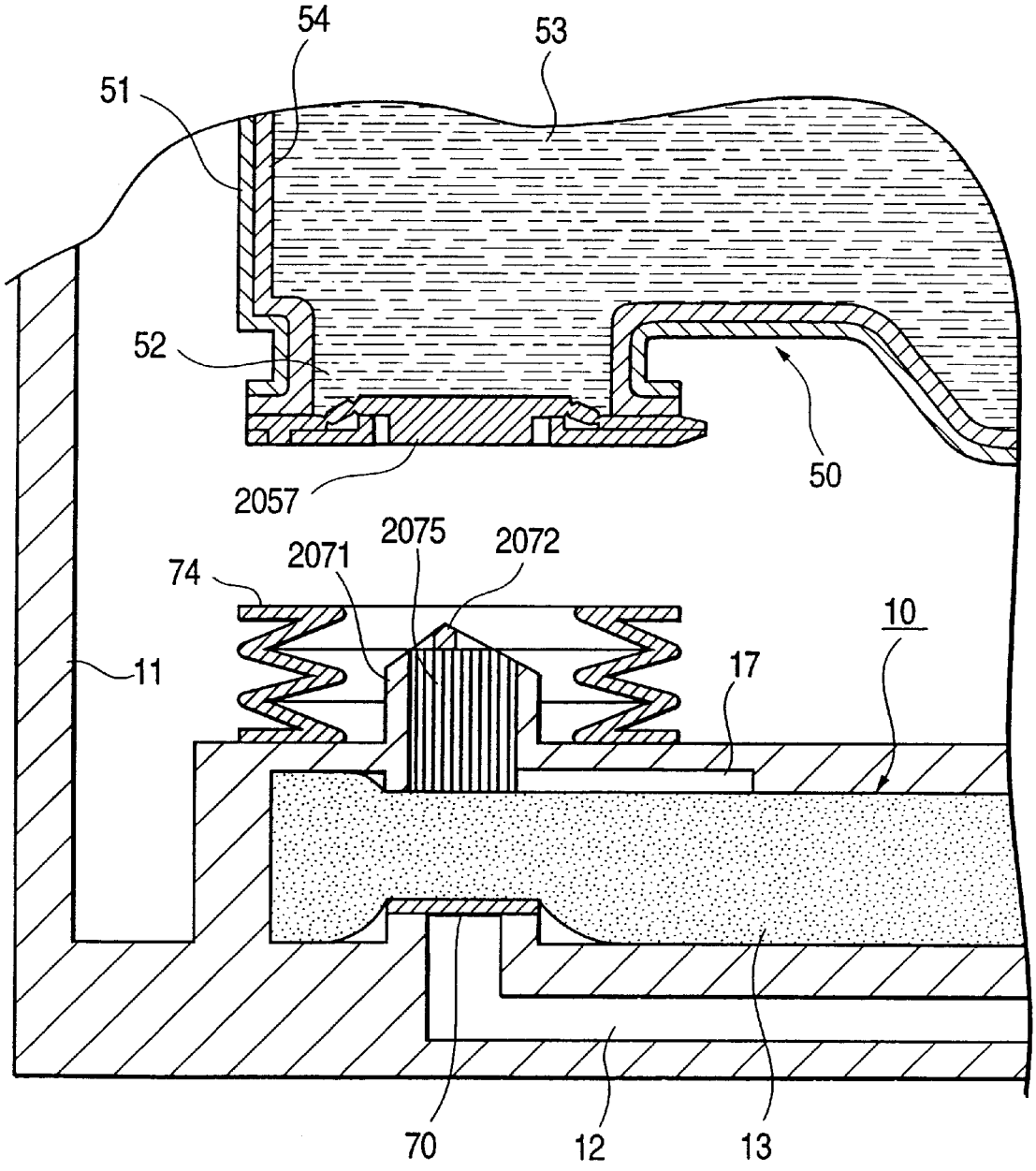
FIG. 37 is an enlarged view which shows the connecting unit of ink paths between the ink container provided with the valve of the present invention and the holder to install the ink container thereon.

FIG. 37 is an enlarged view which illustrates the connecting portion with respect to the ink flow path of the ink container which is the liquid container of the present invention and the holder capable of mounting the ink container thereon, which is sealed by the opening/closing valve for use of the liquid container in accordance with one embodiment of the present invention. As to the ink container and the holder, the same reference marks are applied to the same parts as those in the first embodiment, and the description thereof will be omitted.

As shown in FIG. 37, before the ink container 50 of the present invention is mounted on the holder 30 with head, the opening of the ink supply unit 52 is closed by the opening/closing valve 2057 for use of the liquid container. Thus, the ink storage unit 53 is closed from the air outside. As the material of the valve 2057, polypropylene or other resin is used. The valve 2057 is bonded to the leading end of the ink supply unit 52 by means of welding. In this manner, the liquid container with the opening/closing valve is formed by the ink container 50 and the valve 2057. Also, for the portion on the ink supply unit 52 side of the outer wall 51 on the wall surface on the side opposite to the latch lever 80 side, the fall off stopper nail 82 is arranged.

On the other hand, for upper wall of the holder 30 with head, there is arranged the communication tube 2071 which serves as the communication unit connected with the ink supply unit 52 of the ink container 50 and communicated with the ink storage unit 53. In the interior of the communication tube 71, the ink introducing device 2075 having the capillary force is provided.

Here, for the portion where the communication tube 2071 of the tank holder 11 is arranged, the bellows 74 is fixed as the closing member to surround the communication tube 2071. The bellows 74 is to prevent the ink leakage when the ink supply unit 52 of the ink container 50 is connected with the communication tube 2071. It may be possible to use the O ling instead of the bellows 74 as described earlier. Also, with the provision of the slit on the side wall of the communication tube 2071 or the like, it may be possible to collect ink residing in the interior of the bellows 74 to the ink introducing device 2075 through the slit. On the leading end of the communication tube 2071, abutting portion 2072 is formed as the protrusion. The abutting portion 2072 is arranged with the deviation from the central axis of the cylindrical communication tube 2071.

The bellows 74 is made higher than the leading end of the communication tube 2071, and when the ink container 50 is mounted on the tank holder 11, the bellows 74 abuts upon the valve 2057 ahead of the leading end of the communication tube 2071. The valve 2057 seals the ink supply unit 52 in the initial stage, and when the ink container 50 is mounted on the tank holder 11, the abutting portion 2072 of the communication tube 2071 abuts upon the valve 2057 to compress the valve 2057, thus the thinner thickness portion of the valve 2057 being broken as described later to unseal the valve 2057. After the valve 2057 is unsealed, the valve 2057 becomes switchable.

Figure 38A:
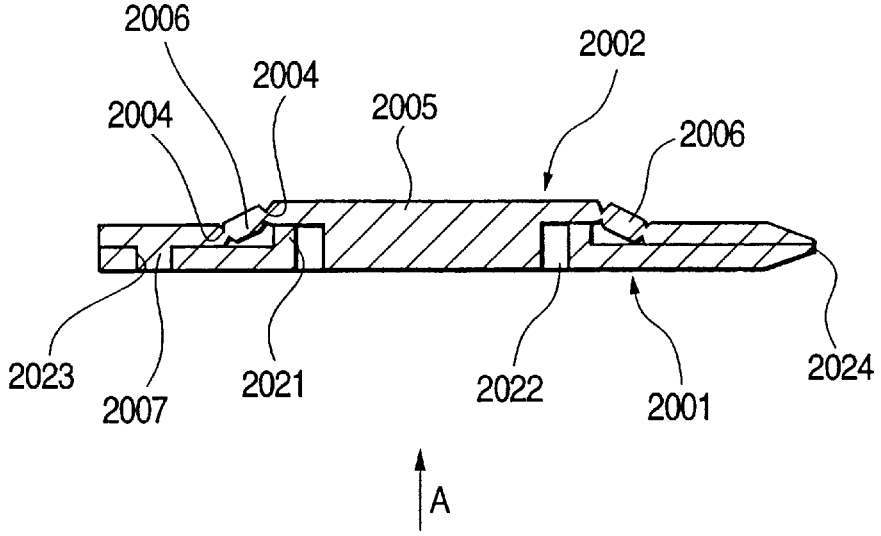
FIGS. 38A and 38B are the cross-sectional view and the plan view which illustrate the valve shown in FIG. 37, respectively.
Figure 38B:
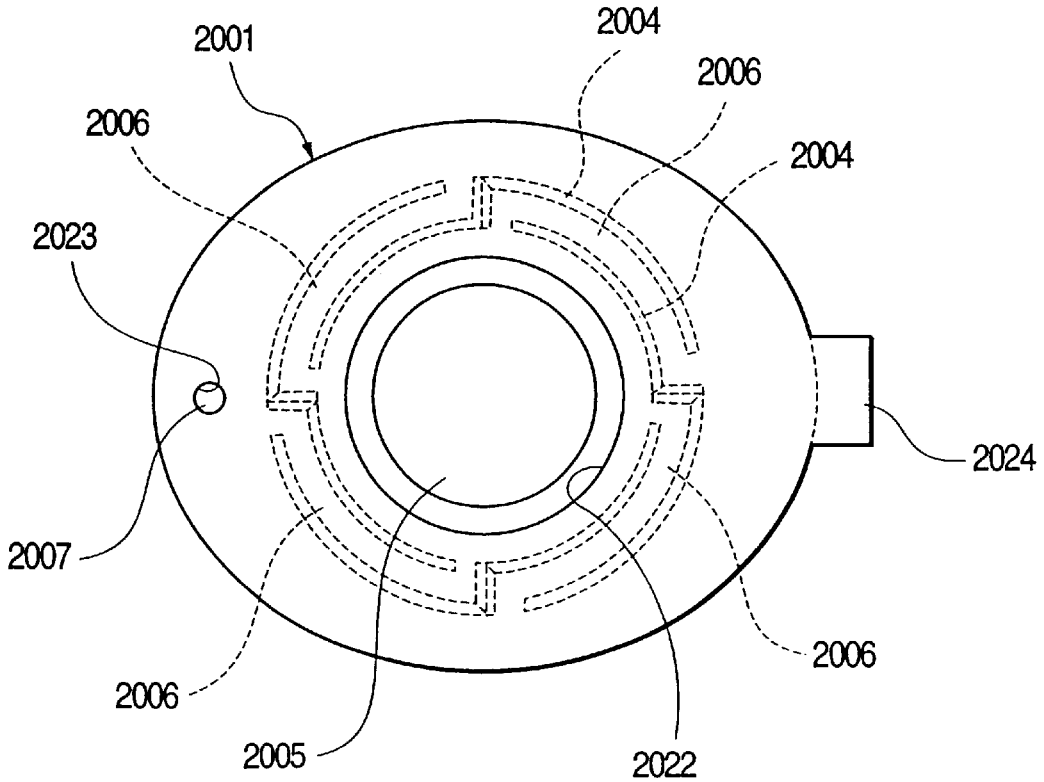

FIGS. 38A and 38B are a cross-sectional view and a plan view which illustrate the valve 2057 represented in FIG. 37. FIG. 38A is a cross-sectional view of the valve 2057, and FIG. 38B is a view of FIG. 38A observed in the direction indicated by an arrow A.

As shown in FIGS. 38A and 38B, the valve 2057 is formed by putting together the bearing surface unit 2001 whose outer shape is in the form of the oval sheet, and the valve body 2002, which are integrally formed. One end of each of the bearing surface unit 2001 and the valve body 2002 is connected through bent portion 2024. From the surface of the other end of the valve body 2002 on the bearing sheet unit 2001 side, the positioned boss 2007 is extruded. Also, on the other end portion of the bearing sheet unit 2001, the positioning hole 2023 is formed to allow the positioning boss 2007 to fit in. The cylindrical abutting portion 2021 is extruded from the surface of the central portion of the bearing sheet unit 2001 on the valve body 2002 side. The leading surface of the abutting portion 2021 on the valve body 2002 side just abuts upon the valve body 2002, and not connected with the valve body 2002. Therefore, the leading surface of the abutting portion 2021 is separable from the valve body 2002. On the inner part of the abutting portion 2021 of the bearing surface unit 2001, the opening 2022 is formed.

On the other hand, the central part of the valve body 2002 is formed to be the movable portion 2005. The part of the movable portion 2005 on the bearing surface unit 2001 is cylindrically protruded, and the protruded portion enters the interior of the opening 2022. Also, on the portion of the valve body 2002 on the circumference of the movable portion 2005, a plurality of breakable thinner thickness portions 2004 are formed so as to provide four elastic supporting portions 2006. The four elastic supporting portions 2006 are deformable, and as described later, these portions support the movable portions 2005 swingably when the thinner thickness portions 2004 are broken. Also, the four elastic supporting portions 2006 are all in the same configuration, and each of the elastic supporting portions 2006 is arranged at the same intervals on the circumference of the movable portion 2005. The movable portion 2005 and the plural elastic supporting portions 2006 form the valve unit which becomes switchable after the thinner thickness portion 2004 is broken, respectively.

The portion of the valve body 2002, with the exception of the movable portion 2005, the elastic supporting portion 2006, and the thinner thickness portion 2004, is in contact with the bearing surface unit 2001, and the contacted surfaces of the valve body 2002 and the bearing surface unit 2001 are bonded together themselves by means of welding. However, as described earlier, the contacted surfaces of the abutting portion 2021 and the valve body 2002 are not bonded together themselves, but are made separable.

Now, with reference to FIGS. 39A and 39B to FIGS. 42A and 42B, the description will be made of the operation of the valve in accordance with the present embodiment. Each of FIGS. 39A and 39B to FIGS. 42A and 42B is a schematic view which illustrates the changes sequentially when the communication tube 2071 of the tank holder 11 abuts upon the valve 2057 of the ink supply unit 52 shown in FIG. 37, and the valve 2057 is unsealed by the communication tube 2071 which compresses the valve 2057. Each of the FIGS. 39A, 40A, 41A and 42A is a perspective view, and each of the FIGS. 39B, 40B, 41B, and 42B is a side view, in which the valve 2057 is sectionally shown respectively.

Figure 39B:
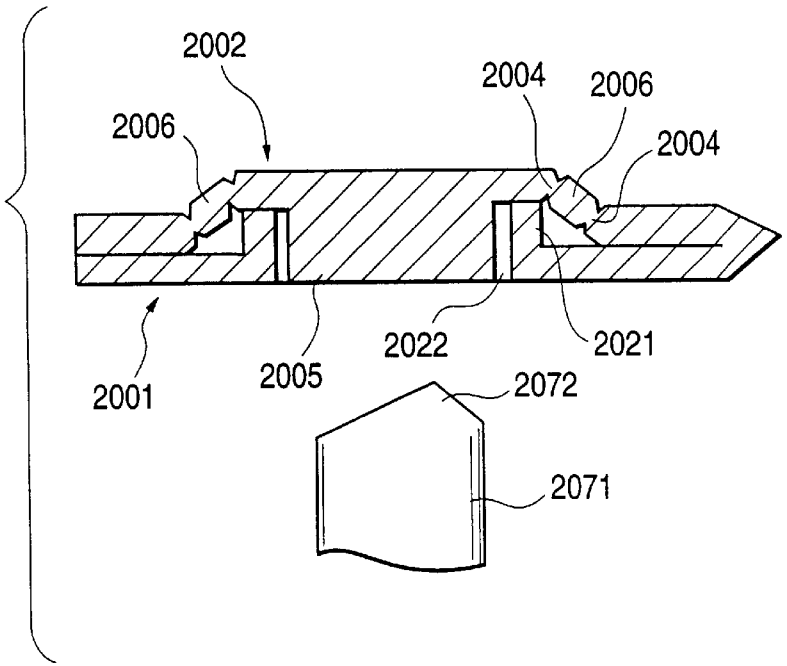
FIGS. 39A and 39B are views which illustrate the state of the valve shown in FIG. 37 before it is unsealed.
Figure 39A:
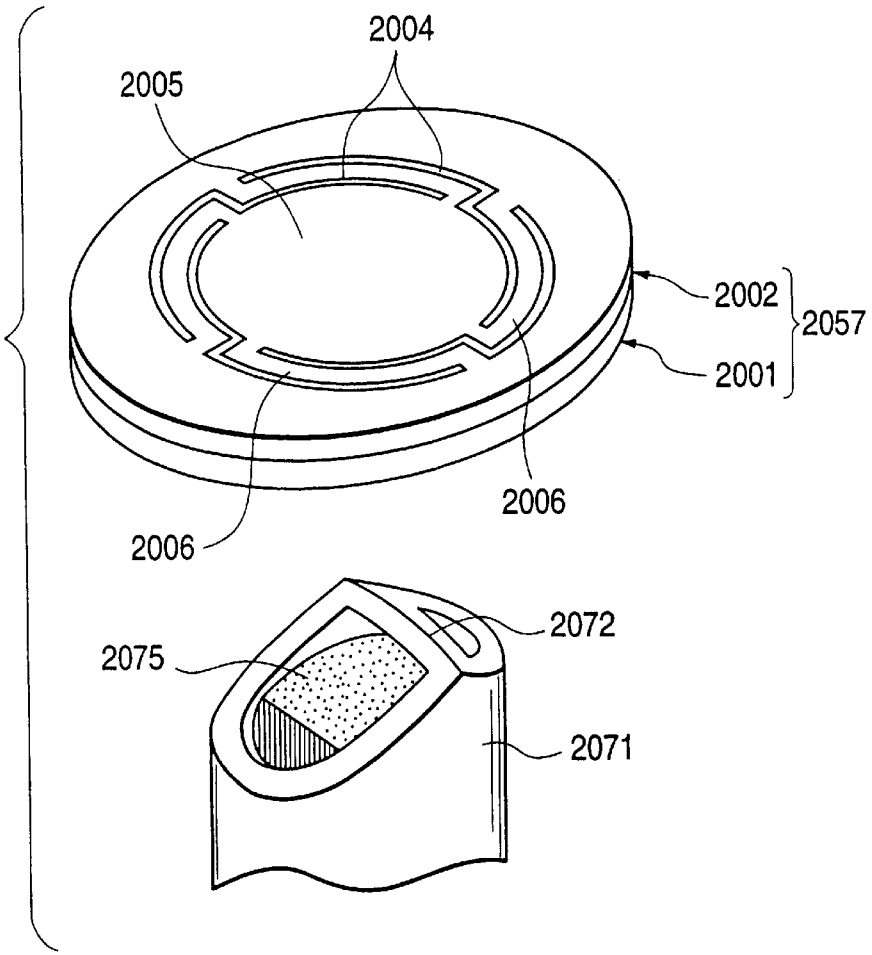

FIGS. 39A and 39B illustrate the state before the valve 2057 is unsealed by mounting the ink container 50 on the holder 30 with head. In this state, the ink container 50 has never been mounted on the tank holder 11 even one here, and the ink container 50 is in the initial stage and still remains unsealed. The thinner thickness portion 2004 shown in FIGS. 38A and 38B is not broken. Therefore, the ink supply unit 52 of the ink container 50 is sealed by the valve 2057 formed by the sheet member provided with the thinner thickness portion 2004. The ink storage unit 53 is essentially closed.

Figure 40B:
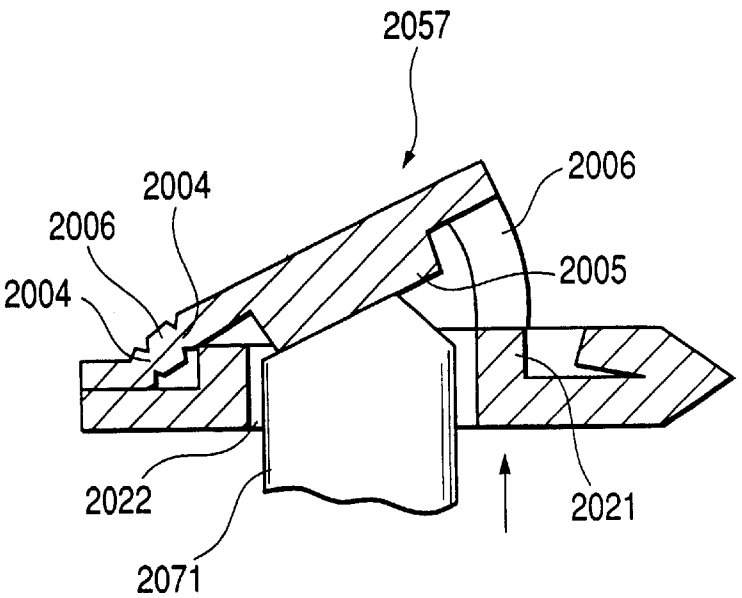
FIGS. 40A and 40B are views which illustrate the unsealing operation of the supply tube of the valve shown in FIG. 37.
Figure 40A:
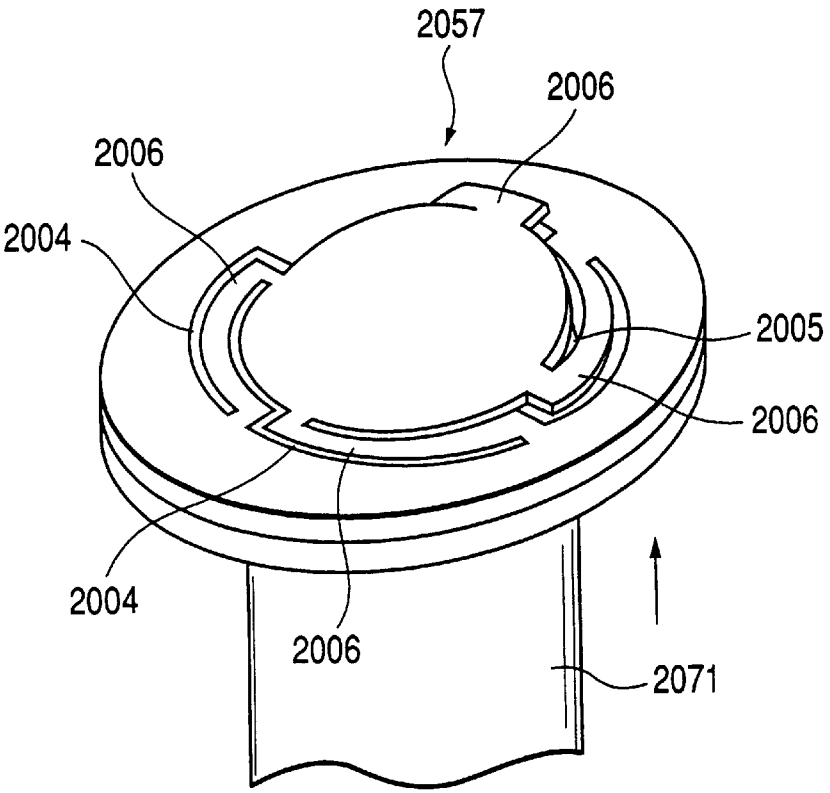

When the ink container 50 is mounted on the holder 30 with head, the abutting portion 2072 of the communication tube 2071 abuts upon the movable portion 2005 of the valve 2057. As shown in FIGS. 40A and 40B, the abutting portion 2072 abuts upon the surface of the movable portion 2005 on the bearing surface unit 2001 side, and the movable portion 2005 is compressed by the communication tube 2071. Then, since the abutting portion 2072 is deviated from the central axis of the communication tube 2071, the abutting portion 2072 breaks the thinner thickness portion 2004 on the deviated side. Thus, the movable member 2005 is raised. In this state, the abutting portion 2072 has not broken the thinner thickness portion 2004 on the side opposite to the deviated portion. The surface of the movable portion 2005 on the communication tube 2071 side is in contact with the slanted face of the leading end of the communication tube 2071. In this manner, the valve 2057 is gradually unsealed along the gradual breakage of the thinner thickness portion 2004.

Here, since the abutting portion 2072 is deviated from the central axis of the cylindrical communication tube 2071 as described above, the unsealing tendency of the valve 2057 is improved due to the stress concentration which occurs locally with the stronger breaking strength than that of the thinner thickness portion 2004 by the uneven distribution of the abutting force on the movable portion 2005 exerted by the abutting portion 2072 when the abutting portion 2072 abuts upon the movable portion 2005. With the occurrence of the localized stress concentration on the thinner thickness portion 2004, the unsealing force of the valve 2057 is reduced. Also, the abutting portion 2072 is arranged on a specific position which is different from the central axis of the communication tube 2071 to allow the stress concentration to occur on the specific portion of the thinner thickness portion 2004. Then, it becomes possible to regulate the breaking order beginning with a designated portion of the thinner thickness portion 2004, hence improving the reliability of the unsealing operation of the valve 2057.

Figure 41B:
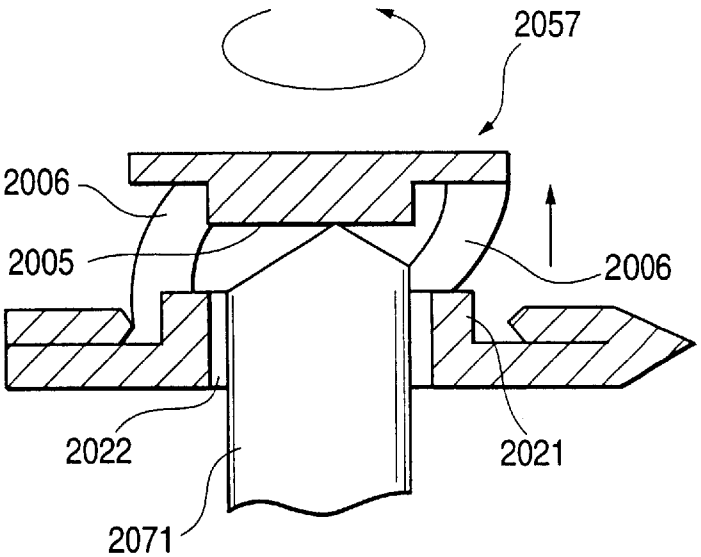
FIGS. 41A and 41B are views which illustrate the connected state of the valve with the supply tube after the unsealing operation by the supply tube.
Figure 41A:
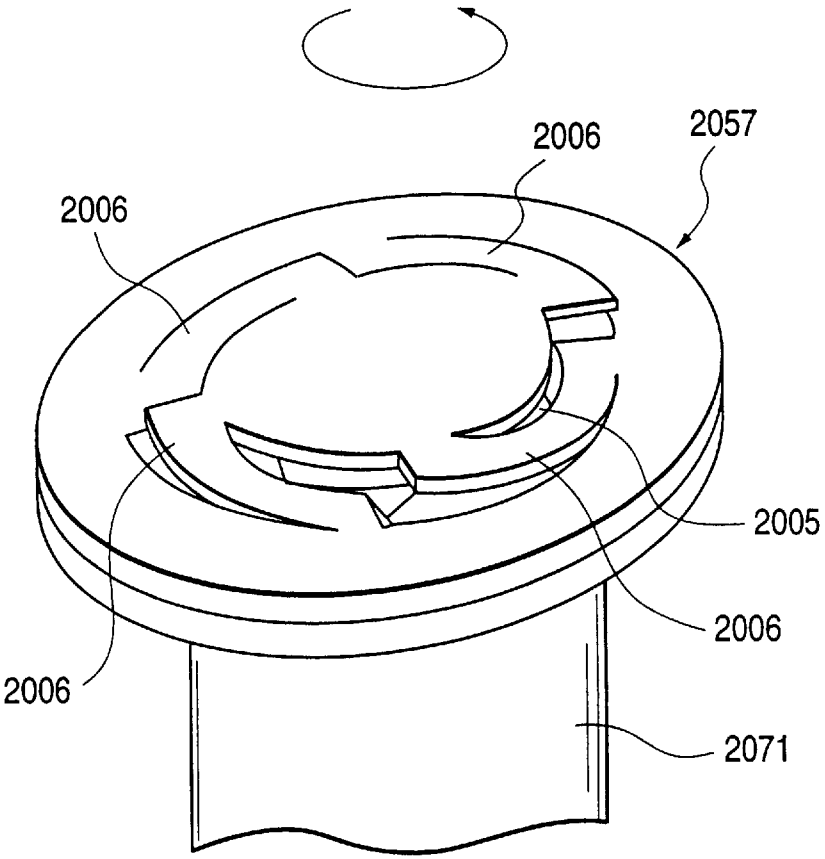

As shown in FIGS. 41A and 41B, when the movable portion 2005 is further compressed by the communication tube 2071, the thinner thickness portion 2004 is completely broken. Then, the movable portion 2005 is pushed upward still more. At this juncture, the movable portion 2005 is rotationally pushed upward by the four elastic supporting portions 2006 which present torsional elastic deformation. Thus, the valve 2057 is unsealed. The movable portion 2005 is swingably supported by the four elastic supporting portions 2006, and by the elastic force exerted by the elastic supporting portions 2006, the movable portion 2005 is biased to the communication tube 2071 side. In this manner, the valve 2057 is completely unsealed by the communication tube 2071 to make connection between the communication tube 2017 and the ink supply unit 52 of the ink container 50. Then, the communication tube 2071 is communicated with the ink storage unit 53 through the opening 2022 of the valve 2057.

As described above, by the torsional elastic deformation of the elastic supporting portions 2006, the movable portion 2005 shifts while being rotated, hence operating the opening and closing of the valve 2057 to secure the opening area of the valve 2057 with a smaller space.

Figure 42B:
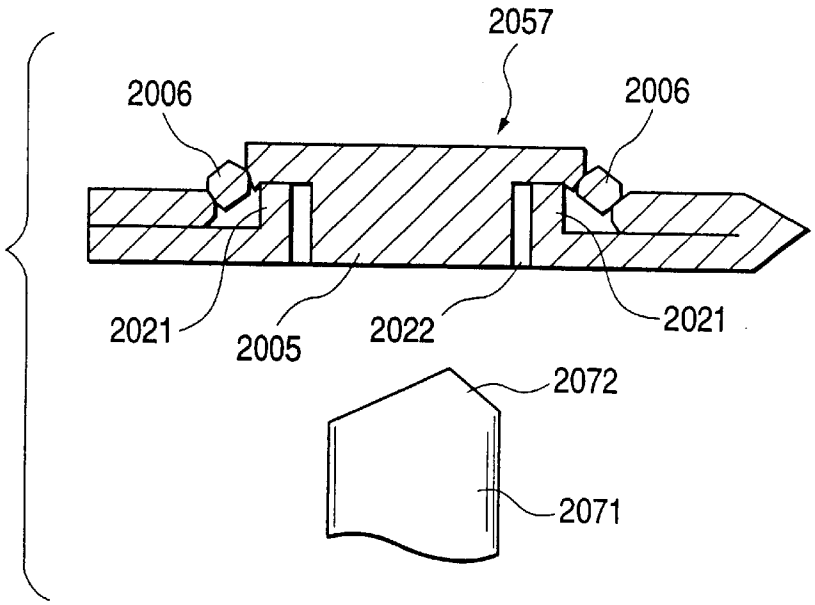
FIGS. 42A and 42B are views which illustrate the state where the compression on the valve is released by the supply tube.
Figure 42A:
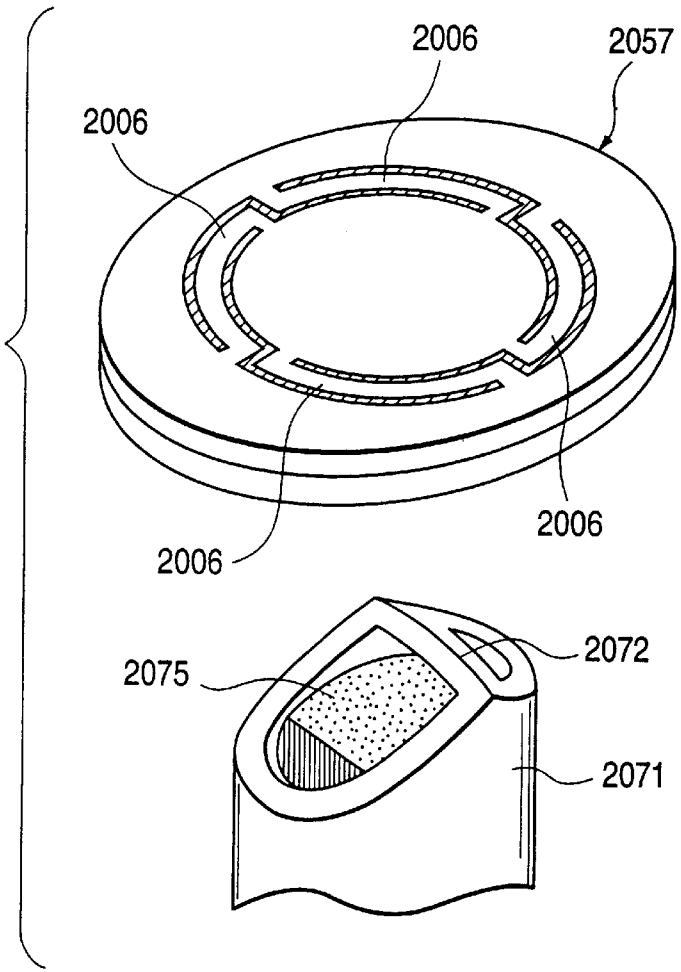

FIGS. 42A and 42B are views which illustrate the state where the valve 2057 is closed when the ink container 50 is removed from the ink holder 11 after the valve 2057 is unsealed. When the ink container 50 is removed from the tank holder 11, the communication tube 2071 is withdrawn from the opening 2022 of the valve 2057. Then, as shown in FIGS. 42A and 42B, the movable portion 2005 enters the inside of the opening portion 2022 by the restoring force of the torsional elastic deformation of the elastic supporting portions 2006, that is, by the elastic force of the elastic supporting portions 2006. The thinner thickness portion 2004 has been broken by the unsealing operation described earlier. The portion of the valve 2057 which has been broken is indicated by slanted lines in FIG. 42A.

At this juncture, the edge face of the movable portion 2005 on the bearing surface unit 2001 side is caused to abut upon the leading surface of the abutting portion 2021 of the bearing surface unit 2001. Hence, the valve 2057 is in the closed condition. In this state, the contacted surfaces of the edge of the movable portion 2005 and the abutting portion 2021 themselves are in contact under pressure by the elasticity of the elastic supporting portions 2006, hence securing the sealing capability. With the sealing capability thus secured, the interior of the ink storage unit 53 is closed. Therefore, after the valve 2057 is unsealed, the opening and closing of the ink supply unit 52 is effectuated by the shift of the movable portion 2005 in the top to bottom direction, that is, in the direction perpendicular to the opening surface of the ink supply unit 52.

In this manner, the elasticity of the elastic supporting portions 2006 is adjusted so that the valve 2057 is closed when the ink container 50 is removed from the holder 11. The elastic force of the elastic supporting portions 2006 is greater than the negative pressure in the interior of the ink storage unit 53. Further, in accordance with the present embodiment, the valve 2057 is bonded to the bottom end side of the ink container 50 with the communication tube 2071 being located on the lower side of the ink container 50. Therefore, the airtightness of the valve 2057 is enhanced by the utilization of the water head of ink.

As described above, by the restoring force of the torsional elastic deformation of the each of the elastic supporting portions 2006, the closing operation of the valve 2057 is performed to enhance the restoring capability of the movable portion 2005 to the initial position, as well as the contacting force of the valve 2057 to the abutting portion 2021. Therefore, even when ink container 50 is removed in the state where ink is stored in the ink container 50 after the valve 2057 is once unsealed, there is no possibility that ink in the ink container 50 leaks. Thus, there is no ink leakage to the tank holder 11 to make it possible to repeat the attachment and detachment of ink container 50 as required.

Figure 43:
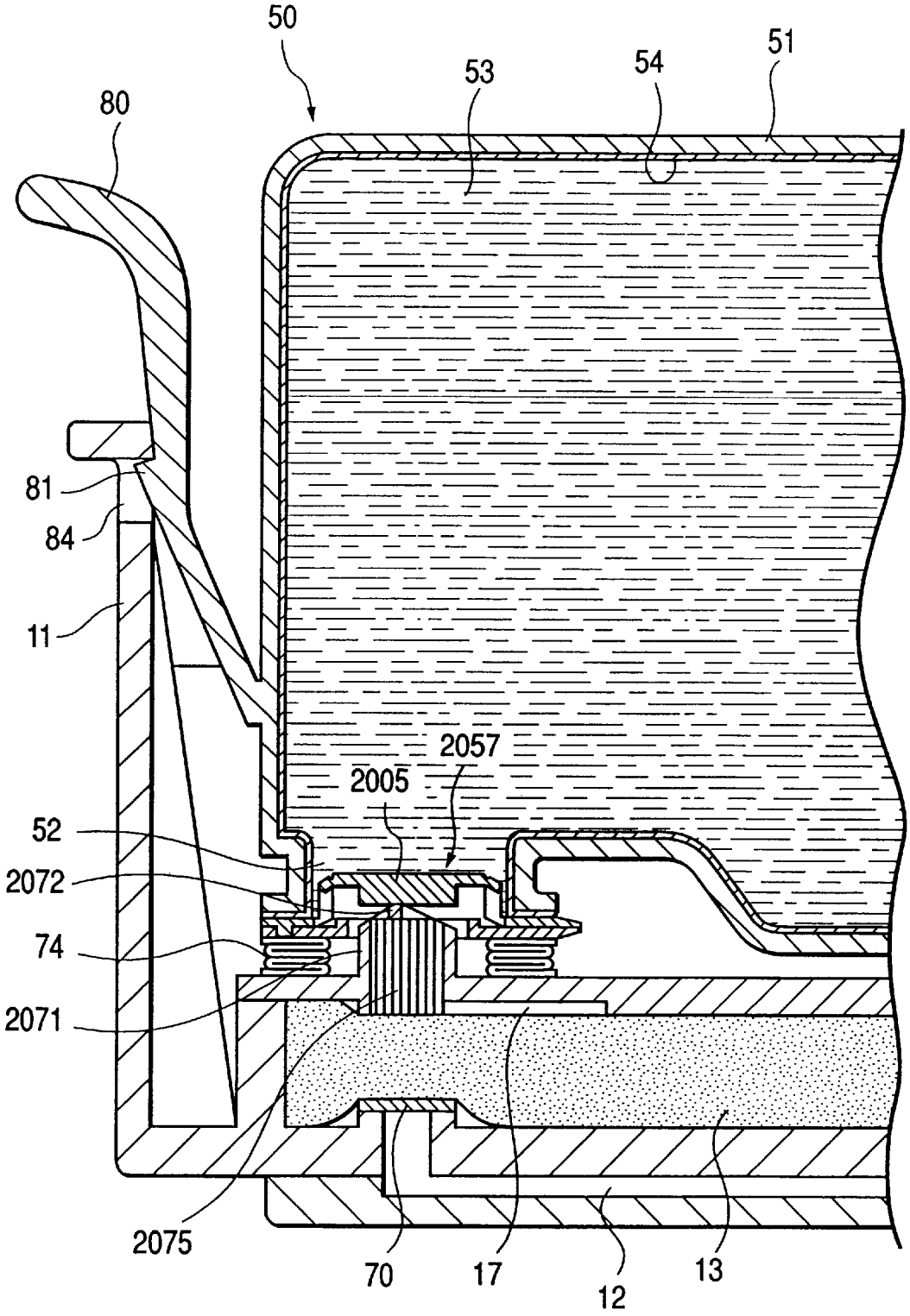
FIG. 43 is a cross-sectional view which shows the state where the ink container provided with the valve of the present invention is mounted on the tank holder shown in FIG. 37.

FIG. 43 is a cross-sectional view which shows the state where the ink container with the valve is mounted on the tank holder represented in FIG. 37. As shown in FIG. 43, with the ink container 50 mounted on the tank holder 11, the movable portion 2005 of the valve 2057 is depressed by the communication tube 2071, and the valve 2057 is in the open state through the unsealing operation of the valve 2057 as described above. As a result, when the ink container 50 is mounted on the tank holder 11, the valve 2057 is always in the open state, and the ink storage unit 53 of the ink container 50 is communicated with the communication tube 2071 through the valve 2057.

When the ink container 50 is removed from the tank holder 11 from the state shown in FIG. 43, the valve 2057 is closed as described in conjunction with FIGS. 42A and 42B. Then, the ink storage unit 53 of the ink container 50 is airtightly closed.

In this respect, as clear from the structure shown in FIGS. 38A and 38B, the valve 2057 of the present invention is formed integrally with the valve body 2001 and the bearing surface unit 2002. Then, after such integrated mold product is bent for bonding, it is bonded to the liquid container. Therefore, only with four steps of simple manufacturing processes, it becomes possible to demonstrate the required functions without any highly precise processing. Here, as to the welding of the leading end surface of the ink supply unit 52 and the valve 2057, it is possible to utilize either one of heat, ultrasonic wave, vibration, or torsional vibration as in the welding of the bearing surface unit 2001 and the valve body 2002. Also, instead of the welding, it may be possible to bond the valve 2057 and the ink container 50 or it may be possible to bond them by use of double sided adhesive tape which is able to seal the abutting portion of the valve 2057 and the ink container 50.

Also, before, the valve 2057 and the ink container 50 are bonded together, ink may be stored in the ink storage unit 53 of the ink container 50 or not. When the valve 2057 is bonded to the ink container 50 in the state where ink is not stored in the ink storage unit 53, the ink injection aperture should be formed in advance on the part which is different from the ink supply unit 53 of the ink container 50. Then, ink may be injected into the ink storage unit 53 through the aperture for use of the ink injection. After ink is filled in the ink storage unit 53, the aperture for use of ink injection is sealed.

FIGS. 44A to 47C are views which illustrate the variational examples of the valve of the present invention.

Figure 44B:
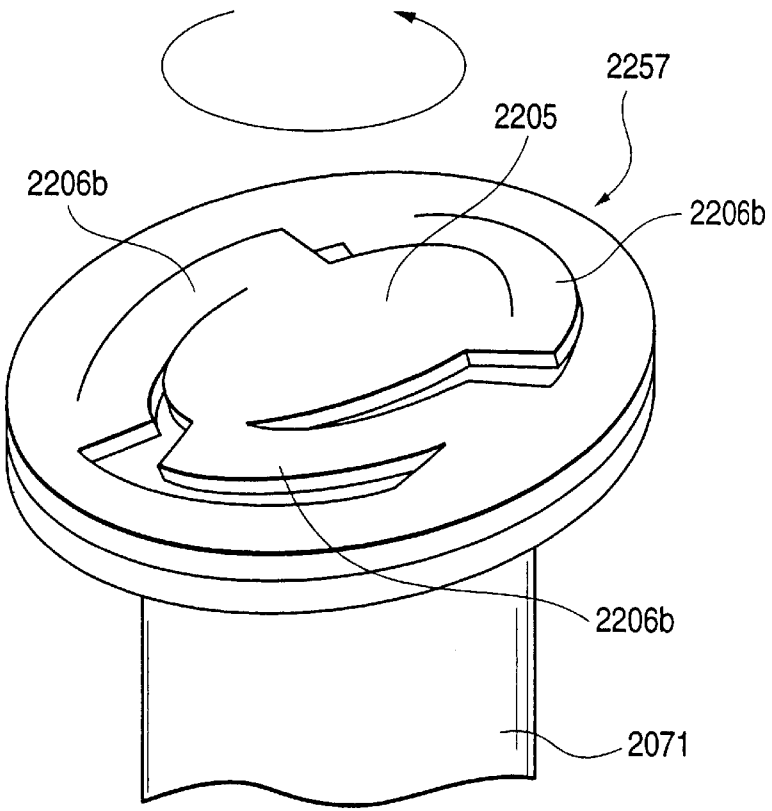
FIGS. 44A and 44B are views which illustrate the unsealed state of the variational examples of the valve in accordance with the present invention.
Figure 44A:
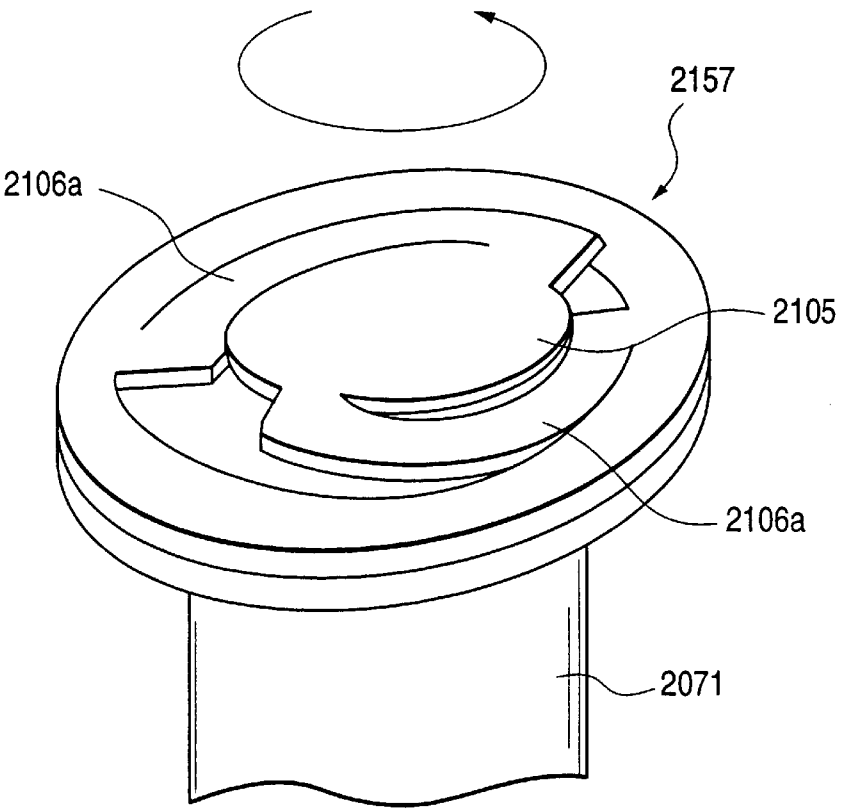

FIGS. 44A and 44B are perspective views which illustrate the open state of the variational example of the valve of the invention. As shown in FIG. 44A, thinner thickness portion 2004*a* may be formed in such a manner that the movable portion 2005 is supported by two elastic supporting portions 2006*a*. Also, as shown in FIG. 44B, the thinner thickness portion 2004*b* may be formed in such a manner that the movable portion 2005 is supported by three elastic portions 2006*b*. In this way, the thinner thickness portion of the valve 2057 is broken, and then, the movable portion 2005 is supported by two or more elastic supporting portions, hence making it possible to open and close the valve 2057 by the movement of the valve 2057 by means of the torsional elastic deformation of the elastic supporting portions. In order to perform the stabilized operation of the valve 2057, it is desirable to provide three or more elastic supporting portions. Also, each of the elastic supporting portions should be in the same configuration and positioned at the same intervals. Then, the force is given evenly to the movable portion 2005 to stabilize the opening and closing operation of the valve 2057.

Further, it is possible to adjust the force of the elastic deformation, that is, the operational force of the valve 2057, depending on the material of the valve 2057, the thickness of the respective parts of the valve 2057, the wide of the supporting portion, among some others.

As described above, in accordance with the present embodiment, the valve 2057 is not unsealed in the initial state when it is installed on the opening of the ink supply unit 52. The movable portion 2005 is provided with the thinner thickness portion 2004 which is broken by the compression of the communication tube 2071. In this way, the ink storage unit 53 is reliably closed by the valve 2057 in the initial stage until when the thinner thickness portion 2004 is broken, thus unsealing the valve 2057. Therefore, in the initial state such as during the distribution, the sealing capability of the ink supply unit 52 is enhanced to make it possible to keep liquid reliably held in the ink container 50.

Also, the valve 2057 is opened and closed by the torsional operation of the elastic supporting portions 2006 that support the movable portion 2005 swingably after the thinner thickness portion 2004 is broken, hence the opening and closing operation of the valve 2057 being performed stably and reliably. Also, as compared with the conventional opening/closing valve for use of the liquid container that uses the ball, it is possible to secure the opening area of the valve 2057 sufficiently with a smaller space. Further, the response to the opening and closing operation of the valve 2057 is made higher. With the smaller space for the valve 2057, it becomes possible to make the liquid container with the opening/closing valve 2057 smaller accordingly for the ink container 50.

Further, the opening and closing operation of the valve .2057 is performed by the rotational shift of the movable portion 2005 by the torsional elastic deformation of the elastic supporting member 2006, and the shift of the movable portion 2005 is stabilized when the valve 2057 is open. Also, by the restoring force of the elastic supporting portions 2006 which have been deformed by the torsional elasticity, the restoring capability (position and pressure) of the movable portion 2005 is enhanced when the valve 2057 is closed. When the valve 2057 is closed, the sealing capability is secured by the contact between the surfaces of the movable portion 2005 and the abutting portion 2021 themselves, hence obtaining the airtightness of the valve 2057 sufficiently.

The valve 2057 is produced by bending the integrally formed product, which needs the smaller number of the structural components as compared with the conventional opening/closing valve for use of the liquid container using the ball and spring member, and which is structured simpler. Therefore, the cost of the valve 2057 becomes lower to make it possible to obtain the opening valve for use of the liquid container capable of performing the opening and closing operation reliable and stably at the lower costs. Further, using the same material, such as resin (olefine resin, for example), as the material of the ink container 50 and the valve 2057 there is no need for the process to separate the ink container 50 and the valve 2057 for recycling. As a result, the recycling capability of the ink container 50 and the valve 2057 is improved.

In accordance with the present embodiment, the valve 2057 is also applicable to the liquid container other than the ink container 50 provided with the inner wall 54 which is elastically deformable. The opening/closing valve of the present embodiment may be mounted on any type of the liquid container that contains in it the capillary force generating material 13 likewise. However, the effect of the opening/closing valve for use of the liquid container is obtained in a better condition when the opening/closing valve of the present embodiment for use of the liquid container is adopted for the liquid container that contains ink in it directly rather than it is adopted for the liquid container that contains the capillary force generating material or the like which absorbs ink.

Thus, in the mode of the valve shown in FIGS. 41A to 44B, a plurality of operating portions are opened or closed by one supply tube by breaking the thinner thickness portion which is breakable is broken just by one action when the ink container is mounted. Then, the opening and closing operation is implemented stably by the deformation of a plurality of elastic supporting portions. In addition, the complete sealing is implemented in the initial state, such as during the distribution.

Figure 45B:
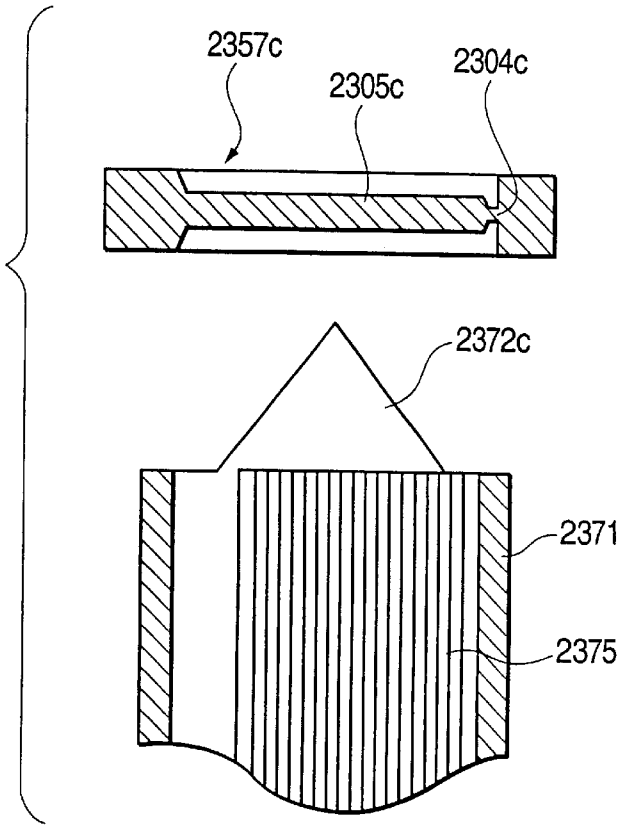
FIGS. 45A and 45B are views which illustrate the unsealed state of the other variational examples of the valve in accordance with the present invention.
Figure 45A:
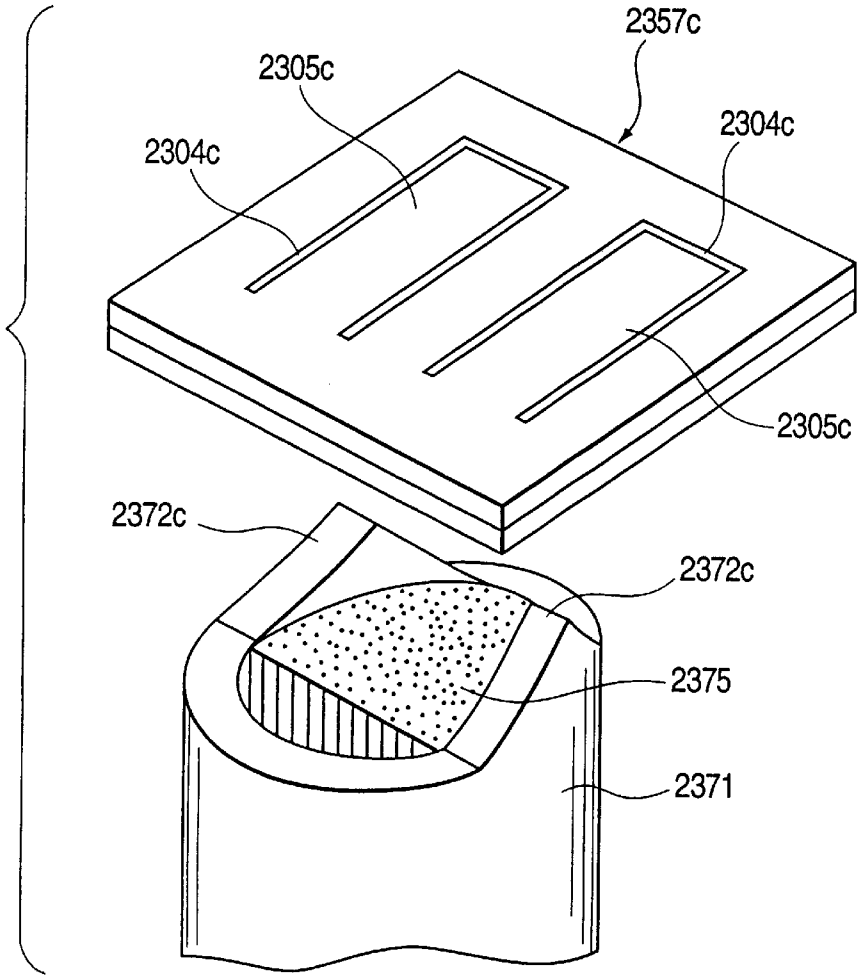

On the other hand, in terms of the reliability of the liquid supply, the valve whose structure is shown in FIGS. 45A and 45B is also effective. FIGS. 45A and 45B are views which illustrate still another variational example of the valve 2057 represented in FIG. 37. FIGS. 45A and 45B illustrate the state before the valve is unsealed, in which this valve opens and closes a plurality of the operating portions by breaking the thinner thickness portion by just one action when one supply tube abuts upon it.

For the valve 2357*c* shown in FIGS. 45A and 45B, two thinner thickness portions 2304*c* are formed so that two movable portions 2305*c* are arranged in parallel. Then, the leading end of the communication tube 2371 is provided with two abutting portions 2372*c* which are formed to depress each of the two movable portions 2305*c*, respectively.

Figure 46B:
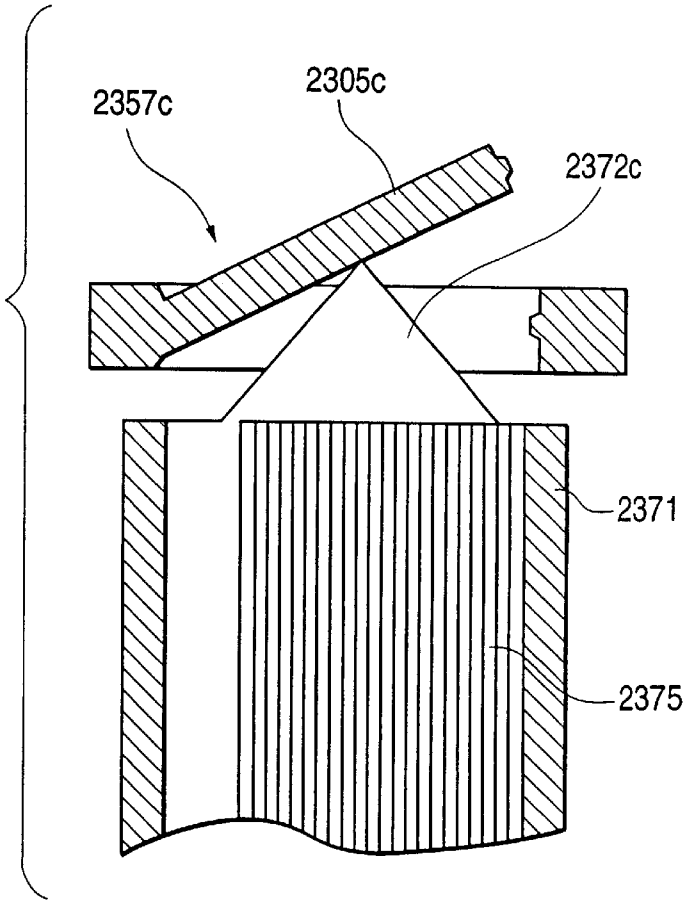
FIGS. 46A and 46B are views which illustrate the unsealed state of the valves shown in FIGS. 45A and 45B, respectively.
Figure 46A:
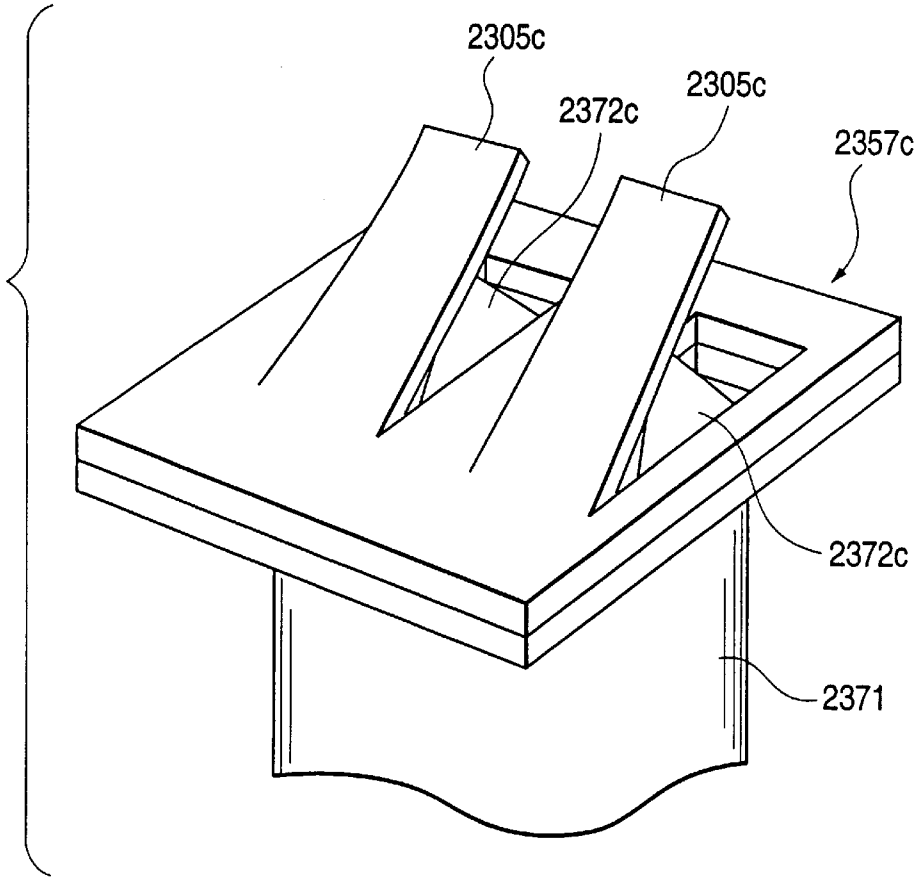

FIGS. 46A and 46B are views which illustrate the state after the valve is connected subsequent to having been broken and unsealed.

As shown in FIGS. 46A and 46B, each of the abutting portions 2372*c* abuts upon each of the movable portions 2305*c* correspondingly. Then, the abutting portions 2372*c* depress the movable portions 2305*c* to break the thinner thickness portion 2304*c*, thus unsealing the valve 2357*c*. Here, the movable portions 2305*c* which becomes operating portion are supported to the valve 2357*c* in a cantilever fashion.

Figure 47A:
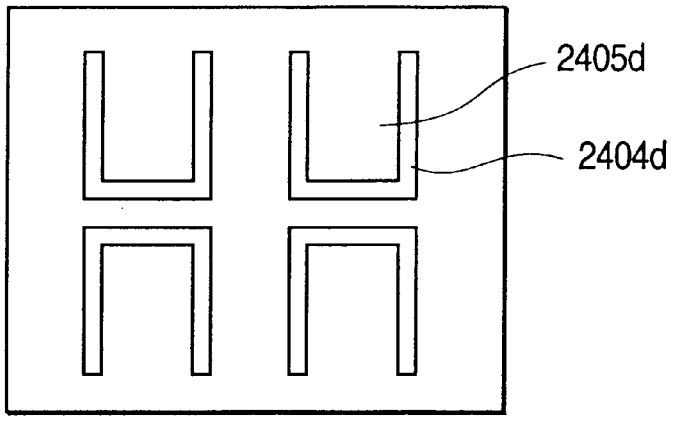
FIGS. 47A, 47B and 47C are views which illustrate still other variational examples of the arrangement of operating portion of the valves shown in FIGS. 45A and 45B, respectively.
Figure 47B:
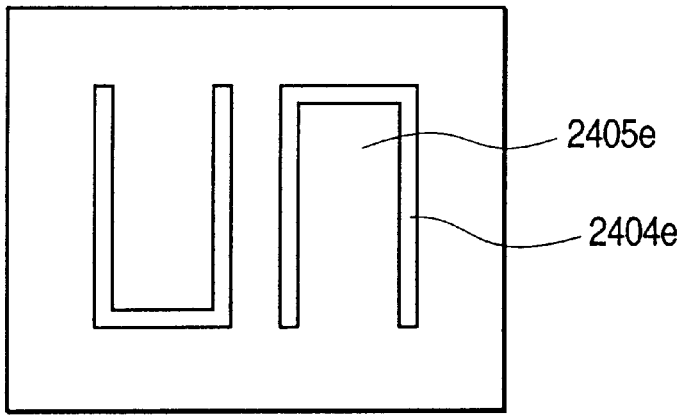
Figure 47C:
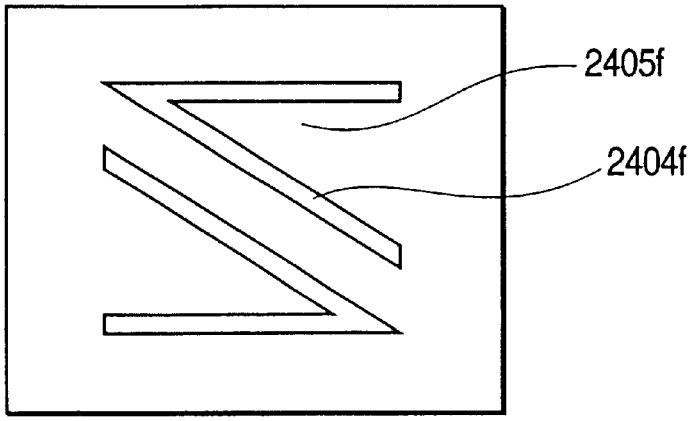

For the valve shown in FIGS. 45A to 46B, the operating portions are two, but it may be possible to determine such numbers and positions arbitrarily depending on the designing specification. FIGS. 47A to 47C are views which illustrate some of the variational example of the arrangement of the operating portions of the valve 2357*c* shown in FIGS. 45A, 45B, 46A and 46B.

The mode of the valve shown in FIG. 47A is such that four operating portions 2405*d* are not only arranged in parallel, but also, concentrated on the center. The thinner thickness portion 2404*d* is formed so as to set the opening/closing valve 2405*d* in such a manner. The mode of the valve shown in FIG. 47B is such that the thinner thickness portion 2404*e* is formed so as to arrange the operating directions of the two operating portions 2405*e* to be different alternately. Here, it is anticipated that there is some obstacle that may impede the deformation of the operating portion 2405*e* in the deforming direction of the operating portion 2405*e*. The mode of the valve shown in FIG. 47C is such that the thinner thickness portion 2404*f* is formed so as to make the surface configuration of the two operating portions 2405*f* smaller than the portion other than the operating portions 2405*f*.

As described above, in accordance with the present invention, the structure is arranged so that the negative pressure is generated by the deformation of the liquid accomodating portion or the liquid accomodating portion is made deformable. Then, the liquid in the liquid accomodating portion is partly retained in the capillary force generating material to deform the liquid accomodating portion when the liquid supply container (liquid supply chamber) and the container that contains the capillary force generating material (the chamber that contains the capillary force generating material) are connected through the communication unit. Thus, this deformed portion becomes the buffer to ease the influence exerted by the air expansion in the liquid accomodating portion due to the environmental changes. Therefore, it becomes possible to enhance the storage efficiency and use efficiency of liquid, lending to making the container smaller still, and to reducing the running costs as well.

Also, since the liquid supply container is positioned on the upper surface of the container that contains the capillary force generating material, it becomes possible to supply liquid more stably. Further, for the container that contains the capillary force generating material, the groove, which is connected with the communication unit for the liquid supply container, is arranged horizontally in the direction nearer to the air communication unit to make it possible to execute the gas-liquid exchange smoothly.

Particularly, the container that contains the capillary force generating material is structured so as to easily retain liquid relatively between the communication unit and the liquid supply unit, hence making it possible to direct the liquid supply to follow the gravitational direction, while maintaining the state of negative pressure in a better condition for the liquid supply container which is replaced in a higher position.

Further, the effects will be demonstrated by the implementation of those embodying the present invention will be described as follows:

The liquid accomodating portion is deformed to keep the balance between the capillary force generating material and the negative pressure. Therefore, even if the air is expanded in the interior of the liquid accomodating portion due to the environmental changes, it is possible to ease the influence thereof by the liquid accomodating portion which is restored to the original configuration if such changes are abrupt. When the changes are moderate, both the capillary force generating material and the liquid accomodating portion are able to ease the influence of such expansion, while maintaining the balance with the capillary force generating material ultimately. Therefore, for the use under various environments, it is anticipated to be able to reduce the buffer space in the chamber that contains the capillary force generating material.

Also, in the process of liquid supply that utilizes the gas-liquid exchange operation, the air is introduced into the interior of the liquid accomodating portion. As a result, liquid in the liquid accomodating portion can be consumed without little remainders. Then, the changes of the negative pressure can be made smaller between the initiation and termination of the liquid led-out from the liquid accomodating portion as compared with the case where the liquid accomodating portion is utilized individually as the container in which negative pressure is generated. Also, as compared with the ink container of conventional type where the chamber that contains the capillary force generating material is arranged adjacent to the ink accomodating chamber, the allowance is higher against the expansion of the air outside thus introduced as described earlier, and also, the liquid accomodating portion is made deformable even when a large amount of liquid is led out in a shorter period of time. Therefore, the liquid supply is performed smoothly from the liquid accomodating portion to the chamber that contains the capillary force generating material. As a result, the liquid supply can be executed in stabilized condition, while the liquid accomodating portion is in use.

Further, the liquid container used for the liquid supply system is capable of shifting liquid in the liquid container to the capillary force generating material by the utilization of the capillary force of the chamber that contains the capillary force generating material at the time of installation, it is possible to use liquid in the liquid container reliably as soon as the liquid container is installed irrespective of the liquid retaining condition of the capillary force generating material in the vicinity of the communication unit. Therefore, it becomes possible to provide the liquid supply system which is excellent in the practical use with the stabilized liquid supply.

Further, there is provided the process in which liquid in the liquid container can be used without introducing the air outside to the liquid accomodating portion. Therefore, it becomes possible to provide the gas supply system and the liquid supply container which can cope with the environmental changes and implement the excellent liquid storage efficiency as well as the usage efficiency in a better condition than the conventional system and container. Therefore, the container of the invention can be made smaller still than the conventional one. At the same time, it becomes possible to provide the liquid supply system which enables the running costs to be curtailed.

Further, with the structure of the present invention which is provided with the liquid led-out passage and the gas preference introducing passage for the communication unit, the gas passage is secured when the structure is applied to the aforesaid liquid supply system. As a result, liquid is led out to the container that contains the capillary force generating material reliably and stably. Moreover, with the gas passage thus secured at the time of the gas-liquid exchange, it becomes easier to perform the gas-liquid exchange without depending on the amount of liquid retained in the container that contains the capillary force generating material.

Also, with the structure provided with the opening different from the opening for use of liquid supply, the supply tube of the present invention makes it possible to allow the liquid that adheres to the supply tube to flow into the supply tube through the opening by the combination with the aforesaid liquid supply system or individually. Therefore, it becomes possible to reduce ink that may adhere to the circumference of the supply tube along with the attachment and detachment operation of the liquid supply container in order to suppress stains that may inconvenience the user and affect the recording apparatus.

Also, for the installation structure of the present invention of the liquid supply container for replacement use, a plurality of levers, each having nail portions on the two wall faces, of those which form the outer wall, are provided substantially in parallel with the direction of attaching and detaching the liquid supply container to the tank holder, as well as in parallel with each other elastically in combination with the aforesaid liquid supply system or individually. As a result, when the liquid supply container for replacement use is detachably mounted on the tank holder, a plurality of the levers provide "play" between the tank holder and the liquid supply container for replacement use, and at the same time, regulate the movement thereof in the direction other than the spright installation. In this manner, it becomes easier to install the liquid supply container for replacement use to the tank holder.

Also, for the ink jet cartridge provided with the tank holder and the ink jet recording apparatus provided with the ink jet cartridge, the levers, which are given bending stresses repeatedly by being warped at the time of installation, are arranged on the liquid supply container for replacement use which is the expendables. Thus, there is no problem as to its durability even when the attachment and detachment of the liquid supply container for replacement use is repeated. In addition, for the ink jet recording apparatus of the present invention, the lever that holds the liquid supply container for replacement use on the tank holder is arranged so as to make the scanning direction of the carriage reciprocation and the direction of the elastic movement of the lever substantially equal. In this manner, it is made possible to absorb the shocks to the liquid supply container for replacement use by means of the lever when the carriage reciprocates.

Also, in accordance with the opening/closing valve of the present invention for use of a liquid container, the opening and closing portion to supply liquid, and a plurality of openings which can be opened and closed for one liquid supply tube are arranged for the opening/closing valve which is installed on the portion which should operate for opening and closing. Therefore, even if one of the operating portions is clogged by dust particles, solidification, or the like, it is still possible to effectuate the stabilized liquid supply.

Also, the opening and closing of the opening/closing valve for use of the liquid container thus structured is arranged to be executable by one action when the liquid container and the liquid supply tube are connected, hence making it possible to effectuate a highly reliable connection with ease.

Also, with the provision of the thinner thickness portion which is not broken in the initial stage, but broken by being depressed, the liquid container is reliably closed by the opening/closing valve for use of the liquid container until the opening/closing valve for use for the liquid container is unsealed when the thinner thickness portion is broken in the initial stage. As a result, in the initial stage, such as during the distribution, the sealing capability of the opening of the liquid container is enhance with the effect that liquid can be stored reliably in the interior of the liquid container.

Further, the opening/closing valve for use of the liquid container comprises the movable portion which is swingable after the aforesaid thinner thickness portion is broken, and the elastic supporting portions to support the movable portion, which is elastically deformable. With the torsional operation of the elastic supporting portions, the opening and closing are effectuated, hence making it possible to operate the opening and closing of the opening/closing valve for use of the liquid container reliably and stably. Also, as compared with the conventional opening/closing valve for use of the liquid container that uses the ball and spring member, the opening area of the opening/closing valve for use of the liquid container can be secured sufficiently with a smaller space. Moreover, there is an effect that the response of the operation of the valve becomes higher.

Also, for the opening/closing valve of the present invention for use of the liquid container, the bearing surface unit and the valve body are integrally formed, and the structure is arranged to bend them for bonding. In this manner, as compared with the conventional opening/closing valve for use of the liquid container that uses the ball and spring member, there is an effect that the structure becomes simpler, and then, the productivity becomes higher at the lower costs simultaneously.

Further, in accordance with the present invention, the liquid container with an opening/closing valve is provided with the aforesaid opening/closing valve for use of the liquid container. Therefore, the opening area of the opening/closing valve for use of the liquid container can be secured sufficiently with a smaller space, hence producing an effect that the liquid container with an opening/closing valve is made smaller accordingly.

Furthermore, for the liquid container with the opening/closing valve of the present invention, the same material, such as resin, can be used for the liquid container and the valve for use thereof. As a result, there is no need for separating them when the liquid container and the opening/closing valve for use thereof are recycled. Therefore, there is an effect that the recycling capability of the liquid container with the opening/closing valve is improved.

What is claimed is:

1. A liquid supply system comprising:

a liquid supply container provided with a deformable liquid accommodating portion for storing liquid in a closed space and being constructed to generate negative pressure; and a capillary force generating material container including a liquid supply portion for supplying liquid to outside, a communicating portion for communicating liquid with said liquid accommodating portion, and an air vent for fluid communication with ambience, said capillary force generating material container for accommodating a capillary force generating material for retaining the liquid, said capillary force generating material container being removably attached to said liquid supply container, and said capillary force generating material container further including a groove connected with said communicating portion and constructed to effect an air-liquid exchange wherein air is introduced into said liquid accommodating portion and the liquid is supplied through said communicating portion, wherein said communicating portion is arranged on the upper surface of said capillary force generating material container, and said liquid supply container is arranged above said capillary force generating material container through said communicating portion to shift liquid in said liquid accommodating portion to said capillary force generating material container, and wherein said groove is formed on an inner wall surface of said capillary force generating material container almost horizontally in a direction nearer to said air vent.

2. A liquid supply system according to claim 1, wherein said capillary force generating material container is constructed to execute said air-liquid exchange at the time of installation.

3. A liquid supply system according to claim 1, wherein liquid is supplied from said capillary force generating material container to the outside with the shift of liquid in said liquid accommodating portion to said capillary force generating material container without said air-liquid exchange, but rather by generating the negative pressure with the deformation of said liquid accommodating portion, and reducing the volume of said liquid supply container.

4. A liquid supply system according to claim 3, wherein the deformation of said liquid accommodating portion is elastic, and after performing the liquid supply from said capillary force generating material container to the outside, the liquid supply is executed from said capillary force generating material container to the outside, while performing said air-liquid exchange.

5. A liquid supply system according to claim 1, wherein said communicating portion is formed for said capillary force generating material container to retain liquid relatively with ease.

6. A liquid supply system according to claim 1, wherein on an inner bottom face of said capillary force generating material container, a wall structure is formed to promote liquid holding in said capillary force generating material between said structure for effecting the air-liquid exchange and said liquid supply portion.

7. A liquid supply system according to claim 6, wherein the capillary force of liquid in the capillary force generating material is changed to make it higher in the vicinity of said communicating portion, and lower away from said communicating portion.

8. A liquid supply system according to claim 6, wherein said capillary force generating material container contains a plurality of capillary force generating materials each having a different capillary force, and of each of said capillary force generating materials, the material having the highest capillary force is arranged between said structure for effecting the air-liquid exchange and said liquid supply portion.

9. A liquid supply system according to claim 6, wherein said capillary force generating material container contains a plurality of capillary force generating materials each having a capillary force becoming smaller from one end to the other end thereof, and each of said capillary force generating materials is arranged to make the capillary force higher on the side nearer to said structure for effecting the air-liquid exchange.

10. A liquid supply system according to claim 1, wherein said capillary force generating material container is shaped substantially in an L-shape when observed from the side.

11. A liquid supply system according to claim 10, wherein said capillary force generating material container is provided with an air introducing passage for effecting the air-liquid exchange substantially in the L-shape in agreement with the shape of said capillary force generating material container.

12. A liquid supply system according to claim 11, wherein a plurality of capillary force generating materials each having different capillary force are arranged and contained in a top-to-bottom direction as a whole substantially in the L-shape together constituting said capillary force generating material, and of said capillary force generating materials, the material having the largest capillary force is arranged in the position nearest to said air introducing passage, and one of the boundaries between each of said capillary force generating materials is positioned between said air introducing passage and said air vent.

13. A liquid container comprising:

a capillary force generating material chamber for containing a capillary force generating material to hold liquid therein, provided with a liquid supply portion to supply liquid to outside, a communicating portion, and an air vent to communicate with air outside, said capillary force generating material chamber further provided with a groove connected with said communicating portion and constructed to effect an air-liquid exchange wherein air is introduced out of said communicating portion and liquid is supplied through said communicating portion; and a liquid supply chamber arranged above said capillary force generating material chamber and provided with a deformable liquid accommodating portion communicated with said capillary force generating material chamber through said communicating portion to which said liquid supply chamber is removably attached, said liquid accommodating portion forming a substantially closed space except for the communication with said capillary force generating material chamber, said liquid accommodating portion being deformable to generate negative pressure as liquid is supplied therefrom, and the communicating portion being arranged on an upper surface of said capillary force generating material chamber, wherein said groove is formed on an inner wall of said capillary force generating material chamber almost horizontally in a direction nearer to said air vent.

14. A liquid container according to claim 13, wherein deformation of said liquid accommodating portion is elastic.

15. A head cartridge holding a liquid supply container attachably and detachably, said liquid supply container being provided with a deformable liquid accommodating portion which generates negative pressure with deformation by containing liquid in a closed space therein, comprising:

a recording head unit for discharging liquid;

a capillary force generating material chamber for containing capillary force generating material to hold liquid therein, and being provided with a liquid supply portion to supply liquid to said recording head unit, and an air vent to communicate with air outside;

a communicating portion arranged on an upper surface of said capillary force generating material chamber to communicate said liquid accommodating portion with said capillary force generating material chamber, said capillary force generating material chamber further provided with a groove connected with said communicating portion and constructed to effect an air-liquid exchange wherein air is introduced out of said communicating portion and liquid is supplied through said communicating portion; and a coupling structure to engage with said liquid supply container and to attachably and detachably hold said liquid supply container on said capillary force generating material chamber in a state where said liquid accommodating portion is communicated with said capillary force generating material chamber by said communicating portion, wherein said groove is formed on an inner wall of said capillary force generating material chamber almost horizontally in a direction nearer to said air vent.

16. An ink jet cartridge comprising:

a recording head unit for discharging liquid;

a capillary force generating material chamber for containing capillary force generating material to hold liquid therein, and being provided with a liquid supply portion to supply liquid to said recording head unit, and an air vent to communicate with air outside;

a liquid accommodating portion removably attached on an upper surface of said capillary force generating material chamber to communicate with said capillary force generating material chamber through a communicating portion, said liquid accommodating portion forming a substantially closed space except for the communication with said capillary force generating material chamber, said liquid accommodating portion being structured by a member which generates negative pressure when liquid is led out from said liquid accommodating portion;

said capillary force generating material chamber further provided with a groove connected with said communicating portion and constructed to effect an air-liquid exchange wherein air is introduced out of said communicating portion and liquid is supplied through said communicating portion, wherein said groove is formed on an inner wall of said capillary force generating material chamber almost horizontally in a direction nearer to said air vent.

17. A head cartridge constructed to separate freely from a detachably mountable liquid supply container for containing liquid, comprising:

a recording head unit for discharging liquid;

a capillary force generating material chamber for containing capillary force generating material to hold liquid therein, and being provided with a liquid supply portion to supply liquid to said recording head unit and with an air vent to communicate with air outside;

a supply tube provided for said capillary force generating material chamber to communicate said liquid supply container with said capillary force generating material chamber when said liquid supply container is installed, wherein said supply tube has in the interior thereof a liquid lead-out passage for leading out liquid from said liquid supply container and a gas-preference introducing passage for preferentially introducing gas to the interior of said liquid supply container, and a slit for communicating the interior of said supply tube with the exterior is formed at a side of said supply tube facing said liquid lead-out passage, the slit being communicated with said capillary force generating material.

18. A head cartridge according to claim 17, wherein a height from the base to the top of said supply tube is greater than that of said gas preference introducing passage on said liquid lead-out passage side.

19. A head cartridge according to claim 17, wherein a closing member is arranged for said capillary force generating material chamber to close space on a circumference of said supply tube from the outside in a state where said liquid supply container is installed.

20. A head cartridge according to claim 19, wherein said closing member comprises a bellows arranged in a position surrounding said supply tube.

21. A head cartridge constructed to separate freely from a detachably mountable liquid supply container for containing liquid, comprising:

a recording head unit to discharge liquid;

a supply tube to communicate said liquid supply container with said recording head by installing said liquid supply container;

a closing member surrounding a base of said supply tube, and closing space on a circumference of said supply tube from the outside when said liquid supply container is installed, wherein said supply tube has in the interior thereof a liquid lead-out passage for leading out liquid from said liquid supply container and a gas-preference introducing passage for preferentially introducing gas to the interior of said liquid supply container, and a slit for communicating the interior of said supply tube with the exterior is formed at a side of said supply tube facing said liquid lead-out passage, the slit being communicated with capillary force generating material in said head cartridge.

22. A head cartridge according to claim 21, wherein said second opening is formed at least on a base of said supply tube, and said liquid supply container is installed from above said recording head unit in a state where a leading end of said supply tube is placed upward.

23. A head cartridge according to claim 21, wherein a liquid absorbent is arranged at least in the position of said first opening of said supply tube.

24. A head cartridge according to claim 23, wherein said liquid absorbent abuts upon capillary force generating material.

25. An ink jet cartridge, comprising:

a recording head unit to discharge ink;

a capillary force generating material chamber for containing capillary force generating material to hold liquid therein, and provided with a liquid supply portion to supply liquid to said recording head unit and with an air vent communicated with air outside;

a liquid supply container provided with a liquid accommodating portion and being separably arranged for detachable mounting on said capillary force generating material chamber, said liquid accommodating portion forming a substantially closed space when installed on said capillary force generating material chamber;

a supply tube arranged for said capillary force generating material chamber to communicate said liquid accommodating portion with said capillary force generating material chamber when installed on said liquid supply container, wherein said supply tube has in the interior thereof a liquid lead-out passage for leading out liquid from said liquid supply container and a gas-preference introducing passage for preferentially introducing gas to the interior of said liquid supply container, and a slit for communicating the interior of said supply tube with the exterior is formed at a side of said supply tube facing said liquid lead-out passage, the slit being communicated with said capillary force generating material.

26. An ink jet cartridge, comprising:

a recording head unit to discharge ink;

a liquid supply container provided with a liquid accommodating portion and being separably arranged for detachable mounting on said recording head unit to form a substantially closed space when installed on said recording head unit;

a supply tube arranged for said recording head unit to communicate said liquid accommodating portion with said recording head unit when said liquid supply container is installed, a closing member surrounding said recording head unit, and closing space on a circumference of said supply tube from the outside in a state where said liquid supply container is installed on said recording head unit, wherein said supply tube has in the interior thereof a liquid lead-out passage for leading out liquid from said liquid supply container and a gas-preference introducing passage for preferentially introducing gas to the interior of said liquid supply container, and a slit for communicating the interior of said supply tube with the exterior is formed at a side of said supply tube facing said liquid lead-out passage, the slit being communicated with capillary force generating material in said ink jet cartridge.

27. An ink jet cartridge according to claim 26, wherein the liquid accommodating portion of said liquid supply container is structured by a deformable member which deforms when liquid is led out to generate negative pressure.

28. An ink jet recording apparatus comprising:

an ink jet cartridge according to claim 26; and holding means to hold said ink jet cartridge, wherein in accordance with electric signals for discharging liquid, liquid is discharged from the recording head unit of said ink jet cartridge for recording on a recording medium.

29. A liquid supply system comprising:

a liquid supply container provided with a deformable liquid accommodating portion for storing liquid in a closed space, said liquid accommodating portion generating negative pressure by being deformed;

a capillary force generating material container detachably mountable to said liquid supply container, and provided with capillary force generating material to hold liquid, an air vent communicated with air outside, and a liquid supply portion to supply liquid to outside, a communicating portion for communicating said liquid supply container with said capillary force generating material container, the communicating portion being provided with a gas preference introducing passage to introduce gas into said liquid supply container, and a liquid lead-out passage to lead out liquid from said liquid supply container;

wherein said communicating portion is a tubular member, and said liquid lead-out passage has capillary force generating material inserted in an axial direction of said tubular member, and wherein said gas preference introducing passage comprises a gap arranged on a position between said capillary force generating material and an inner wall of said tubular member.

30. A liquid supply system according to claim 29, wherein before said liquid supply container is communicated with said capillary force generating material container, a closing structure is arranged to close a circumference of said communication unit.

31. A liquid supply system according to claim 29, wherein when said liquid supply container is communicated with said capillary force generating material container, said liquid lead-out passage is communicated ahead of said gas preference introducing passage.

32. A liquid supply system according to claim 29, wherein the communicating portion is provided with a tubular member, which is inserted into said liquid supply container at the time of installation.

33. A liquid supply system according to claim 29, wherein the communicating portion closes said liquid accommodating portion, and an unsealable sealing material is provided.

34. A communicating portion used for a liquid supply system, comprising:

a liquid supply container having a deformable liquid accommodating portion for containing liquid in a closed space and generating negative pressure by being deformed;

a capillary force generating material container detachably mountable to said liquid supply container, said capillary force generating material container being provided with capillary force generating material, an air vent communicated with air outside, and a liquid supply portion to supply liquid to the outside, wherein said capillary force generating material container is provided with a gas preference introducing passage to introduce gas into said liquid supply container, and a liquid lead-out passage to lead out liquid from said liquid supply container;

wherein said communicating portion comprises a tubular member, and said liquid lead-out passage has capillary force generating material inserted in an axial direction of said tubular member, and wherein said gas preference introducing passage comprises a gap arranged on a position between said capillary force generating material and an inner wall of said tubular member.

35. An ink jet cartridge comprising:

a recording head unit for discharging liquid;

a capillary force generating material chamber for containing capillary force generating material to hold liquid therein, and being provided with a liquid supply portion to supply liquid to said recording head unit, a liquid accommodating portion for containing liquid in a closed space and generating negative pressure by being deformed, a liquid supply container detachably mountable on said capillary force generating material chamber and containing said liquid accommodating portion, a communicating portion for communicating said liquid supply container and said capillary force generating material chamber, said communicating portion being provided with a gas preference introducing passage to introduce gas into said liquid supply container, and a liquid lead-out passage to lead out liquid from said liquid supply container, wherein said communicating portion comprises a tubular member, and said liquid lead-out passage has capillary force generating material inserted in an axial direction of said tubular member, and wherein said gas preference introducing passage comprises a gap arranged on a position between said capillary force generating material and an inner wall of said tubular member.

36. A head cartridge structured for detachable mounting to a liquid supply container provided with a deformable liquid accommodating portion containing liquid in a closed space and generating negative pressure upon deformation, comprising:

a recording head unit to discharge liquid;

a capillary force generating material chamber for containing capillary force generating material to hold liquid therein, and being provided with a liquid supply portion to supply liquid to said recording head unit, and an air vent communicated with air outside, a communicating portion for communicating said liquid supply container and said capillary force generating material container, wherein said capillary force generating material chamber is integrally arranged together with said recording head unit, and the communicating portion is provided with a gas preference introducing passage to introduce gas to said liquid supply container, and a liquid lead-out passage to lead out liquid from said liquid supply container;

wherein said communicating portion comprises a tubular member, and said liquid lead-out passage has capillary force generating material inserted in an axial direction of said tubular member, and wherein said gas preference introducing passage comprises a gap arranged on a position between said capillary force generating material and an inner wall of said tubular member.

37. A liquid supply container provided with a liquid supply portion to supply liquid to an outside thereof, and an air communicating portion communicated with air outside, said liquid supply container being exchangeable and detachably mountable on a capillary force generating material container for containing capillary force generating material holding liquid therein, comprising:

a liquid accommodating portion forming a substantially closed space with the exception of a communicating portion and being deformable when liquid contained in the interior thereof is led out so as to generate negative pressure, a liquid lead-out passage to lead out liquid to said capillary force generating material container, a gas preference introducing passage to introduce gas from said capillary force generating material container;

wherein said communicating portion comprises a tubular member, and said liquid lead-out passage has capillary force generating material inserted in an axial direction of said tubular member, and wherein said gas preference introducing passage comprises a gap arranged on a position between said capillary force generating material and an inner wall of said tubular member.

38. A liquid supply container according to claim 37, wherein said communicating portion is provided with an unsealable sealing material.

* * * * *

UNITED STATES PATENT AND TRADEMARK OFFICE

CERTIFICATE OF CORRECTION

PATENT NO. : 6,460,984 B1
DATED : October 8, 2002
INVENTOR(S) : Hidehisa Matsumoto et al.

It is certified that error appears in the above-identified patent and that said Letters Patent is hereby corrected as shown below:

Title page, Item [54] and Column 1, line 9,
Title, "CARTRIDGE OPENING/CLOSING" should read -- CARTRIDGE, OPENING/CLOSING --.

Column 12,
Line 55, "sown" should read -- shown --.

Column 15,
Line 67, "curbed" should read -- curved --.

Column 16,
Line 28, "holer" should read -- holder --; and
Line 38, "member 57 ink protect" should read -- member 57, ink can be prevented from leaking into --.

Column 17,
Line 14, "form" should read -- from --;
Line 29, "chamber" should read -- chamber 10 --; and
Line 30, "10" should be deleted.

Column 19,
Line 34, "method." should read -- methods. --.

Column 22,
Line 42, "vies" should read -- views --.

Column 24,
Line 28, "In" should read -- in --; and
Line 46, "increase" should read -- increased --.

Column 25,
Line 37, "atmospheric to enable" should read -- atmospheric, --;
Line 42, "proportional" should read -- proportion --; and
Line 63, "environmental" should read -- environment --.

Column 26,
Line 2, "is" should read -- are --; and
Line 25, "discharge" should read -- discharged --.

UNITED STATES PATENT AND TRADEMARK OFFICE

CERTIFICATE OF CORRECTION

PATENT NO. : 6,460,984 B1
DATED : October 8, 2002
INVENTOR(S) : Hidehisa Matsumoto et al.

It is certified that error appears in the above-identified patent and that said Letters Patent is hereby corrected as shown below:

Column 27,
Line 36, "proportional" should read -- proportion --;
Line 38, "position" should read -- positioned --; and
Line 55, "becomes" should read -- become --.

Column 30,
Line 55, "$t=t^a$, $t=t_b$, $t=t^c$," should read -- $t=t_a$, $t=t_b$, $t=t_c$, --.

Column 31,
Line 54, "tin" should read -- the --.

Column 36,
Line 8, "reminders" should read -- remainder --; and
Line 13, "sown" should read -- shown --.

Column 38,
Line 27, "shows" should read -- show --.

Column 39,
Line 24, "priority" should read -- primarily --.

Column 41,
Line 57, "made" should read -- make --.

Column 42,
Line 31, "priority" should be deleted.

Column 43,
Line 42, "O ling" should read -- O-ring --; and
Line 51, "O ling" should read -- O-ring --.

Column 48,
Line 27, "hank" should read -- tank --.

Column 51,
Line 2, "damages." should read -- damage. --; and
Line 54, "sill" should read -- still --.

UNITED STATES PATENT AND TRADEMARK OFFICE

CERTIFICATE OF CORRECTION

PATENT NO. : 6,460,984 B1 
DATED : October 8, 2002
INVENTOR(S) : Hidehisa Matsumoto et al.

It is certified that error appears in the above-identified patent and that said Letters Patent is hereby corrected as shown below:

Column 53,
Line 34, "disabled discharged" should read -- disabled, discharges --;
Line 43, "conation" should read -- condition --;
Line 44, "restor" should read -- restore --; and
Line 47, "cases," should read -- case, --.

Column 55,
Line 56, "O ling" should read -- O-ring --.

Column 61,
Line 7, "are" should read -- is --; and
Line 9, "breakable is" should read -- breakable, --.

Column 64,
Line 6, "is the expendables." should read -- are expendable --.

Signed and Sealed this

Twenty-second Day of April, 2003

JAMES E. ROGAN
*Director of the United States Patent and Trademark Office*